US009080335B2

(12) United States Patent
Kreller

(10) Patent No.: US 9,080,335 B2
(45) Date of Patent: Jul. 14, 2015

(54) SCAFFOLDING COMPONENT WITH AT LEAST ONE CONNECTION HEAD AND METHOD FOR FASTENING A SCAFFOLDING COMPONENT HAVING AT LEAST ONE CONNECTION HEAD TO A VERTICAL SCAFFOLDING ELEMENT

(75) Inventor: Helmut Kreller, Bad Rappenau (DE)

(73) Assignee: WILHELM LAYHER VERWALTUNGS-GMBH, Gueglingen-Eibensbach (DE)

( * ) Notice: Subject to any disclaimer, the term of this patent is extended or adjusted under 35 U.S.C. 154(b) by 53 days.

(21) Appl. No.: 13/824,633

(22) PCT Filed: May 31, 2012

(86) PCT No.: PCT/DE2012/100164

§ 371 (c)(1), (2), (4) Date: Mar. 18, 2013

(87) PCT Pub. No.: WO2012/163349

PCT Pub. Date: Dec. 6, 2012

(65) Prior Publication Data

US 2013/0330117 A1 Dec. 12, 2013

(30) Foreign Application Priority Data

Jun. 1, 2011 (DE) ..... 10 2011 050 809
Jun. 1, 2011 (DE) ..... 10 2011 050 811

(51) Int. Cl.

*E04G 7/02* (2006.01)
*E04G 7/30* (2006.01)
*E04G 7/32* (2006.01)

(52) U.S. Cl.

CPC *E04G 7/02* (2013.01); *E04G 7/307* (2013.01); *E04G 7/32* (2013.01); *Y10T 29/49826* (2015.01); *Y10T 403/30* (2015.01); *Y10T 403/4645* (2015.01)

(58) Field of Classification Search

CPC ..... E04G 7/32; E04G 7/307; E04G 7/02; F16B 7/0486
USPC ..... 403/49, 409.1; 182/186.7, 186.8; 52/638

See application file for complete search history.

(56) References Cited

U.S. PATENT DOCUMENTS 4,044,523 A 8/1977 Layher (Continued)

FOREIGN PATENT DOCUMENTS

AT 360 733 1/1981

(Continued)

OTHER PUBLICATIONS

International Search Report of PCT/DE2012/100164, Nov. 28, 2012.

(Continued)

*Primary Examiner* — Joshua Kennedy
(74) *Attorney, Agent, or Firm* — Collard & Roe, P.C.

(57) ABSTRACT

The invention relates to a scaffolding component (45) with at least one connection head (61) for forming a releaseable connection with a vertical scaffolding element (41) extending in the direction of a longitudinal axis (47). On this scaffolding element is fastened a projection (44) which extends transversely to its longitudinal axis (47) and which has an aperture (55) for the insertion of a wedge (62). The connection head has an upper head part (74) with an upper wedge opening (80) and a lower head part (75) with a lower wedge opening (81), for the wedge (62) which can be inserted through the wedge openings (80, 81). Disposed between the upper head part (74) and the lower head part (75) is a slot (67) which is open towards the front and which is intended for the fitting of the connection head (61) onto the projection (44). The connection head (61) has a wedge-support body (85) with wedge-support surfaces which is arranged above the slot (67) so as to engage over the latter towards the front, for vertically supporting the wedge (62) in the region of its lower wedge end against unintended movement of the wedge (62) vertically downwardly into a blocking position. Above the wedge-support surfaces of the wedge-support body (85), the connection head (61) has a wedge-pivoting abutment (86).

26 Claims, 42 Drawing Sheets

(56) References Cited

U.S. PATENT DOCUMENTS

| | | | | | |
|---|---|---|---|---|---|
| 4,530,616 | A | | 7/1985 | Roux | |
| 4,595,077 | A | * | 6/1986 | Buttgereit | 182/186.8 |
| 4,815,249 | A | * | 3/1989 | Szucs | 52/638 |
| 4,840,513 | A | * | 6/1989 | Hackett | 403/49 |
| 4,867,274 | A | | 9/1989 | Langer | |
| 4,958,702 | A | | 9/1990 | Langer | |
| 5,024,037 | A | | 6/1991 | Ono | |
| 5,127,757 | A | * | 7/1992 | Langer | 403/49 |
| 5,207,527 | A | * | 5/1993 | Duncan et al. | 403/246 |
| 5,217,314 | A | * | 6/1993 | Perruelle | 403/49 |
| 5,411,113 | A | | 5/1995 | Lubinski | |
| 5,868,223 | A | * | 2/1999 | Lubinski | 182/179.1 |
| 5,954,921 | A | | 9/1999 | Dahmen et al. | |
| 5,961,240 | A | | 10/1999 | Bobrovniczky | |
| 6,027,276 | A | | 2/2000 | Schwoerer | |
| 2006/0153631 | A1 | | 7/2006 | Stringer | |
| 2010/0078263 | A1 | | 4/2010 | Kreller | |
| 2012/0181111 | A1 | * | 7/2012 | Brinkmann | 182/186.8 |

FOREIGN PATENT DOCUMENTS

| | | | | | |
|---|---|---|---|---|---|
| CH | 659 282 | | | 1/1987 | |
| CN | 103255910 | | * | 5/2013 | E04G 7/12 |
| CN | 103255910 | A | | 8/2013 | |
| DE | 1 972 690 | | | 11/1967 | |
| DE | 25 23 879 | | | 12/1975 | |
| DE | 24 49 124 | | | 4/1976 | |
| DE | 26 54 439 | | | 6/1978 | |
| DE | 35 46 045 | | | 6/1987 | |
| DE | 38 24 823 | | | 1/1990 | |
| DE | 44 30 069 | | | 2/1996 | |
| DE | 196 30 225 | | | 1/1997 | |
| DE | 195 47 382 | | | 6/1997 | |
| DE | 198 06 093 | | | 8/1999 | |
| DE | 202 00 728 | | | 4/2002 | |
| DE | 101 11 279 | | | 7/2002 | |
| DE | 101 12 370 | | | 9/2002 | |
| DE | 102 25 403 | A1 | | 3/2003 | |
| DE | 202 21 675 | | | 11/2006 | |
| DE | 20 2006 015 586 | | | 2/2008 | |
| EP | 0 004 806 | | | 10/1979 | |
| EP | 0 112 831 | | | 7/1984 | |
| EP | 0 276 487 | | | 8/1988 | |
| EP | 0 351 703 | | | 1/1990 | |
| EP | 0 423 514 | | | 4/1991 | |
| EP | 0 486 381 | | | 5/1992 | |
| EP | 486381 | A1 | * | 5/1992 | E04G 7/30 |
| EP | 0 780 583 | | | 6/1997 | |
| EP | 0 936 327 | | | 8/1999 | |
| EP | 0 777 804 | B1 | | 11/1999 | |
| EP | 1 219 761 | | | 7/2002 | |
| EP | 1 911 907 | | | 4/2008 | |
| FR | 2 273 220 | | | 12/1975 | |
| FR | 2 520 482 | | | 7/1983 | |
| FR | 2 529 931 | | | 1/1984 | |
| FR | 2 553 456 | | | 4/1985 | |
| FR | 2 752 593 | A3 | | 2/1998 | |
| FR | 2 912 476 | | | 8/2008 | |
| GB | 1 469 807 | | | 4/1977 | |
| GB | 2061445 | A | * | 5/1981 | E04G 7/30 |
| GB | 2 165 021 | | | 4/1986 | |
| GB | 2165021 | | * | 9/1986 | F16B 7/22 |
| GB | 2 369 665 | | | 6/2002 | |
| JP | 50-023924 | | | 3/1975 | |
| JP | 10-37455 | A | | 2/1998 | |
| JP | 11-022186 | A | | 1/1999 | |
| JP | 11022186 | A | * | 1/1999 | E04G 7/22 |
| JP | 11-050656 | A | | 2/1999 | |
| JP | 11-62213 | A | | 3/1999 | |
| JP | 11-182027 | A | | 7/1999 | |
| JP | 2004-092253 | A | | 3/2004 | |
| JP | 2013-256857 | A | | 12/2013 | |
| JP | 2013256857 | A | * | 12/2013 | E04G 7/32 |
| WO | WO 83/02637 | | | 8/1983 | |
| WO | WO 94/16172 | | | 7/1994 | |
| WO | WO 97/27372 | | | 7/1997 | |
| WO | WO 02/066768 | | | 8/2002 | |
| WO | WO 2008/043339 | | | 4/2008 | |

OTHER PUBLICATIONS

International Search Report of PCT/DE2012/100163, Nov. 28, 2012.
International Search Report of PCT/DE2012/100005, May 9, 2012.
European Search Report dated Oct. 4, 2012 in European Application No. 12 17 0282 with English translation of relevant parts.
European Search Report dated Jul. 17, 2012 in European Application No. 12 16 8022 with English translation of the relevant parts.
European Search Report dated Jul. 18, 2012 in European Application No. 12 16 8019 with English translation of the relevant parts.
European Search Report dated Jul. 17, 2012 in European Application No. 12 16 8012 with English translation of the relevant parts.
Australian Examination Report in Australian Application No. 2012265293, dated Oct. 31, 2014.
Australian Examination Report in Australian Application No. 2012265292, dated Oct. 31, 2014.
Australian Examination Report in Australian Application No. 2012239235, dated Nov. 7, 2014.
European Examination Report dated Aug. 4, 2014 in European Application No. 12 170 282.3 with English translation of relevant parts.
European Examination Report in 12 170 282.3 dated Mar. 19, 2015, with English translation of relevant parts.

* cited by examiner

SCAFFOLDING COMPONENT WITH AT LEAST ONE CONNECTION HEAD AND METHOD FOR FASTENING A SCAFFOLDING COMPONENT HAVING AT LEAST ONE CONNECTION HEAD TO A VERTICAL SCAFFOLDING ELEMENT

CROSS REFERENCE TO RELATED APPLICATIONS

This application is the National Stage of PCT/DE2012/100164 filed on May 31, 2012, which claims priority under 35 U.S.C. §119 of German Application No. 10 2011 050 811.2 filed on Jun. 1, 2011 and German Application No. 10 2011 050 809.0 filed on Jun. 1, 2011, the disclosures of which are incorporated by reference. The international application under PCT article 21(2) was not published in English.

BACKGROUND OF THE INVENTION

1. Field of the Invention

The invention relates to a scaffolding component having at least one connection head for formation of a releasable connection, particularly of a connection node, with a vertical scaffolding element that extends in the direction of a longitudinal axis, onto which element a projection that extends transversely, in other words in a transverse direction, relative to the longitudinal axis of the scaffolding element, and has a recess in the form of a perforation for inserting a wedge through it, is fastened, and whereby the connection head has an upper head part having an upper wedge opening, and a lower head part having a lower wedge opening, for the wedge that can be inserted through the wedge openings, and whereby a slot that is open toward the front is disposed between the upper head part and the lower head part, for mounting the connection head onto the projection, particularly in an essentially horizontal mounting direction, and whereby the slot is delimited toward the top and toward the bottom with slot surfaces that extend on both sides of a horizontal center plane of the slot.

The invention also relates to a method for fastening a scaffolding component having at least one connection head onto a vertical scaffolding element that extends in the direction of a longitudinal axis, onto a projection that extends transversely, in other words in a transverse direction, relative to the longitudinal axis of the scaffolding element, and has a recess in the form of a perforation for inserting a or the wedge through it, whereby for formation of a releasable connection, particularly of a connection node, in which the connection head is locked in place, with shape fit, on the vertical scaffolding element, using the wedge that has been inserted through the opening, the scaffolding component with the connection head with its slot, or the connection head with its slot, is mounted onto or pushed onto the projection of the vertical scaffolding element, in an essentially horizontal mounting direction.

2. The Prior Art

From DE 24 49 124 A1, EP 0 423 514 A2, EP 0 276 487 A2, DE 198 06 093, and EP 0 936 327 A1, for example, scaffolding constructions having connection nodes of a modular scaffolding are evident, onto the posts of which perforated disks are fastened, spaced apart from one another, in the axial direction, in a grid dimension, in order to be able to connect scaffolding components in the form of connection, holding and/or support elements there, for example longitudinal bars, transverse bars and/or diagonals. Such a modular scaffolding has been known for many years as the LAYHER Allround scaffolding system. The connection nodes or scaffolding nodes of this modular scaffolding are also known under the designation LAYHER Allround force-transmitting node.

In these connection nodes, a particularly stable, releasable connection between the scaffolding components having connection heads, particularly rod elements such as scaffolding tubes or scaffolding bars, and the scaffolding posts provided with the perforated disks, is achieved. These connection heads have an upper head part and a lower head part and a horizontal slot that extends between them, which slot is open toward the front and to the sides. The upper head part has an upper wedge opening, and the lower head part has a lower wedge opening, for a wedge that can be inserted through the wedge openings. The wedge, which consists of flat material, particularly of steel, is undetachably connected with the connection head. For this purpose, the wedge has a retainer in the form of a rivet on its lower wedge end, which has rivet heads that project beyond the flat side surfaces of the wedge. Usually, a truss-head rivet or a blind rivet can be used. Preferably, the truss-head rivet can be riveted by machine, while the blind rivet can preferably be riveted by hand. The upper wedge opening of the upper head part is structured as a longitudinal slot having a slot width that is only slightly greater than the thickness of the wedge that is inserted through the upper wedge opening with its lower wedge end. The rivet projects laterally, with its rivet heads, beyond the wedge, with a rivet width that is greater than the slot width of the longitudinal slot of the upper wedge opening. As a result, the wedge cannot be pulled upward out of the connection head, but rather only up to an impact of the rivet heads on an inner delimitation surface of an upper wall part of the upper head part of the connection head. The lower wedge opening of the lower head part is greater than the upper wedge opening of the upper head part, specifically so great that the lower wedge end, with the rivet fastened there, can easily be inserted through the lower wedge opening.

For fastening the connection head to a perforated disk of a scaffolding post, the wedge is first, if this is not already the case, pulled upward in the vertical direction, and then pivoted toward the rear, in a direction toward an upper outer surface of the scaffolding component, particularly toward an upper outer surface of a rod element or scaffolding tube firmly connected with the connection head, for example of a scaffolding bar, preferably until the wedge lies against the said outer surface, so that the wedge is in an installation position in which it is shifted toward the rear. In this manner, the wedge remains in the said installation position during subsequent mounting of the scaffolding component with its connection head onto the perforated disk, in which position the connection head can be pushed onto the perforated disk, without any blockage by the wedge, in an essentially horizontal mounting direction, all the way into a mounting position, in which the wedge openings of the connection head are situated vertically above the perforated disk, so that subsequently, the wedge, after having been pivoted from the said installation position into a vertical introduction position, can move downward, as the result of gravity, specifically either immediately through a perforation of the perforated disk and through the lower wedge opening, into a locking position, or first onto the top side of the perforated disk, so that after subsequent displacement of the connection head on the perforated disk to a push-on position, in which the lower wedge end comes into alignment with a perforation of the perforated disk, the wedge can then move through this perforation and through the lower wedge opening, into a locking position, as the result of gravity. In the locking position, in each instance, the connection head is releasably locked to the perforated disk, with shape fit, to prevent unintentional release in all directions. Proceeding from this locking position, the wedge can be wedged in place by means of a hammer blow from above, onto its upper drive-in surface, in such a manner that the connection head is braced against the scaffolding post by way of the front contact support surfaces of its upper head part and its lower head part, which support themselves on the outer surface of the scaffolding post, and against the perforated disk by way of the wedge.

In practice, it is possible, in the case of specific ones of the aforementioned connection heads, not only to pivot the wedge, after it has been pulled out into an upper extraction position, in which the rivet impacts against the said inner surface of the upper wall part of the upper head part, toward the rear, into the said installation position, but also to pivot the wedge toward the front, into a position in which the upper wedge end projects beyond the connection head or its front contact support surfaces, toward the front. The wedge can remain lying in this position, pivoted toward the front, because of the lever conditions that occur, as the result of gravity, and as the result of friction forces, if the scaffolding component with the connection head is held in an essentially horizontal position. In this position, pivoted toward the front, the wedge is supported, on the one hand, on an upper wall part of the upper head part of the connection head, with a wedge face surface that is then a lower surface, on a front first support location, and is supported, on the other hand, on an inner rear second support location, by way of its rivet or by way of the rivet heads of the latter, on an inner wall of the upper head part of the connection head. It is furthermore possible, in practice, in the case of some of these connection heads, to support the wedge, when it is in such a position, pivoted toward the front, on or on top of an inner support crosspiece that delimits the upper wedge opening toward the rear and extends transverse to the mounting direction, with its lower wedge end, which is the rear wedge end in this position. This support crosspiece delimits the wedge accommodation space of the connection head toward the front, in order to prevent the wedge from slipping through downward when the connection head is not set onto a perforated disk and when the wedge has been inserted through the two wedge openings.

For the purpose of fastening the scaffolding components discussed above, according to the state of the art, with their connection head, onto a perforated disk of a vertical scaffolding element, positioning of the wedge as described above, which is possible in practice, in a position pivoted toward the front, before being mounted onto the perforated disk, is completely unsuitable. This is because in a case in which an attempt were to be made to fasten one of the connection heads known from the state of the art onto a perforated disk of a scaffolding post, in a manner usual in practice, in a position in which it projects beyond or in front of the connection head, toward the front, with its wedge, the wedge would fall downward with its lower wedge end, before the connection head has reached the perforated disk, as the result of gravity, after contact of the wedge with its upper, in this position front wedge end with the outer surface of the scaffolding post, and in the event of continued movement of the connection head, with the wedge projecting toward the front in this manner, in a radial direction, toward the scaffolding post, with the result that the wedge, which would then have fallen downward, crossing the horizontal slot, would block mounting of the connection head, with its slot, onto the perforated disk, and would therefore make it impossible. The result would be that continued mounting of the connection head, with the goal of subsequent locking of the connection head to the perforated disk, by means of the wedge inserted through a perforation of the perforated disk, would not be possible without previously pulling the wedge upward to above its slot. Aside from this, for this purpose the installer would have to be at a maximal distance limited by his personal reach, in other words in the vicinity of the perforated disk onto which the connection head is supposed to be mounted, in order to be able to pull the wedge upward there. This would make installation of the scaffolding components from a secured position impossible, or at least make it more difficult. Furthermore, the installer would have to undertake a new mounting attempt.

For this reason, in practice, the previously known scaffolding components, which are structured in the same manner or similar to what is disclosed in the documents mentioned above, are fastened onto the perforated disks with their connection heads, exclusively using an installation method during which, before the connection head is set onto the perforated disk, the wedge, as described above, is first moved into an installation position in which it is pivoted toward the rear, and in which method the scaffolding component, with its connection head with the latter's slot leading, is set onto the perforated disk in this installation position of the wedge, and in which method, after the connection head has been set onto the perforated disk, the installer must pivot the wedge manually back into a vertical position, while at a maximal distance from the perforated disk restricted by his personal reach or arm length, from which position the wedge can move into its locking position as the result of gravity. According to this previous method, no secured pre-assembly, particularly no leading railing, proceeding from a secure position of the installer, is possible with these previous scaffolding components.

From WO 97/27372 A, an arrangement for formation of a scaffolding node with a transverse strut and pillar has become known, from the outer surface of which at least one projection that projects radially relative to the pillar axis, in the form of a perforated disk having recesses, projects. A scaffolding component, for example a strut, can be fastened onto the perforated disk. The strut has a wedge-shaped hook on at least one of its ends, which hook projects transverse to the longitudinal axis of the strut, beyond its outer surface. With this hook the strut can be fastened into a recess of the perforated disk, in that the hook is inserted into and through the recess, in a position in which it projects downward, in the vertical direction, from top to bottom. A releasable wedge is provided at the same end of the strut, which wedge is displaceable relative to the hook, in the vertical direction. This wedge projects, before the hook is completely introduced into a recess of the perforated disk, downward and laterally beyond the contour of the hook, so that this wedge end comes to lie on an edge of the recess or on the top of the perforated disk in a region next to the recess, during vertical introduction of the hook, and whereby the wedge end is pushed upward and, at the same time, displaced in the transverse direction relative to the hook, all the way into a wedge position in which the said lower wedge end of the wedge can pass through the recesses and, after passing through the recess, can move laterally into a spread position, in which vertical or plumb-line movement of the strut end upward, through the recess, is blocked. The strut can be inserted into the recesses of the perforated disk fastened onto the pillar, proceeding from its end facing away from the scaffolding node, from above, vertically downward, whereby the wedge moves into its introduction position that allows introduction of the hook into the recess, by means of its impact on the edge section of the perforated disk that surrounds the recess. After the hook passes through the recess, the wedge automatically moves into a locking position, as the result of gravity, or as the result of a pressure or impact on its upper end, in which position it projects away from the hook profile to such an extent that in this spread position, hook and wedge cannot pass through the recess, and the wedge can only be moved out of this spread position by means of a force that acts on it, for example by means of a hammer blow from below onto the lower end of the wedge. In the case of this arrangement, the installer can first hang the strut into the recess with the hook, so that the strut is already provisionally held in this position, and the scaffolding section can be walked on, if necessary, and afterward, by pushing the strut end toward the pillar, in a horizontal direction, the wedge falls downward, for example as the result of gravity. In the transition phase, however, in which the strut is locked to the perforated disk only provisionally, by way of the hook inserted through a recess of the perforated disk, the strut can be lifted upward off the perforated disk again without hindrance. In the worst case, unintentional or accidental lift-off of the strut that is held in place only provisionally can occur. This represents a significant safety problem. Furthermore, this design and the related fastening procedure cannot be transferred to scaffolding components and methods for fastening them, as they are disclosed in the documents mentioned initially, or cannot be easily transferred.

SUMMARY OF THE INVENTION

It is a task of the invention to make available a scaffolding component of the type mentioned initially, and a method for fastening a scaffolding component, preferably one of this type, onto a vertical scaffolding element, with which or in the case of which installation with wedge locking of the scaffolding component, with its connection head, onto the vertical scaffolding element or onto its projection can be carried out by an installer in particularly secure and nevertheless comparatively simple and easy manner, particularly from a secure position or secured location of this installer, particularly in order to allow secure pre-assembly of the scaffolding component, for example a leading railing.

This task is accomplished by means of the characteristics described herein, or, in the case of a scaffolding component of the type mentioned initially, particularly in that the connection head has a wedge support body having wedge support surfaces, disposed above the slot and engaging over the slot toward the front, for vertical support of the wedge in the region of its lower wedge end or at its lower wedge end, against unintentional movement of the wedge vertically downward into a blockage position, in which mounting, particularly complete mounting of the connection head with its slot in an essentially horizontal mounting position, particularly radially, onto the projection would be blocked, or against unintentional movement of the wedge vertically downward, crossing the slot, in order to allow mounting of the connection head, with its slot in an essentially horizontal mounting direction, onto the projection, without blockage by the wedge, and that the wedge, when it is supported on the wedge support surfaces of the wedge support body, preferably in the region of its lower wedge end or with its lower wedge end, and projects upward out of the upper head part with a wedge part, can be pivoted into an imaginary vertical plane that runs perpendicular to the horizontal center plane of the slot, preferably in the transverse center of the connection head, particularly the vertical plane of symmetry of the connection head, which is structured to be symmetrical for this purpose, relative to the connection head, into an impact pivot position that is inclined toward the front, in which position the wedge projects in front of or beyond the upper head part of the connection head, toward the front, and that the connection head has a wedge pivot counter-bearing above the wedge support surfaces of the wedge support body, which surfaces allow vertical support of the wedge, onto which counter-bearing the wedge can be laid or is laid when it is supported on the wedge support surfaces of the wedge support body, in the region of its lower wedge end, and about which the wedge can be pivoted, when it is laid against the wedge pivot counter-bearing, toward the rear with its wedge part that projects toward the top beyond the upper wedge opening, and, at the same time, toward the front with its lower wedge end, in order to achieve liberation of the wedge, in such a manner that the wedge can automatically move all the way into or through the lower wedge opening as the result of gravity and/or with the support of spring force, vertically toward the bottom, while crossing the slot.

According to an advantageous embodiment of the invention, the wedge support surfaces of the wedge support body can be disposed at a slight vertical distance above wall parts that delimit the slot toward the top, particularly above horizontal slot edges or slot surfaces of the slot. As a result, a particularly stable installation intermediate position of the wedge that is supported on the wedge support surfaces of the wedge support body can be achieved. Furthermore, more secure release or liberation of the wedge support in this manner can be achieved in this way, so that the wedge, with its lower wedge end, can quickly and securely move into the lower wedge opening, crossing the slot.

The above advantages can be implemented in particularly advantageous manner if the wedge support surfaces of the wedge support body are disposed at a vertical distance above wall parts that delimit the slot toward the top, particularly above the horizontal slot edges or slot surfaces, which distance is less than half the slot height or the slot width configured in the vertical direction.

It is furthermore greatly advantageous if the wedge support body is disposed in the region of the vertical slot edges or surfaces of its slot bottom that delimit the slot toward the rear and/or in a rear region of the slot. In this way, not only can a further improvement in the sense of the above advantages be achieved, but also a particularly compact or space-saving solution can be achieved, so that the connection dimensions and/or outside dimensions of the connection head according to the invention can be particularly adapted to the general design conditions of the modular system.

According to a particularly advantageous embodiment of the invention, it can be provided that the wedge support body delimits the slot with an upper slot surface toward the top. In this way, not only can a further improvement in the sense of the above advantages be achieved, but also, advantageous possibilities for formation of a shoulder that extends downward are created by this, and, by means of this shoulder, a particularly advantageous orientation of the connection head relative to the perforated disk is created, for the purpose of implementation of positive and negative bending stresses that are approximately equal, when the connection head is set onto the projection with its slot and braced against the vertical scaffolding element there, with its wedge.

According to a further development of the invention, it can be provided that the wedge support surfaces are inclined at a slant toward the front and toward the bottom in the region of the front, lower end of the wedge support body that faces the lower head part, and are structured to run concave or in a straight line when viewed in a vertical section that contains the imaginary vertical plane. In this way, the wedge, proceeding from its installation position, can be guided particularly well and can be moved into a release position in simple and easy manner, with the formation of only comparatively slight friction forces.

According to a particularly preferred embodiment of the invention, it can be provided that the wedge support body is structured with an accommodation pocket for accommodating and supporting at least one wedge part provided at the lower wedge end of the wedge. In this way, the wedge can have been or can be securely supported in its transition installation position, with shape fit, and consequently against shaking and/or vibrations.

If the accommodation pocket, when viewed in the vertical direction, is configured between the wedge pivot counter-bearing and the slot, the above advantages can be implemented to a particular degree.

It can be particularly advantageous if the accommodation pocket, when viewed in a vertical section that contains the imaginary vertical plane, has an inside contour that corresponds to a corresponding outside contour of a or the wedge part provided at the lower wedge end of the wedge. In this way, optimally secure support of the lower wedge end can be achieved.

An embodiment that is particularly advantageous from functional aspects can be achieved in that the wedge pivot counter-bearing is disposed in the region of the upper wedge opening and delimits the upper wedge opening toward the rear and toward the bottom. In this way, not only can the above advantages be implemented in particularly advantageous manner, but also the wedge pivot counter-bearing can simultaneously serve as a wedge securing body that delimits the wedge accommodation space, so that when the connection head is not mounted onto the perforated disk, but rather is handled separately, the wedge cannot fall downward out of the connection head when it is inserted through the upper wedge opening and through the lower wedge opening. Furthermore, in this manner, advantageous possibilities can be created in that the wedge, if it is pulled sufficiently far upward out of the upper wedge opening, can be pivoted completely toward the rear, onto an outer surface of a component of the scaffolding component firmly connected with the connection head, particularly onto a rod part or onto a scaffolding tube. For this purpose, it can be provided that the wall part of the wedge pivot counter-bearing that delimits the upper wedge opening toward the front and the rear is configured parallel to the said outer surface of the said component of the scaffolding component, or parallel to its longitudinal axis. Preferably, the wall part of the wedge pivot counter-bearing that delimits the upper wedge opening toward the front and the rear can be delimited, as a whole, with a horizontal outer surface, which is situated at the same height as the said outer surface of the said component, or which extends horizontally at a height slightly below the height of the outer surface.

It is practical if the wedge support body and/or the wedge pivot counter-bearing is/are configured on the upper head part of the connection head and/or on a connection part of the connection head, onto which a component, particularly a rod element of the scaffolding component is fastened. In this way, particularly advantageous pivoting and release conditions can be achieved.

It can furthermore be advantageous if the wedge support body and/or the wedge pivot counter-bearing are disposed in the interior of the connection head. In this way, a particularly compact construction is obtained. As a result, a configuration of the connection head or of the scaffolding component that has this connection head is possible, which allows meeting the needs for the ability to combine or interchange the scaffolding component according to the invention with the previous scaffolding components, in excellent manner.

According to a particularly preferred further development of the invention, it can be provided that the connection head has centering support surfaces for the wedge, particularly inner surfaces, disposed on both sides of the vertical plane, between which surfaces the wedge is laterally supported in the region of its lower wedge end, with little play, when the wedge is supported on the wedge support surfaces of the wedge support body. In this way, lateral tilting of the wedge that passes through the upper wedge opening, relative to the vertical plane, can be minimized, thereby making it possible to achieve more precise or secure activation and release of the wedge during movement of the connection head, with its slot, in a or the essentially horizontal mounting direction, toward the projection, and also during mounting of the connection head, with its slot, onto the projection.

Further improved securing of the wedge in its transition installation position, to prevent lateral tilting and, accordingly, to achieve improved general conditions for activation and release of the wedge, can be achieved if the centering support surfaces are disposed below the wall parts of the upper head part that delimit the upper wedge opening and/or below the wedge pivot counter-bearing.

The above advantages can be implemented to a particular degree if the centering support surfaces are disposed in the region or at the height of the wedge support body or in the region or at the height of the accommodation pocket, and/or if the centering support surfaces delimit a or the accommodation pocket laterally.

A design that can be improved even further in the sense of the above advantages can be achieved in that at least two or precisely two centering support tabs that extend toward the front are provided, which tabs are disposed at a horizontal transverse distance relative to one another, preferably parallel to one another, delimited by the centering support surfaces that lie opposite.

According to an advantageous embodiment of the invention, it can be provided that the upper wedge opening is delimited, at least on one side or on sides that lie opposite one another, by an upper wall part, or an upper wall part, in each instance, of the upper head part, which part is delimited, into the interior of the connection head, by an inner, slanted wedge guide edge that extends toward the rear and toward the bottom, along which edge a retainer provided in the region of the lower wedge end or on the lower wedge end, preferably a thickening, particularly at least one rivet head of a rivet, can be guided or is guided, in the event of a movement of the wedge relative to the connection head. In this way, jamming or hooking of the lower wedge end can be avoided or precluded, thereby making it possible to ensure that the wedge, proceeding from a pivot position that projects toward the top and toward the front beyond the front end of the connection head or beyond its front vertical contact support surfaces, will definitely move onto the wedge support surfaces of the wedge support body in the case of pivoting of the upper wedge end toward the rear.

These advantages can be implemented to a particular degree if the or each wedge guide edge makes a tangential transition, toward the rear and the bottom, into the accommodation pocket.

According to a very particularly advantageous further development, the scaffolding component according to the invention can be an integral part of an arrangement with a vertical scaffolding element onto which a projection that extends transversely is fastened, which projection has a recess in the form of a perforation, for inserting a or the wedge through it, whereby the connection head can be locked to the projection with shape fit, using the wedge that can be inserted through the recess of the projection, for the formation of a releasable connection, particularly of a connection node, and can be braced relative to the vertical connection element, preferably whereby the connection head is locked to the projection with shape fit, with the formation of the releasable connection, particularly the connection node, using the wedge inserted through the recess, whereby the wedge is in a locking position, preferably so that or whereby the connection head cannot be removed from the projection in any direction, particularly so that or whereby the connection head can be removed from the projection only after unlocking of the wedge by means of a force that acts on the wedge.

Accordingly, the invention can also relate to an arrangement of a scaffolding component according to the invention, having at least one connection head according to the invention and a vertical scaffolding element that preferably extends in the direction of a longitudinal axis, onto which element a projection that extends transversely is fastened, which projection has a recess in the form of a perforation, for inserting a wedge through it for shape-fit locking and for bracing of the connection head of the scaffolding component, which head is to be connected or is connected with the vertical scaffolding element.

According to a very particularly preferred further development of the invention, it can be provided that the wedge, in the locking position, can be laid, with a vertical, preferably essentially level contact surface of its rear wedge face edge, over its full area, against a corresponding, preferably essentially level vertical wedge support surface of the projection that extends parallel to a vertical axis, which surface delimits the recess of the projection toward the rear, and that, at the same time, the wedge can be laid, with an upper, preferably essentially level contact surface of its front wedge face edge, which extends in the direction toward the rear and the bottom, at a first inclination angle relative to the vertical axis, along a first slanted axis, over its full area, against a corresponding upper, particularly an inner wedge support surface of the upper head part, which surface is essentially level and faces toward the rear, and also extends in the direction toward the rear and the bottom, at the first inclination angle relative to the vertical axis, along the first slanted axis, and that, at the same time, the wedge can be laid, with a lower, preferably essentially level contact surface of its front wedge face edge, which extends in the direction toward the rear and the bottom at a second inclination angle relative to the vertical axis, along a second slanted axis, over its full area, against a corresponding, lower, preferably essentially level, particularly inner wedge support surface of the lower head part, which faces toward the rear, which surface also extends in the direction toward the rear and the bottom, at the second inclination angle relative to the vertical axis, along the second slanted axis, or that the wedge, in the locking position, at the latest when it is braced relative to the vertical scaffolding element, lies, with a vertical, preferably essentially level contact surface of its rear wedge face edge, over its full area, against a corresponding vertical wedge support surface that delimits the recess of the projection toward the rear, is preferably essentially level, and extends parallel to a vertical axis, and that, at the same time, the wedge lies, with an upper, preferably essentially level contact surface of its front wedge face edge, which extends in the direction toward the rear and the bottom, at a first inclination angle relative to the vertical axis, along a first slanted axis, over its full area, against a corresponding, upper, preferably essentially level, particularly inner wedge support surface of the upper head part that faces toward the rear, which surface also extends in the direction toward the rear and the bottom, at the first inclination angle relative to the vertical axis, along the first slanted axis, and that, at the same time, the wedge lies, with a lower, preferably essentially level contact surface of its front wedge face edge, which extends in the direction toward the rear and the bottom at a second inclination angle relative to the vertical axis, along a second slanted axis, over its full area, against a corresponding lower, preferably essentially level, particularly inner wedge support surface of the lower head part that faces toward the rear, which surface also extends in the direction toward the rear and the bottom at the second inclination angle relative to the vertical axis, along the second slanted axis. In this way, very particularly simple, easy, and also particularly secure fastening, over a long time, can be achieved, at advantageous pivoting and guide conditions, with minimal wear of the connection parts, particularly of the perforated disk.

According to an alternative embodiment, it can be provided that the outer projection part has a preferably essentially level vertical wedge support surface that faces inward, for the wedge, which surface delimits the arrangement or perforation, preferably in the transverse direction, toward the outside, and which extends between the upper delimitation surface and the lower delimitation surface of the projection, parallel to or along or in the direction of a vertical axis, and that the upper head part has a preferably essentially level, vertical upper wedge support surface for the wedge, on an inner side of the passage in the transverse direction, which surface faces outward in the transverse direction and extends parallel to the vertical axis, and that the lower head part has a preferably essentially level, vertical lower wedge support surface for the wedge, on an inner side of the passage in the transverse direction, which surface faces outward in the transverse direction and extends parallel to the vertical axis, and that the wedge has a first wedge face edge, which has a preferably essentially level contact surface that faces outward and extends at a slant in the direction inward and toward the bottom, at an inclination angle relative to the vertical axis, along a slanted axis, which surface, when the wedge is in the locking position and the connection head is braced against the vertical scaffolding element using the wedge and/or when the wedge is in the locking position, lies against the vertical wedge support surface of the outer projection part only locally, preferably in the region of an upper recess edge of the recess of the projection, particularly in point form or line form, and that the wedge has a second wedge face edge that faces inward in the transverse direction, which edge has a preferably essentially level vertical contact surface that extends parallel to the vertical axis, which surface corresponds to the vertical upper wedge support surface of the upper head part and to the vertical lower wedge support surface of the lower head part, in such a manner that the vertical contact surface of the wedge, lying against not only the vertical upper wedge support surface of the connection head but also the vertical lower wedge support surface of the connection head, preferably over its full area, can be displaced relative to not only the vertical upper wedge support surface but also the vertical lower wedge support surface, parallel to or along or in the direction of the vertical axis.

In this way, when the wedge is hammered into place, only comparatively slight friction forces come about, so that hammering in of the wedge is possible in comparatively simple manner, particularly by means of a single hammer blow. Furthermore, in this way it can be avoided that even after multiple hammering in and releasing of the wedge, secure bracing of the connection head with the projection of the vertical scaffolding element or with the vertical scaffolding element is always possible or guaranteed, every time the wedge is hammered in once again.

According to an advantageous exemplary embodiment, it can be provided that the slot is structured, in the direction toward its slot bottom and/or in the region of its slot bottom and/or in a rear region of the slot, with a shoulder of the upper head part that extends to below the horizontal upper slot surfaces of the slot that are formed in the introduction region for the projection, which shoulder is delimited, toward the bottom, by a horizontal upper shoulder slot surface of the slot, whereby the shoulder that is disposed, in the support position, above the horizontal upper delimitation surface of the outer projection part of the projection, supports itself, in the support position and at least when the wedge is in the locking position and the connection head is braced relative to the vertical scaffolding element using the wedge, or already when the wedge is in the locking position, with its shoulder slot surface that extends parallel to the horizontal upper delimitation surface of the projection, on the upper delimitation surface of the projection, over its full area, so that the first distance of the upper head part from the horizontal center plane of the projection, and the second distance of the lower end of the lower contact support surface of the lower head part from the horizontal center plane of the projection are equal in size. In this way, the same or symmetrical force and moment transfer conditions, and, accordingly, the same static characteristic values of the connection can be achieved in the case of positive bending stress toward the top and in the case of negative bending stress toward the bottom. Furthermore, in this way, defined contact, positioning, guidance, and force transfer conditions can be implemented. In particular, transverse forces can be better transferred from the connection head to the projection in this way. Furthermore, by means of the stated measures, the tensions in the connection head can be kept particularly low. Because of reduced play between the slot and the projection that projects into it, and the full-area contact conditions of the projection inserted into the slot, both toward the bottom and toward the top, the projection can be "carried along" well in the case of bending stresses both downward and upward, if the scaffolding component that has the connection head, for example a scaffolding bar, is bend downward or upward, because the projection now can advantageously cooperate in the bending, both downward and upward, in such a manner that greater bending forces or moments can be transferred, both downward and upward, than was the case until now. This design allows a connection node or a connection with better static characteristic values overall.

According to a particularly preferred embodiment, it can be provided that the horizontal center plane of the slot and the horizontal center plane of the projection essentially coincide or form a common plane in the support position. In this way, a further improvement in the sense of the above advantages can be achieved.

According to a preferred further development, it can be provided that the shoulder is provided with lateral introduction bevels. These can be provided with a slanted surface, in each instance, which surface can extend, proceeding from the horizontal shoulder slot surface, at a slant upward and laterally toward the vertical outer surface, in each instance, of the upper side wall part, in each instance. In this way easier mounting or pushing on of the connection head in a direction perpendicular to the vertical plane or perpendicular to the transverse direction and perpendicular to the vertical axis or in a tangential direction toward the projection or toward the perforated disk is possible. This is particularly advantageous if fir mounting or pushing on of the connection head in the direction toward the front or in a radial direction toward the projection or toward the perforated disk is not possible, for example because insufficient space is available for this or because the scaffolding component provided with the connection head is already fastened onto a projection or onto a perforated disk of another vertical scaffolding element or scaffolding post, at its end facing away from the connection head, particularly by means of a second connection head and/or a second wedge, by means of the second wedge inserted through its perforation, in such a manner that the scaffolding component can be pivoted in a horizontal plane relative to the projection.

According to a particularly preferred embodiment of the invention, it can be provided that the shoulder, alternatively or additionally, is provided with a front introduction bevel. This can be provided with a slanted surface that can extend, proceeding from the horizontal shoulder slot surface, at a slant toward the front or inside and top. In this way, mounting of the connection head, with its horizontal slot, radially or in the direction toward the front, onto the projection, or insertion of the projection into the horizontal slot of the connection head, is further facilitated.

The aforementioned slanted surfaces can have an inclination angle relative to the horizontal or to the shoulder slot surface that amounts preferably to about 10 to 30 degrees, particularly about 20 degrees, individually or in each instance or in both cases. In this way, a further improvement in the sense of the above advantages can be achieved.

The invention also relates to a method for fastening a scaffolding component having at least one connection head, preferably having the above characteristics, onto a vertical scaffolding element that extends in the direction of a longitudinal axis, onto which element a projection that extends transversely, in other words in a transverse direction relative to the longitudinal axis of the scaffolding element, and has a recess in the form of a perforation for inserting a or the wedge through it, is fastened, —preferably whereby the connection head has an upper head part having an upper wedge opening and a lower head part having a lower wedge opening, for the wedge that can be inserted through the wedge openings, and whereby a slot that is open toward the front is disposed between the upper head part and the lower head part, for mounting the connection head onto the projection, preferably whereby the slot is delimited toward the top and toward the bottom with slot surfaces that extend on both sides of a horizontal center plane of the slot, —whereby for formation of a releasable connection, particularly a connection node, in which the connection head is locked in place, with shape fit, on the vertical scaffolding element, using the wedge that has been inserted through the recess, the scaffolding component having the connection head is mounted onto or pushed onto the projection of the vertical scaffolding element with its slot, in an essentially horizontal mounting direction, whereby the wedge has been or is brought into an installation position that allows mounting of the connection head, with its slot, in a or the essentially horizontal mounting direction, onto the projection, without any blockage by the wedge, in which position the wedge is supported, with its lower wedge end or in the region of its lower wedge end, on wedge support surfaces of a wedge support body, or on the wedge support surfaces of the wedge support body, and in which the wedge projects out of the upper head part, toward the top, with a or its wedge part, and projects in front of the upper head part, toward the front, whereby the connection head, together with the wedge that is in a or in the essentially horizontal installation position, moves toward the projection with its slot, in a or in the essentially horizontal mounting direction, and/or is mounted onto the projection, until the wedge impacts against a scaffolding element part of the vertical scaffolding element that extends above the projection, in a or the impact pivot position, with its wedge part that projects out of the upper head part, preferably in the region of its upper wedge end or with its upper wedge end, whereupon the connection head is moved further in a or in the essentially horizontal mounting direction, toward the front, thereby pivoting the wedge part of the wedge that lies against the scaffolding part toward the rear, relative to the connection head, whereby or after which the wedge lies against a or the wedge pivot counter-bearing, about which the wedge is then pivoted relative to the connection head, in such a manner that its upper wedge part is pivoted toward the rear and, at the same time, its lower wedge end is pivoted toward the front, whereby or meanwhile the wedge still remains supported on the wedge support surfaces of the wedge support body, in the or in a functionally corresponding installation position, at least until a mounting limit position has been reached, from which position the wedge, if pushing of the connection head onto the projection were to be continued, in a or in the essentially horizontal mounting direction, would automatically move toward the bottom, particularly into or through the recess of the projection, as the result of gravity and/or with the support of spring force, whereby the connection head is pushed further toward the front, onto the projection, beyond the mounting limit position, so that the wedge comes loose from the wedge support surfaces because of its pivoting about the wedge pivot counter-bearing, whereupon the wedge automatically moves into a locking position, into or through the recess of the projection, as the result of gravity and/or with the support of spring force, in which position the connection head is locked together with the projection, with shape fit, using the wedge, so that the connection head can only be removed from the projection after the wedge has been unlocked, by means of a force that acts on the wedge. In this way, installation of the scaffolding component, with its connection head, onto the vertical scaffolding element or onto its projection, is possible, in particularly secure and nevertheless comparatively simple and easy manner, particularly from a secure position or from a secured location of an installer, by this installer, even if the installer can no longer reach with his hand all the way into the region of the particularly perforated disk onto which the scaffolding component is to be mounted with its connection head, from this position or location. Using the method according to the invention, secured pre-assembly of a or the scaffolding component according to the invention, for example in the form of a leading railing, is possible in comparatively simple and easy manner.

Preferably, in the locking position of the wedge in which the connection head is locked with shape fit onto the projection, using the wedge, the connection head cannot be removed from the projection in any direction without previously unlocking the wedge.

The scaffolding component, before being fastened to the projection with its connection head, can preferably—either proceeding from a preparation position of the wedge in which the latter is folded in, in the direction on or onto an outer surface of a component that is firmly connected with the connection head, for example a rod element, preferably a scaffolding tube, particularly a round tube—or proceeding from a preparation position of the wedge in which the latter is loosely pushed only through the upper wedge opening or loosely pushed through the upper and through the lower wedge opening, be rotated by an angle of up to about 180 degrees, about a longitudinal axis in the form of an intersection line at which the horizontal center plane of the slot and the vertical plane, preferably the vertical center plane, particularly the vertical plane of symmetry of the connection head intersect and/or about a longitudinal axis of the scaffolding component, preferably running parallel to the horizontal center plane of the slot, so that the wedge hangs downward, supported on inner support surfaces of the upper head part, as the result of gravity, particularly held by way of the retainer provided in the region of the lower wedge end or on the lower wedge end.

Subsequent to the or before the or instead of the preceding measure, the scaffolding component, before being fastened onto the projection with the connection head or by means of the connection head, can be inclined toward the front and toward the bottom, with the connection head and with the slot leading, into an inclination position in which—a or the longitudinal axis in the form of an intersection line at which the horizontal center plane of the slot and the vertical plane of the connection head intersect, and/or a or the longitudinal axis of the scaffolding component—has/have an inclination angle relative to the horizontal, and in which the wedge hangs downward, supported on inner support surfaces of the upper head part, as the result of gravity, particularly by way of the retainer provided in the region of the lower wedge end or on the lower wedge end.

Preferably, in the said inclination position of the scaffolding component, the wedge that is hanging downward can support itself, with its front wedge edge, on a front wall part of the upper head part that faces downward in this position. In this way, a shake-proof starting position can be achieved.

Subsequently, the scaffolding component, while maintaining this or a corresponding inclination position and/or at a corresponding inclination angle relative to the horizontal, can be rotated back or further, by an angle of about 180 degrees, about the longitudinal axis of the connection head and/or about the longitudinal axis of the scaffolding component, so that as a result, the wedge moves into an upper pivot position in which its wedge part that projects toward the top beyond the upper head part projects in front of at least the upper head part, toward the front. In this manner, an optimal intermediate position of the scaffolding component with its connection head with its wedge can be achieved, proceeding from which position the wedge can be moved securely into its transition installation position, in which it is supported on the or on top of the wedge support surfaces, so that no blockage by the wedge can occur.

Subsequently, the scaffolding component can be pivoted, with its connection head, out of the said inclination position into a less inclined inclination position having a reduced inclination angle that is equal to or less than 12 degrees or that is equal to or less than seven degrees or that is equal to or less than five degrees, and as a result, the wedge moves into the or a functionally corresponding or functionally equivalent installation position, in which it is supported on the wedge support surfaces of the wedge support body, from the upper pivot position, toward the bottom, as the result of gravity and/or with the support of spring force. In this manner, an optimal starting position of the scaffolding component with its connection head and its wedge can be achieved, proceeding from which position the scaffolding component, with its slot and the projecting wedge leading, can be moved toward the projection in this essentially horizontal direction, without blockage of the slot by the wedge coming about.

Unless indicated otherwise, the term "essentially horizontal" in the sense of this patent means not only parallel to the horizontal that is configured perpendicular to the vertical axis, particularly perpendicular to the vertical or plumb line, but rather also means a possible inclination up to a maximal inclination angle relative to the said horizontal, which is equal to or less than twelve degrees, or which is equal to or less than seven degrees, or which is equal to or less than five degrees.

It can be particularly advantageous if during the movement of the wedge from the upper pivot position to the rear and downward into the installation position, a or the retainer provided in the region of the lower wedge end or on the lower wedge end of the wedge is guided toward the bottom together with the wedge, lying against a or the wedge guide edge or against the wedge guide edges. In this way, jamming or hooking of the lower wedge end can be avoided or precluded, and it can thereby be ensured, in turn, that the wedge, proceeding from an upper pivot position projecting toward the top and toward the front, beyond the front end of the connection head or beyond its front contact support surfaces, definitely moves onto the wedge support surfaces of the wedge support body in the event of pivoting of the upper wedge end toward the rear, so that no blockage of the slot occurs.

Unless indicated otherwise, the direction information "toward the rear" is intended to mean a direction transverse, particularly radial to the longitudinal axis of the vertical scaffolding element, away from it or opposite the mounting direction, in which the connection head is mounted onto the projection with its slot, with its contact support surfaces leading. Unless indicated otherwise, the direction information "toward the front" is intended to mean a direction transverse, particularly radial to the longitudinal axis of the vertical scaffolding element, toward it or in the mounting direction, in which the connection head is mounted onto the projection with its slot, with its contact support surfaces leading.

Unless indicated otherwise, the direction information "toward the outside" is intended to mean a direction transverse, in other words a transverse direction, relative to the longitudinal axis of the scaffolding element, away from the latter. Unless indicated otherwise, the direction information "toward the inside" is intended to mean a direction transverse, in other words a transverse direction, relative to the longitudinal axis of the scaffolding element, toward the latter.

The vertical axis can preferably be disposed parallel to the vertical or plumb line.

The method according to the invention can be carried out, according to a particularly preferred variant, in such a manner that an installer fastens the scaffolding component having the connection head onto the projection of the vertical scaffolding element, while holding it in his hands.

In a particularly advantageous embodiment, it is possible that an installer fastens the scaffolding component having the connection head onto the projection, from a position secured to prevent him from falling down.

According to a preferred embodiment, it can be provided that an installer standing on a scaffolding deck of a level of a scaffolding fastens the scaffolding component having the connection head onto a projection of a vertical scaffolding element disposed within this level, preferably at about half the level height of this level.

The scaffolding component can be a rod element, particularly a scaffolding tube and/or a scaffolding bar or a bracket. The scaffolding component can be provided with at least two connection heads that can be structured to be the same or different. The connection heads can be provided at ends of the scaffolding component that face away from one another. The scaffolding component can be formed with a profile, for example with an O or U cross-section, with a rod element or with a tube, particularly a round tube, which can be connected with the connection head in one piece or multiple pieces, particularly by means of welding.

The vertical scaffolding element can be a preferably cylindrical scaffolding tube, particularly a round tube in the form of a circular cylinder. The vertical scaffolding element can be a component, for example a sleeve or a tube section, that can be fastened onto a scaffolding post or pillar. The vertical scaffolding element can be a scaffolding post or pillar or a frame composed of or formed from these, for example an assembly frame or façade frame.

The projection can extend perpendicular and/or radial to the vertical scaffolding element, particularly transverse, perpendicular and/or radial to a longitudinal axis of the vertical scaffolding element.

The projection can surround the vertical scaffolding element, in whole or in part. The projection can be a rosette, preferably a perforated disk. This can be provided, in known manner, with multiple recesses, particularly in the form of passage holes. These can be disposed, once again in known manner, at equal circumference angles, preferably of 45 degrees, relative to one another. Furthermore, small and large recesses can be provided, also in known manner, which can preferably be disposed alternately in the circumference direction.

Preferably, the scaffolding component and/or the connection head and/or the scaffolding element and/or the projection and/or the wedge consist(s) of metal. The connection head can preferably consist of a tempered casting, steel casting, or aluminum. The scaffolding component and/or the scaffolding element and/or the projection and/or the wedge can consist of steel, particularly of zinc-plated steel, or of aluminum. According to a particularly preferred combination, it can be provided that the projection and the vertical scaffolding element and the wedge consist of preferably zinc-plated steel, and that the connection head consists of a steel casting or tempered casting.

The connection head can be structured with a contact part that has contact wall parts having contact support surfaces, for contact against corresponding outer surfaces of the vertical scaffolding element. The upper head part can have upper contact support surfaces of the contact support surfaces for contact against corresponding outer surfaces of a scaffolding element part of the vertical scaffolding element that extends above the projection. The lower head part can have lower contact support surfaces of the contact support surfaces for contact against corresponding outer surfaces of a scaffolding element part of the vertical scaffolding element that extends downward, below the projection. The connection head can have a connection part that is firmly connected with a component of the scaffolding component.

Preferably, the connection head can be delimited by side wall parts that have vertical outer surfaces that run toward a center, in wedge-like manner. The vertical outer surfaces can enclose a wedge angle that amounts to preferably 40 to 50 degrees, particularly about 43 to 46 degrees, preferentially about 44 degrees or 45 degrees.

The slot of the connection head can preferably reach all the way to the connection part. Preferably, the slot can be open toward the contact support surfaces or toward the contact side, particularly also toward the vertical outer surfaces, if such surfaces or a contact side is/are provided.

Preferably, the wedge consists of flat material and has an essentially constant wedge thickness. Preferably, the centering support surfaces have a lateral distance from one another that is only slightly greater than the wedge thickness. Preferably, the wedge is undetachably connected with the connection head. For this purpose, the wedge can be provided with a retainer, or a retainer, in each instance, in the region of one of its wedge ends or in the region of its two wedge ends or on one wedge end or on both wedge ends. This retainer can be formed with a thickening. A pin or a rivet can be provided as a retainer. Preferably, the wedge can consist of flat material, in known manner, and can be provided with a rivet on its lower wedge end, which rivet can project laterally or transversely beyond the flat material of the wedge with at least one rivet head.

Preferably, the upper wedge opening can be structured as a longitudinal slot that extends from the rear toward the front, particularly containing the vertical plane. Preferably, the wedge opening can, or the longitudinal slot can have parallel slot walls that can run on both sides of the vertical plane. The slot walls can have a distance from one another that corresponds to the slot width. This distance or the slot width is preferably only slightly greater than the wedge thickness of the wedge, so that the wedge is then guided in the wedge opening with only slight lateral play.

The connection head and the scaffolding component can be connected with one another in multiple pieces or one piece. The scaffolding component and the connection head can have been or be produced in one piece or from one piece. The connection head can be formed onto the scaffolding component.

At least two of the subsequent parts of the connection head, if they are present, can be produced or can have been produced from one piece, in any desired combination: the upper head part, the lower head part, the contact part, the connection part, the wedge support body, the shoulder and/or the wedge pivot counter-bearing.

Using a scaffolding component according to the invention, it is also possible to implement a particularly advantageous arrangement with a vertical scaffolding element that extends in the direction of a longitudinal axis, which is the object of two German patent applications by the same applicant, in each instance, with the title "Arrangement of a scaffolding component and of a vertical scaffolding element," both of which were filed with the German Patent and Trademark Office on the same filing date as the present patent application. The content of these two German patent applications, in each instance, is being incorporated into the present patent application at this point, by making reference to them or referring to them, with their full content, for the sake of simplicity and in order to avoid repetition. Accordingly, the content of the said German patent applications, in each instance with all the technical characteristics, both individually and in any desired combination, is therefore supposed to be completely included in the disclosure of the invention of the present patent application.

BRIEF DESCRIPTION OF THE DRAWINGS

Further characteristics, advantages, and aspects of the invention can be derived from the following description part, in which advantageous exemplary embodiments of the invention are described using the figures.

These show:

FIG. 23 a three-dimensional view of a section of the arrangement according to the invention or of the connection node according to the invention, whereby the scaffolding component according to the invention is shown in partial section;

FIG. 24 a greatly enlarged partial view of FIG. 21, in a representation of the arrangement according to the invention or of the connection node according to the invention in longitudinal section;

FIG. 25 the arrangement or the connection node in horizontal section, along the section lines 25-25 in FIG. 24;

FIGS. 26 to 33 three-dimensional representations of the connection head according to the invention, whereby FIG. 26 shows a view of the connection head at a slant from the front, right, and top, FIG. 27 shows a view of the connection head at a slant from the rear, right, and top, FIG. 28 shows a front view of the connection head, FIG. 29 shows a rear or back view of the connection head, FIG. 30 shows a side view of the connection head from the right, FIG. 31 shows the connection head according to FIG. 28 in a cross-section along the section lines 31-31 in FIGS. 30 and 32, FIG. 32 shows a top view of the connection head, and FIG. 33 shows a bottom view of the connection head;

FIG. 34 an enlarged longitudinal section of the connection head along the section lines 34-34 in FIGS. 28 and 32;

FIG. 35 a greatly enlarged representation of the detail marked with a circle in FIG. 34;

FIG. 36 a side view of the wedge according to the invention,

FIG. 37 a three-dimensional view of a section of the arrangement according to the invention or of the connection node according to the invention, whereby the scaffolding component according to the invention is shown in partial section;

FIG. 38 an enlarged longitudinal section of the arrangement according to the invention or of the connection node according to the invention, along the section lines 38-38 in FIG. 37;

FIG. 39 the arrangement of the connection node in horizontal section along the section lines 39-39 in FIG. 38;

FIG. 40 an enlarged longitudinal section of the connection head along the section lines 40-40 in FIGS. 45 and 49;

FIG. 41 a greatly enlarged representation of the detail marked with a circle in FIG. 40;

FIG. 42 an arrangement that contains the scaffolding component and a vertical scaffolding element in the form of a scaffolding post provided with a perforated disk, whereby the end region of the scaffolding component is shown in a horizontal starting position, proceeding from which the scaffolding component can be mounted radially onto the perforated disk of the scaffolding post shown with a post section, with its connection head and the latter's slot leading, whereby the wedge does not yet touch the post;

FIGS. 43 to 50 three-dimensional representations of the connection head according to the invention, whereby FIG. 43 shows a view of the connection head at a slant from the front, right, and top, FIG. 44 shows a view of the connection head at a slant from the rear, right, and top, FIG. 45 shows a front view of the connection head, FIG. 46 shows a rear or back view of the connection head, FIG. 47 shows a side view of the connection head from the right, FIG. 48 shows the connection head according to FIG. 45 in cross-section along the section lines 48-48 in FIGS. 47 and 49, FIG. 49 shows a top view of the connection head, and FIG. 50 shows a bottom view of the connection head;

FIG. 52 a three-dimensional view of a section of the arrangement according to the invention or of the connection node according to the invention, whereby the scaffolding component according to the invention is shown in partial section;

FIG. 53 an enlarged longitudinal section of the arrangement according to the invention or of the connection node according to the invention, along the section lines 53-53 in FIG. 51;

FIG. 54 the arrangement or the connection node in horizontal section along the section lines 54-54 in FIG. 53;

FIG. 55 an enlarged longitudinal section of the connection head along the section lines 55-55 in FIGS. 60 and 63;

FIG. 56 a greatly enlarged representation of the detail marked with a circle in FIG. 55;

FIG. 57 an arrangement that contains the scaffolding component and a vertical scaffolding element in the form of a scaffolding post provided with a perforated disk, whereby the end region of the scaffolding component is shown in a horizontal starting position, proceeding from which the scaffolding component can be radially mounted onto the perforated disk of the scaffolding post shown with a post section, with its connection head and the latter's slot leading, whereby the wedge does not yet touch the post;

FIGS. 58 to 65 three-dimensional representations of the connection head according to the invention, whereby FIG. 58 shows a view of the connection head at a slant from the front, right, and top, FIG. 59 shows a view of the connection head at a slant from the rear, right, and top, FIG. 60 shows a front view of the connection head, FIG. 61 shows a rear or back view of the connection head, FIG. 62 shows a side view of the connection head, from the right, FIG. 63 shows the connection head according to FIG. 60 in cross-section along the section lines 63-63 in FIGS. 62 and 64, FIG. 64 shows a top view of the connection head, and FIG. 65 shows a bottom view of the connection head.

DETAILED DESCRIPTION OF THE DRAWINGS

Figure 1:
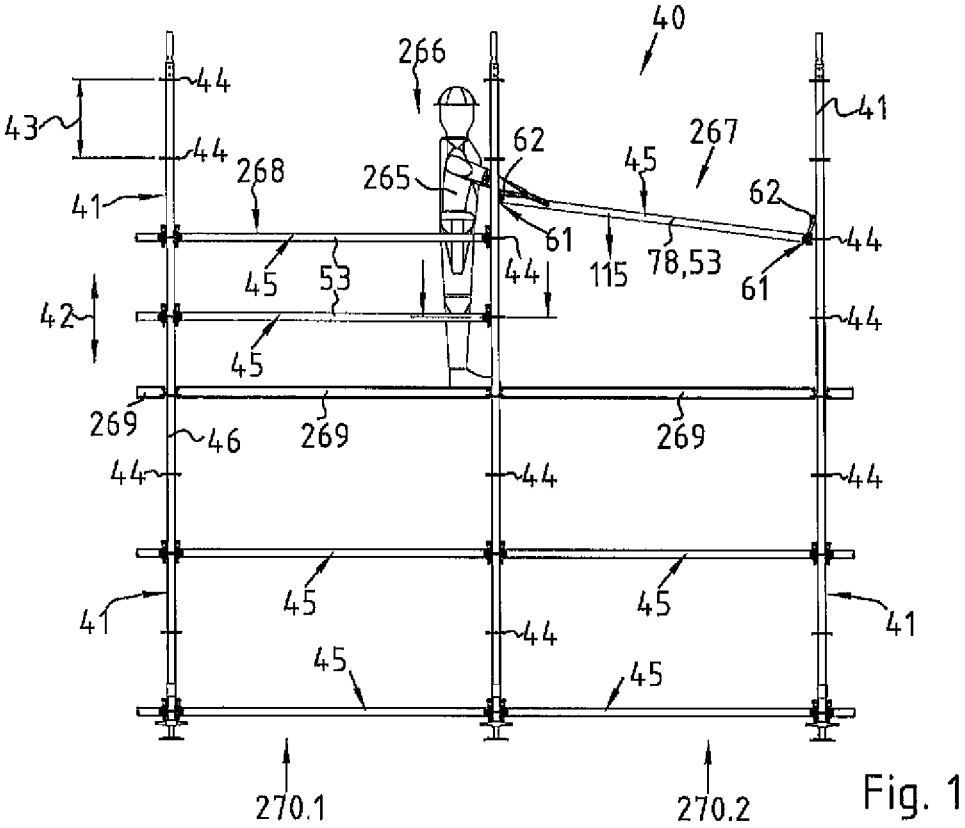
FIG. 1A section of a scaffolding having scaffolding components or arrangements according to the invention, in a construction phase, in which an installer standing on a scaffolding deck, in a secured position, is in the process of fastening a scaffolding component according to the invention, for the formation of a leading railing, onto a perforated disk of a scaffolding post, using one of its connection heads according to the invention.

In FIGS. 1 to 4, a section of a scaffolding 40, also called a modular scaffolding, is shown, in each instance. The scaffolding 40 is constructed of vertical posts 41. The posts 41 form vertical scaffolding elements. Each post 41 extends vertically along an essentially straight longitudinal axis 47, in other words forms an essentially straight rod element 41. The posts 41 consist of metal, preferably of steel. However, the posts can also consist of light metal, particularly of aluminum or of aluminum alloys. The posts 41 are produced from round tubes 46. The round tubes 46 have an essentially cylindrical outer cross-section essentially over their entire effective length. Each post 41 has a tube connector at one of its free ends, preferably at its upper end. The outside diameter of the tube connector is slightly smaller than the inside diameter of the post tube at the other end of the post 41, facing away from the tube connector, so that a further post 41 can be mounted onto the tube connector of a post 41. In this manner, the scaffolding 40 can be built up over multiple levels.

Multiple connection elements in the form of rosettes or perforated disks 44 are fastened onto the posts 41, spaced apart from one another in the axial direction 42, in other words in the direction of the longitudinal axes 47 of the posts 41, at a grid dimension 43 that preferably amounts to about 50 cm, preferably by means of welding, in order to be able to connect scaffolding components 45 in the form of connection, holding and/or support elements, for example longitudinal bars 45, transverse bars and/or diagonals there. The diagonals and the transverse bars are not shown in the figures. Scaffolding decks 269 can be fastened on top of or onto the transverse bars. Multiple scaffolding fields 270.1, 270.2 can be constructed. An installer 265 can install a scaffolding component 45 according to the invention from a position 266 secured to prevent him from falling down. In this connection, a leading railing 267 in the form of a hip or back railing 268 can be implemented.

The perforated disks 44 engage around the posts 41 over their full circumference, but can also engage around the posts 41 only in part. The perforated disks 44, which form a projection, extend transversely, in other words in the transverse direction 118 relative to the longitudinal axis 47 of the post 41, away from the outer surface 54 of the post 41, toward the outside 52. The perforated disks 44 are structured with upper and lower delimitation surfaces 48, 49, which are configured to run parallel to one another and to be essentially level. Accordingly, the perforated disks 44 have an essentially constant perforated disk thickness 50. The perforated disk thickness 50 preferably amounts to about 9 mm, particularly if the perforated disk 44 consists of steel. The perforated disk thickness 50 can, however, also be slightly greater, for example can amount to about 10 mm, particularly if the perforated disk 44 consists of light metal, for example of aluminum. The delimitation surfaces 48, 49 of the perforated disk 44 are configured parallel to an imaginary center plane 51 of the perforated disk 44, which intersects the perforated disk 44, viewed in the vertical direction or in the thickness direction 42, at the height of half the perforated disk thickness 50. Each perforated disk 44 extends in a direction 52 perpendicular to the longitudinal axis 47 of the post 41, away from the latter, from the outer surface 54 of the post 41 radially toward the outside 52. Accordingly, the center plane 51 of the perforated disk 44 runs normal to the longitudinal axis 47 of the post. Each perforated disk 44 is provided, in usual manner, with multiple passage holes 55, which are also referred to as perforations 55. This means that each of these passage holes 55 is laterally delimited, over its entire circumference, by laterally delimiting wall parts of the perforated disk 44 or by wall parts of the perforated disk 44. Each passage hole 55 extends, in the vertical direction 42, between the upper delimitation surface 48 formed on the top side 57 of the perforated disk 44 and the lower delimitation surface 49 on the underside 58 of the perforated disk 44. The passage holes 55 are disposed, in known manner, to be spaced apart from one another at equal circumference angles 59 of 45 degrees, in each instance. Furthermore, also in known manner, small and large perforations 55.1, 55.2 are provided, which are disposed alternately in the circumference direction 60. The precise configuration of the perforated disk 44 is particularly evident from FIGS. 21 to 25. The perforated disks 44 preferably consist of steel, but can also consist of light metal, particularly of aluminum or aluminum alloys.

The scaffolding 40 shown in the figures is constructed with scaffolding components 45 according to the invention, in the form of longitudinal bars 45 and transverse bars, as well as diagonals, whereby only the longitudinal bars 45 are shown in the figures. These bars 45 are configured to be completely compatible with the previously known bars and consequently fully compatible with the previous LAYHER Allround modular scaffolding system. This means that the bars 45 according to the invention can easily be combined with the previous other scaffolding parts of this previous modular scaffolding system.

The scaffolding bars 45 according to the invention have a connection head 61 according to the invention at their ends 56.1, 56.2 that face away from one another, in each instance, by means of which head the scaffolding bar 45 can be fastened onto a perforated disk 44 assigned to it, in each instance. For this purpose, each connection head 61 has a wedge 62 that is undetachably connected with the connection head 61, by means of which wedge the connection head 61, in each instance, can be wedged in place on a perforated disk 44 assigned to it. The connection heads 61 can be fastened onto a rod element 53 of the scaffolding bar 45 as separately produced components. The scaffolding bars 45 shown in the figures are produced in multiple parts or from multiple parts, namely from two connection heads 61 and from one rod element 53, in each instance. In the exemplary embodiments shown, a round tube 58 made of metal, preferably of steel, is used as the rod element 53. It is understood, however, that the invention is not restricted to rod elements, particularly not to such rod elements. Thus, other profiles, for example U-profiles, can be used as rod elements, in place of round tubes. Instead of being fastened onto rod elements 53, the connection heads 61 according to the invention can also be fastened onto other components. For example, a scaffolding component 45 according to the invention can also be a bracket having one or having multiple connection heads according to the invention.

In the exemplary embodiment, the round tube 78 is welded to the connection head 61, in each instance, as usual. It is understood, however, that a connection head according to the invention can also be fastened onto a component of the scaffolding component according to the invention in different manner. It is furthermore understood that a scaffolding component according to the invention can also be produced in one piece with at least one connection head according to the invention.

Each connection head 61 has a contact part 63 and a connection part 64. The connection part 64 is firmly connected with the round tube 78, preferably by means of welding. The contact part 63 has contact wall parts 63.1, 63.2 having contact support surfaces 65.1, 65.2, for making contact with the corresponding outer surfaces 54 of the post 41. These contact support surfaces 65.1, 65.2 are concavely rounded, viewed in horizontal section parallel to the center plane 68 of the slot 67, with a radius 69 that corresponds to the outer radius 70 of the round tube 46 of the post 41.

Each connection head 61 is delimited by side wall parts 71.1 to 71.4 that have vertical outer surfaces 72.1 to 72.4 that run, in wedge-like manner, toward a center or toward a central axis 91, in the direction toward the front 79. The vertical outer surfaces 72.1 to 72.4 enclose a wedge angle 73 that preferably amounts to about 44 degrees or 45 degrees.

The contact part 63 comprises an upper head part 74 and a lower head part 75. The upper head part 74 has an upper contact support surface 65.1 of the contact support surfaces 65.1, 65.2 for making contact with a corresponding upper outer surface 76.1 of a post part 77.1 of the post 41 that extends above the projection 44. The lower head part 75 has a lower contact support surface 65.2 of the contact support surfaces 65.1, 65.2 for making contact with a corresponding lower outer surface 76.2 of a post part 77.2 of the post 41 that extends below the projection 44.

The upper head part 74 has an upper wedge opening 80, and the lower head part 75 has a lower wedge opening 81, for the wedge 62 that can be inserted through the wedge openings 80, 81.

A horizontal slot 67 that is open toward the contact support surfaces 65.1, 65.2, in other words toward the front 79, and also toward the vertical outer surfaces 72.1 to 72.4, in other words toward both sides, is disposed between the upper head part 74 and the lower head part 75, with which slot the connection head 61 can be mounted or has been mounted onto the perforated disk 44. The slot 67 preferably reaches all the way to the connection part 64 in the direction toward the rear.

A wedge accommodation space 84 for the wedge, also referred to as a passage 84, is configured between the upper wedge opening 80 and the lower wedge opening 81, which space extends through the upper head part 80 and through the lower head part 81, crossing the slot 67. The wedge accommodation space 84 or the passage 84 is delimited, toward the front 79, by the contact wall part 63.1 of the upper head part 74 and the contact wall part 63.2 of the lower head part 75, toward the sides by the side wall parts 71.1 to 71.4 of the upper and of the lower head part 74, 75, and toward the rear by the connection part 64, as well as by a wedge support body 85 and by a wedge pivot counter-bearing 86 in the upper head part 74, which will be discussed in greater detail below. The passage 84 or the wedge accommodation space 84 stands in a passage connection with a perforation 82 in the connection part 64. This in turn stands in a passage connection with the interior space 87 of the round tube 78.

When the connection head 61 is completely mounted onto the perforated disk 44 with its slot 67, and when the wedge 62 has been inserted through the passage 84 and through a perforation 55.1 of the perforations 55.1, 55.2 of the perforated disk 44, so that the connection head 61 of the scaffolding bar 45 is locked to the perforated disk 44, with shape fit, in a locking position 88 of the wedge 62, the upper wedge opening 80 of the upper head part 74 and the lower wedge opening 81 of the lower head part 75 approximately align with this perforation 55.1.

To unlock the connection head 61 locked to the perforated disk 44 from the perforated disk 44, the wedge 62 can be moved or pulled upward through the passage 84 or through the wedge opening 55.1, all the way to above the upper delimitation surface 48 of the perforated disk 44, so that then, the connection head 61 can be removed from the projection 44, in other words can be freely handled separately.

The connection head 61 is structured symmetrical to an imaginary vertical plane of symmetry 90, which is configured perpendicular to the imaginary horizontal center plane 68 of the slot 67. The vertical plane of symmetry 90 contains the imaginary vertical central axis 91, in which the vertical planes 92.1, 92.2 spanned by the vertical outer surfaces 72.1 to 72.4 of the side wall parts 71.1 to 71.4 intersect in front of the connection head 61. In the exemplary embodiment shown, the vertical plane of symmetry 90 also contains the longitudinal axis 94 of the round tube 78 of the scaffolding component 45 or scaffolding bar 45. When the connection head 61 is mounted onto the perforated disk 44 and is locked and braced in place there by means of the wedge 62, the vertical plane of symmetry 90 contains the longitudinal axis 47 of the vertical scaffolding element 41 or post 41. In the introduction region 93 of the slot 67, the connection head 61 is structured symmetrical to the center plane 68 of the slot 67 with its upper head part 74 and its lower head part 75. Accordingly, the upper contact support surface 65.1 of the upper head part 74 and the lower contact support surface 65.2 of the lower head part 75 are configured symmetrical to the horizontal center plane 68 of the slot 67, and furthermore, the upper contact support surface 65.1 of the upper head part 74 and the lower contact support surface 65.2 of the lower head part 75 are equal in size.

The slot 67 has a front introduction region 93, in which it is delimited, toward the top, with upper slot surfaces 95.1, 95.2 of the upper head part 74, and, toward the bottom, with lower slot surfaces 96.1, 96.2 of the lower head part 75, which run parallel to one another, preferably also parallel to the longitudinal axis 94 of the round tube 78. There, the slot 67, viewed in the vertical direction 42, has a first slot height 98 or first slot width that corresponds to the vertical distance between the upper slot surfaces 95.1, 95.2 of the upper head part 74 and the lower slot surfaces 96.1, 96.2 of the lower head part 75, in the introduction region 93. This distance 98 preferably amounts to about 12 mm. The said slot surfaces 95.1, 95.2, 96.1, 96.2 extend on both sides of an imaginary horizontal center plane 68 of the slot 67 that runs at the height of half the slot height 98 or the slot width.

The slot 67 is delimited, toward the rear, with slot surfaces 102.1, 102.2 of a slot bottom 103.1, 103.2, which surfaces extend vertically. In the region of the slot bottom 103.1, 103.2, respectively in a rear region of the slot 67, in which upper slot surfaces 99.1, 99.2 of the slot 67 lie opposite an outer edge crosspiece 97 of the perforated disk 44, which is delimited, radially toward the inside 79, by the said perforation 55.1 of the perforated disk 44, when the connection head 61 is completely mounted onto the perforated disk 44 and is locked in place there by means of the wedge 62 that has been inserted through a perforation 55.1 of the perforations 55.1, 55.2, the upper head part 74 of the connection head 61 has a shoulder 100. The shoulder 100 extends, viewed in an imaginary vertical section plane 106 that is configured perpendicular to the horizontal center plane 68 of the slot 67, extending in the longitudinal direction 101 of the upper wedge opening 80, passing through the upper wedge opening 80, preferably running in the transverse center of the connection head 61, to below the upper slot surfaces 95.1, 95.2 configured in the introduction region 93, and delimits the slot 67 toward the bottom with its upper shoulder slot surface 107.

Because the shoulder 100 is disposed in the region of the imaginary vertical plane 90 that is configured perpendicular to the horizontal center plane 68 of the slot 67, extending in the longitudinal direction 101 of the upper wedge opening 80, passing through the upper wedge opening 80, preferably running in the transverse center of the connection head 61, particularly the vertical plane of symmetry 90 of the connection head 61, which is configured to be symmetrical to this plane, a particularly advantageous combination with a or integration into a wedge support body 85 that engages over the slot 67 toward the front, disposed above the slot 67, can be implemented. The wedge support body 85 has wedge support surfaces 108 for vertically supporting the lower wedge end 109 of the wedge 62 to prevent unintentional movement of the wedge 62 vertically downward, intersecting the slot 67, in order to allow mounting of the connection head 61 with its slot 67 radially onto the projection 44 or onto the perforated disk 44, in an essentially horizontal mounting direction 107, without blockage by the wedge 62.

The shoulder 100 is configured on both sides of the vertical plane 90, containing the said vertical plane 90, and extends passing through between the upper side wall parts 71.1, 71.2. In this way, further improvement in the sense of the above advantages can be achieved, whereby simple and easy mounting or pushing on of the connection head 61, with its slot 67, onto the projection 44 is possible. By means of the measure last mentioned, furthermore reinforcement, particularly of the upper head part 74 of the connection head 61 can be achieved, so that the static characteristic values of the connection can be improved, on the whole.

The shoulder 100 delimits the slot 67 with the upper shoulder slot surface 107. The upper shoulder slot surface 107 is configured parallel to the upper slot surfaces 95.1, 95.2, 99.1, 99.2 and to the lower slot surfaces 96.1, 96.2 of the slot 67, or parallel to the horizontal center plane 107 of the slot 67. Between the upper shoulder slot surface 107 of the shoulder 100 and the lower slot surfaces 96.1, 96.2 of the slot 67, the slot width 106 or height of the slot 67, viewed in the vertical direction, is reduced, because of the shoulder 100, to a vertical distance 106 that is less than the distance 98 between the upper slot surfaces 95.1, 95.2 and the lower slot surfaces 96.1, 96.2 in the front introduction region 93 of the slot 67, and which is therefore less than the slot width 98 or height of the slot 67 in this introduction region 93. The said distance 106 between the shoulder slot surface 107 and the lower slot surfaces 96.1, 96.2 amounts to about 10.5 mm in the exemplary embodiment. The connection head 61 is supported vertically on the upper delimitation surface 48 of the outer edge crosspiece 97 of the perforated disk 44, in a support position, by way of this shoulder 100, when the head is completely mounted onto the perforated disk 44 with its slot 67 and locked in place there by means of the wedge 62.

Because of the said shoulder 100, the slot 67, viewed in the direction from the front to the rear 52, is structured with a narrowing 111 in the direction toward the slot bottom 103.1, 103.2. The narrowing 111 or the shoulder 100 is formed by an upper wall part 112 of the upper head part 74. This upper wall part 112 extends horizontally and between the side wall parts 71.1, 71.2 of the upper head part 74, preferably continuously, as shown in the figures. The said upper wall part 112 or the shoulder 100 is delimited toward the front 79, in other words in the direction toward the introduction region 93 of the slot 67, by a slanted surface 113 that is inclined downward and toward the rear. The slanted surface 113 extends, viewed in a vertical section that contains the vertical plane of symmetry 90, from the upper slot surfaces 95.1, 95.2 of the introduction region 93, toward the bottom 115 and toward the rear 52, toward the slot bottom 103.1, 103.2.

The contact wall part 63.1 of the upper head part 74 of the connection head 61 is structured, proceeding from its front contact support surfaces 65.1 toward the slot 67, with an upper introduction bevel 116 that is inclined toward the rear 52 and toward the bottom 115. The contact wall part 63.2 of the lower head part 75 of the connection head 61 is structured, proceeding from its front contact support surfaces 65.2 toward the slot 67, with a lower introduction bevel 117 that is inclined toward the rear 52 and toward the top 110. These two introduction bevels 116, 117 facilitate mounting of the connection head 61, with its slot 67, onto the perforated disk 44.

The upper introduction bevel 116 makes a transition, toward the rear 52, into the upper slot surfaces 95.1, 95.2 in the introduction region 93. The lower introduction bevel 117 makes a transition, toward the rear, into the lower slot surfaces 96.1, 96.2 in the introduction region 93. Because of the comparatively great slot height 98 or width of the slot 67 in the introduction region 93, the connection head 61, with its slot 67, can accordingly be easily mounted onto or pushed onto the perforated disk 44. Because of the slanted surface 113 of the shoulder 100 that is inclined toward the rear 52 and bottom 115, the connection head 61, when it is already radially mounted onto the perforated disk 44 with the introduction region 93, can easily be pushed further toward the front 79, radially onto the perforated disk 44.

Figure 28:
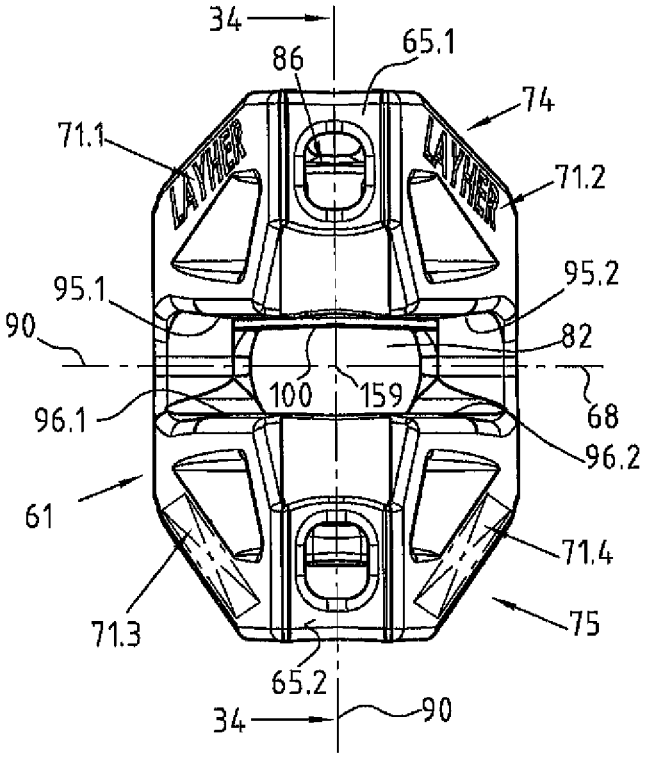
Figure 29:
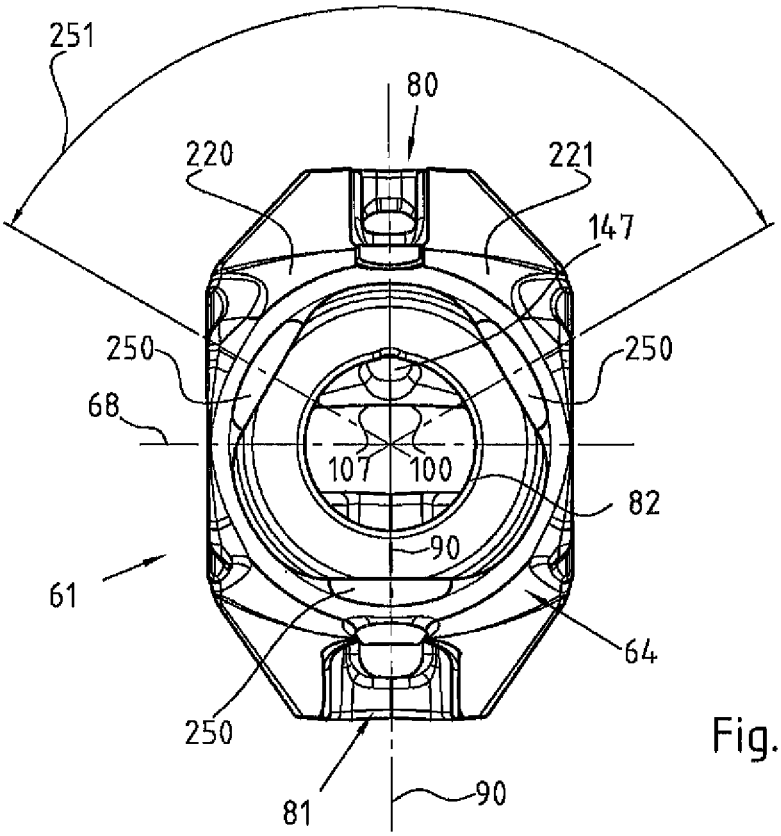
Figure 30:
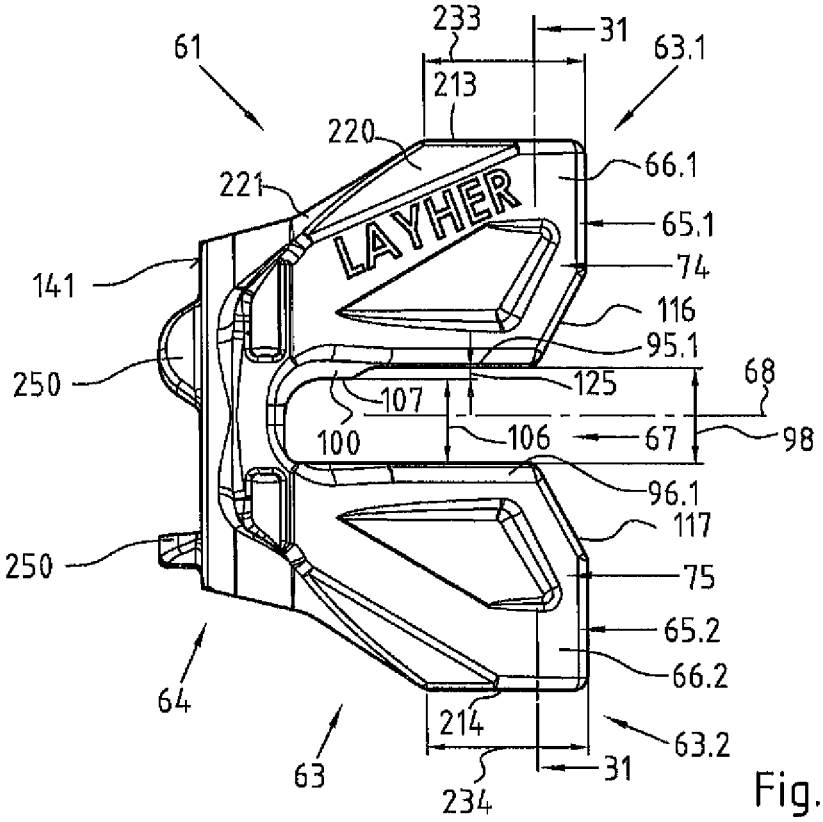
Figure 31:
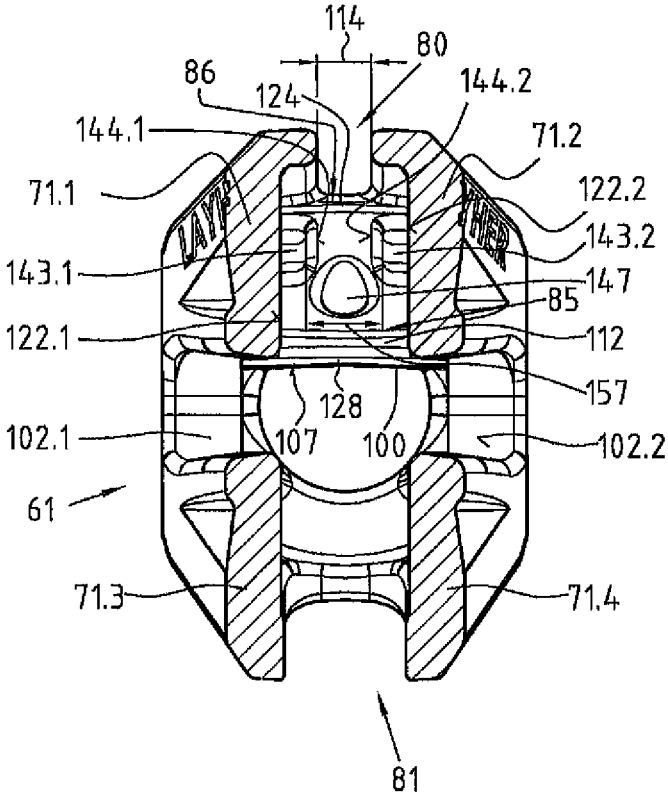
Figure 32:
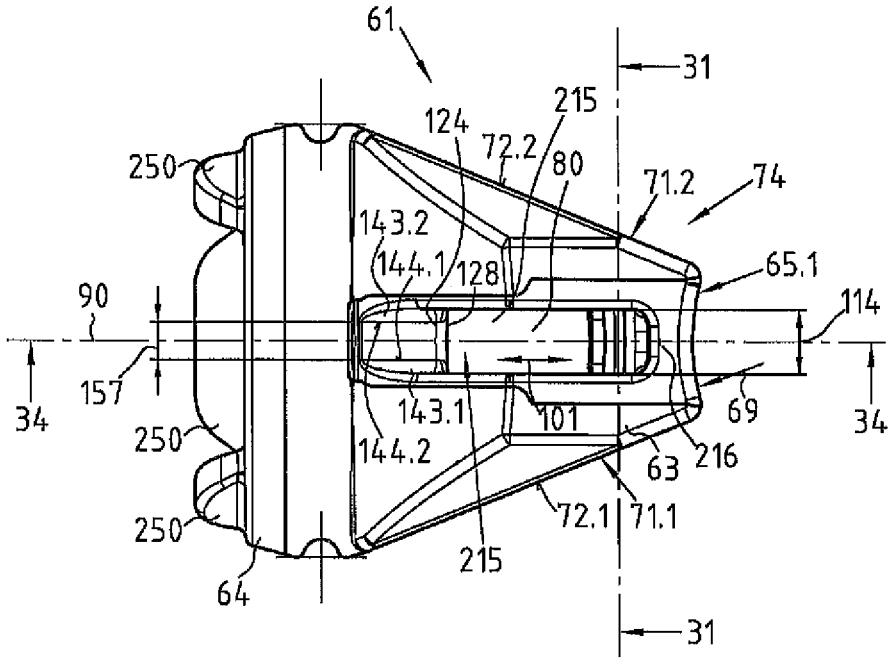
Figure 33:
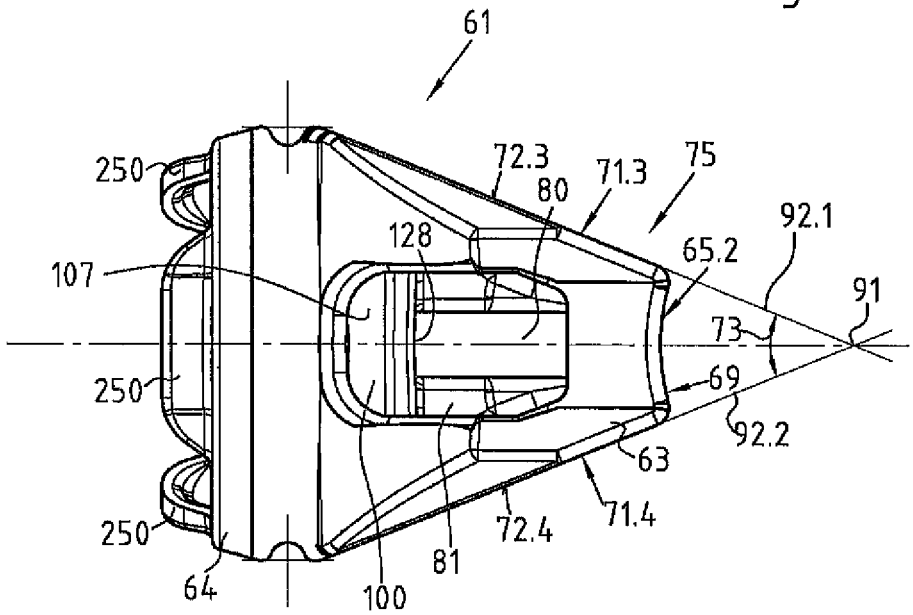
Figure 34:
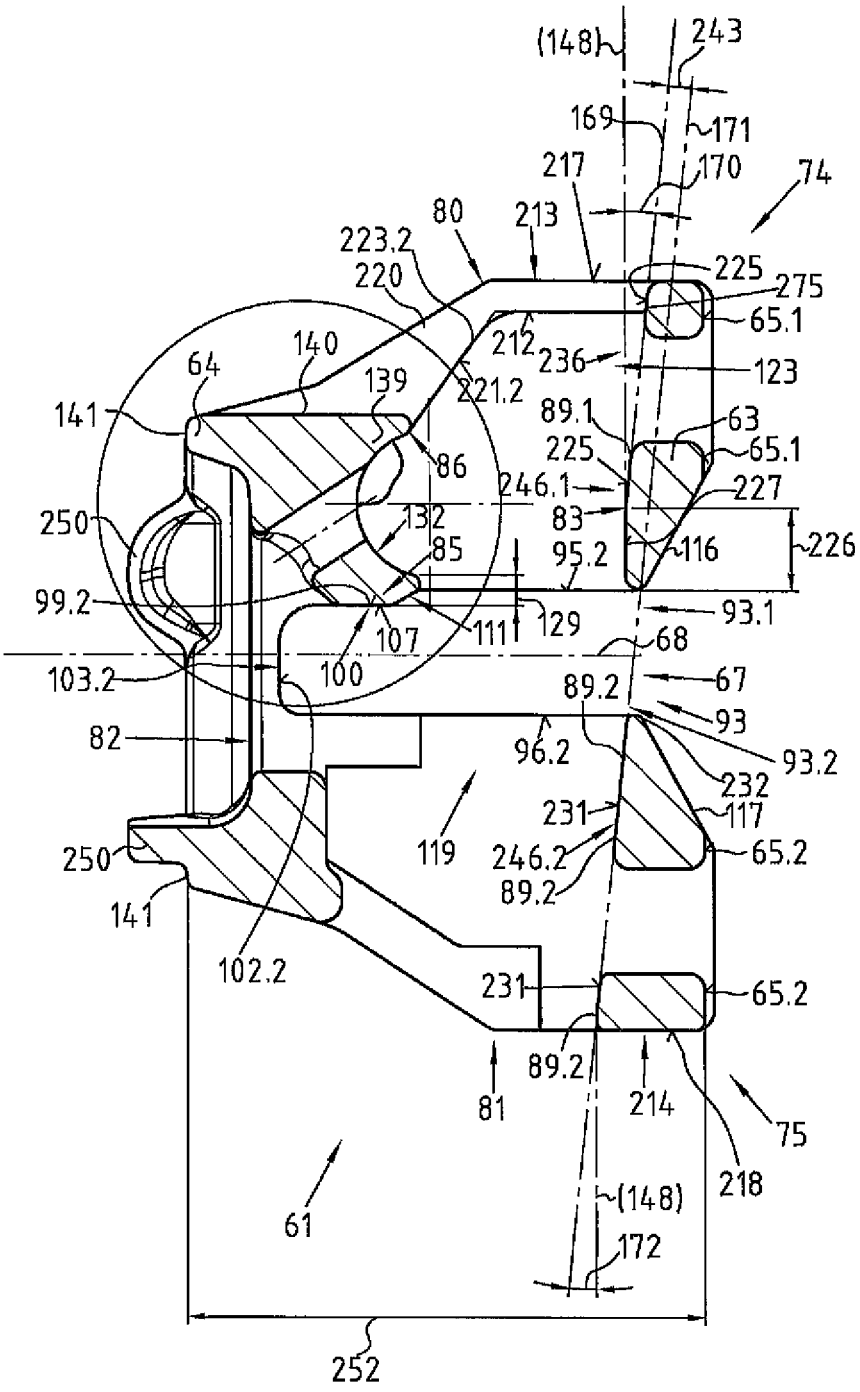
Figure 35:
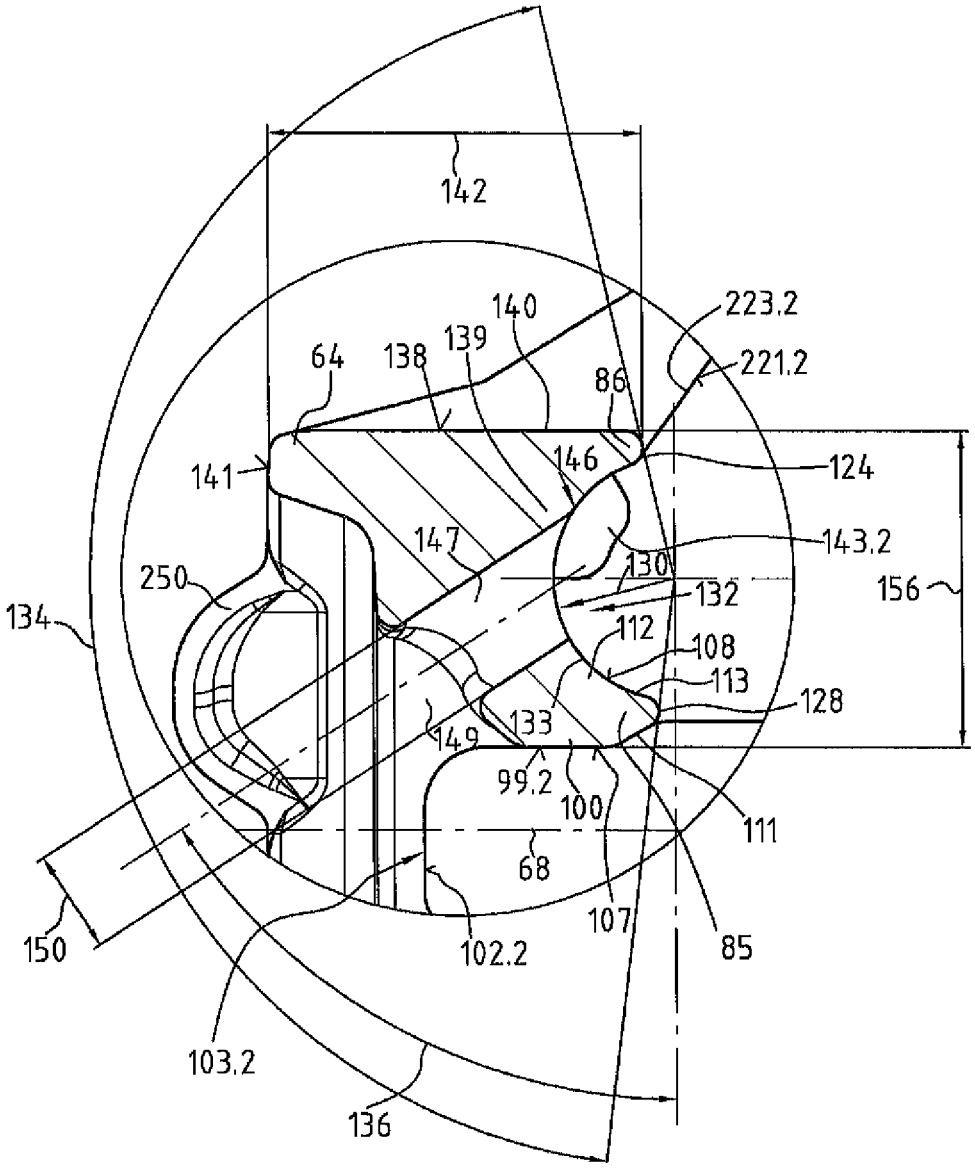

As is particularly evident from FIGS. 28 and 31, the shoulder 100 is disposed offset relative to the vertical outer surfaces 72.1, 72.2 of the upper side wall parts 71.1, 71.2, in the direction toward the inside, in other words into the interior 119 of the connection head 61. In this connection, the shoulder 100 is disposed offset relative to the upper slot surfaces 95.1, 95.2; 99.1, 99.2 of the upper side wall parts 71.1, 71.2, in the direction toward the inside. The upper slot surfaces 95.1, 95.2; 99.1, 99.2 of the upper side wall parts 110 extend from the introduction region 93 toward the rear 52 in the direction toward the slot bottom 103.1, 103.2, laterally and on the outside past the shoulder 100, above the shoulder slot surface 107 of the shoulder 100. To the side of the shoulder 100, in other words viewed in a direction perpendicular away from the vertical plane of symmetry 90, in each instance, the upper slot surfaces 99.1, 99.2 and the lower slot surfaces 96.1, 96.2 have a vertical distance 98 from one another that is equal to the distance 98 between the upper slot surfaces 95.1, 95.2 and the lower slot surfaces 96.1, 96.2 in the introduction region 93.

Figure 2:
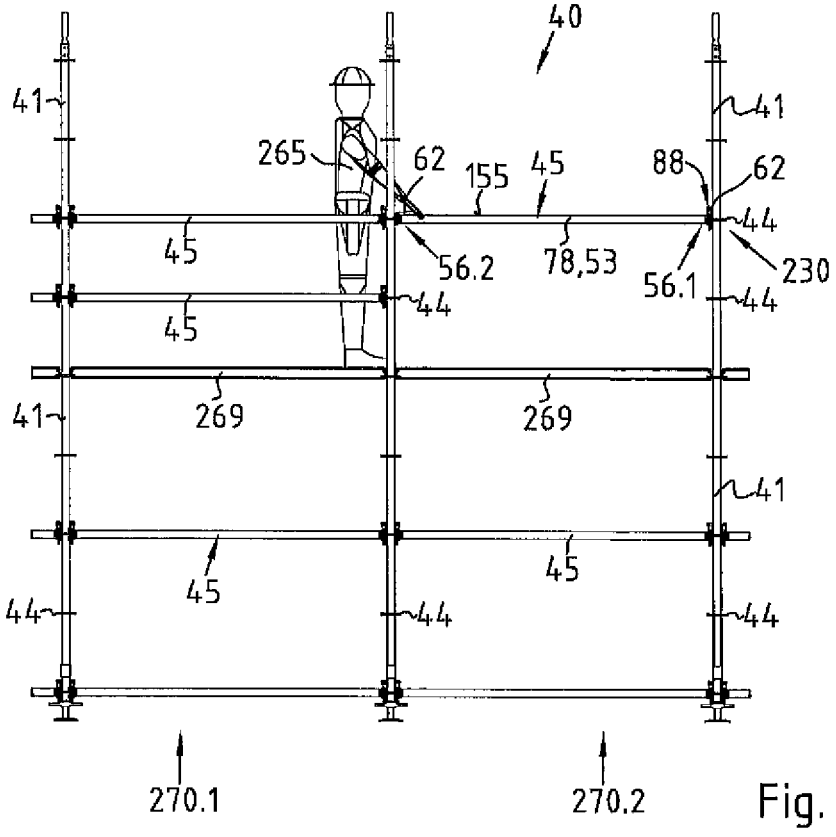
FIG. 2 the scaffolding section according to FIG. 1 in a later construction phase.

By means of the above measures, individually or in any desired combination, weight can be saved, and easier mounting or pushing on of the connection head 61 in a direction 120 perpendicular to the transverse direction 118, in other words lateral or tangential to the projection 44, is possible. This is particularly advantageous if mounting or pushing on of the connection head 61 in the direction radially toward the front 79, onto the projection 44 or onto the perforated disk 44 is not possible, for example because insufficient space is available for this, or because the scaffolding component 45 or the scaffolding bar 45 is already fastened onto a projection 44 or onto a perforated disk 44 of another vertical scaffolding element 41, at its end 56.2 facing away from the connection head 61, particularly by means of a second connection head 61 and a second wedge 62, by means of the second wedge 62 inserted through a perforation 55.1 of the perforations 55.1, 55.2, in such a manner that the scaffolding component 45 or the scaffolding bar 45 can be pivoted in a horizontal plane 121 relative to the projection 44 or to the perforated disk 44. Such an installation position is indicated in FIGS. 1 and 2, and will be discussed in further detail below. The connection head 61 that is structured in this way can be produced in particularly simple and cost-advantageous manner.

As is evident from FIGS. 28 and 31, the shoulder 100 extends between the upper side wall parts 71.1, 71.2, passing through the inside space 123 spanned by these parts or by their inner delimitation surfaces 122.1, 122.2. In this way, simple and easy mounting or pushing on of the connection head 61, with its slot 67, onto the projection 44 is possible, and reinforcement, particularly of the upper head part 74 of the connection head 61, can be achieved, so that the static characteristic values of the connection can be improved, as a whole.

The upper shoulder slot surface 107 of the shoulder 100 extends, viewed in vertical section parallel to the vertical plane of symmetry 90, at a vertical first slot surface distance 125 below the upper slot surfaces 95.1, 95.2 of the slot 67 provided in the introduction region 93. When the connection head 61 is supported on the upper delimitation surface 48 of the edge crosspiece 97 of the perforated disk 44, by way of the shoulder 100, the lower slot surfaces 96.1, 96.2 of the slot 67 extend at a vertical second slot surface distance 126 below the lower delimitation surface 49 of the edge crosspiece 97 of the projection 44. According to the invention, the first slot surface distance 125 is equal to the second slot surface distance 126. Preferably, the first slot surface distance 125 and the second slot surface distance 126 can amount to about 1.5 mm, in each instance. By means of this measure, a certain or slight play remains during mounting of the connection head 61, with its slot 67, onto the perforated disk 44, which play facilitates mounting. By means of the said measure, or by means of the special configuration of the shoulder 100, however, the result is also achieved that when the connection head 61, with its slot 67, is completely mounted onto the perforated disk 44, so that the connection head 61 is supported on the edge crosspiece 97 of the perforated disk 44, by way of the shoulder 100 on the top side 57 of the perforated disk 44, centering of the connection head 61 not only relative to the horizontal center plane 68 of the slot 67 but also relative to the horizontal center plane 51 of the perforated disk 44 is achieved. In other words, according to the invention, the result can be achieved or it can be provided not only that the first distance 151.1 of the upper end 152 of the upper contact support surface 65.1 of the upper head part 74 from the horizontal center plane 68 of the slot 67 and the second distance 153.1 of the lower end 154 of the lower contact support surface 65.2 of the lower head part 75 from the horizontal center plane 68 of the slot 67 are equal in size, but also that the first distance 151.2 of the upper end 152 of the upper contact support surface 65.1 of the upper head part 74 from the horizontal center plane 51 of the perforated disk 44 and the second distance 153.2 of the lower end 154 of the lower contact support surface 65.2 of the lower head part 75 from the horizontal center plane 51 of the perforated disk 44 are equal in size. In this way, the same lever arm conditions can be achieved at positive bending stresses toward the top as well as negative bending stresses toward the bottom, and, accordingly, improved static characteristic values of the connection or of the connection node can be achieved.

Both the first distance 151.1 of the upper end 152 of the upper contact support surface 65.1 of the upper head part 74 from the horizontal center plane 68 of the slot 67 and the second distance 153.1 of the lower end 154 of the lower contact support surface 65.2 of the lower head part 75 from the horizontal center plane 68 of the slot 67 amount to about 36 mm in the exemplary embodiment shown. Both the first distance 151.2 of the upper end 152 of the upper contact support surface 65.1 of the upper head part 74 from the horizontal center plane 51 of the perforated disk 44 and the second distance 153.2 of the lower end 154 of the lower contact support surface 65.2 of the lower head part 75 from the horizontal center plane 68 of the perforated disk amount to about 36 mm in the exemplary embodiment shown.

The wall part 112 of the upper head part 74 that contains the shoulder 100 extends horizontally and transversely between the upper side wall parts 71.1, 71.2 in the interior 123 of the connection head 61. The said wall part 112 furthermore extends toward the front, into the wedge accommodation space 123, delimiting same toward the rear. The said wall part 112 has a front delimitation edge 128 that is rounded in convex manner, viewed in a vertical section containing the vertical plane or the vertical plane of symmetry 90. This front delimitation surface 128 forms a release edge 128 for releasing the wedge, which will be discussed in greater detail below.

At the same time, the said wall part 112 or the body containing the shoulder 100 forms an inner wedge support body 85 for vertical support of the lower wedge end 109 of the wedge 62 in an installation position 263, in which position mounting of the connection head 61, with its slot 67, onto the perforated disk 44 is made possible without blockage by the wedge 62. The wedge support body 85 is disposed above the slot 67, engaging over the slot 67 toward the front 79. The wedge support body 85 has wedge support surfaces 108, on which the wedge 62 can be supported with its lower wedge end 109, in the said installation position 263. The wedge support surfaces 108 follow a front delimitation edge 128 of the shoulder 100 or of the said wall part 112, running toward the rear 52 and top 110. At least the wedge support surfaces 108 of the wedge support body 85 disposed in the region of or adjacent to the said delimitation edge 128 are disposed at a slight vertical distance 129 above the shoulder slot surface 107. This distance 129 is less than half the slot height 98 or width in the introduction region 93 of the slot 67. The wedge support surfaces 108 are inclined at a slant toward the front 79 and bottom 115 in the direction of the front delimitation edge 128 of the said wall part 112, and are structured to be concave, viewed in a vertical section containing the vertical plane of symmetry 90. In the exemplary embodiment shown, the wedge support surfaces 108, viewed in the said vertical section, are structured with an inner radius 130 that preferably amounts to about 7 mm. This inner radius 130 is slightly greater than the outer radius 131, which preferably amounts to about 6.25 mm, of the wedge end part 201 at the lower wedge end 109 of the wedge, which can be supported on the wedge support surfaces 108.

The said wedge support surfaces 108 delimit an accommodation pocket 132 for accommodation and support of the wedge end part 201 on the lower wedge end 109 of the wedge 62, which part, as has already been mentioned, is rounded in concave manner with the said outer radius 131. Viewed in the vertical section containing the vertical plane of symmetry 90, the accommodation pocket 132 has an inside contour 133 that extends in circular shape over a circumference angle 134, preferably of about 160 degrees. The inside contour 133 of the accommodation pocket 132 corresponds with an outside contour 135 of the wedge 62, which is also circular, on its lower wedge end 109. Viewed in the vertical section containing the plane of symmetry 90, the accommodation pocket 132 is delimited, toward the bottom 115 and front 79, by the lower, front delimitation edge 128 of the wedge support body 85 or of the shoulder 100. The accommodation pocket 132 is delimited toward the top 110 and front 79, by an upper front delimitation edge 124 of a wedge pivot counter-bearing 86, which preferably, at the same time, forms a wedge retainer body that delimits the wedge accommodation space 84 toward the rear 52. The wedge pivot counter-bearing 86 is therefore disposed above the wedge support surfaces 108 of the wedge support body 85 that allow vertical support of the wedge 62 at its lower wedge end 109.

When the wedge 62 is vertically supported on the wedge support surfaces 108 of the wedge support body 85, it can be laid against the wedge pivot counter-bearing 86 in the region of its lower wedge end 109. When the wedge 62 lies against the wedge pivot counter-bearing 86, vertically supported on the wedge support surfaces 108 of the wedge support body 85, the wedge 62 can be pivoted toward the rear 52 about the wedge pivot counter-bearing 86 with its wedge part 136 that projects out toward the top 110, beyond the upper wedge opening 80, and, at the same time, can be pivoted toward the front 79 with its lower wedge end 109, specifically all the way into a release position in which the lower wedge end 109 slips vertically toward the bottom 115 as the result of gravity or because of the inherent weight of the wedge 62, toward the front 79 beyond the lower, front delimitation edge 128 of the wedge support body 85 or the shoulder 100, also referred to as the release edge, so that the lower wedge end 109 moves into or through the slot 67 or while crossing the slot 67, all the into or through the lower wedge opening 81.

The front delimitation edge 124 of the wedge pivot counter-bearing 86 extends horizontally between the upper side wall parts 71.1, 71.2 of the upper head part 74, on both sides of the vertical plane of symmetry 90, preferably continuously. The front delimitation edge 124 of the wedge pivot counter-bearing 86 delimits the upper wedge opening 80 toward the rear 52. The wedge pivot counter-bearing 86, viewed in the vertical section containing the vertical plane of symmetry 90, is delimited, proceeding from its front delimitation edge 124, vertically toward the bottom 115, by an inner wall part 139 of the upper head part 74 that delimits the accommodation pocket 132, and, proceeding from its delimitation edge 124, is delimited toward the top 110 by an upper wall part 140 that extends horizontally from the upper head part 74 all the way to the upper contact wall part 63.1. The upper wall part 140 has a surface 138 that runs approximately parallel to the center plane 68 of the slot 67 or approximately parallel to the longitudinal axis 94 of the round tube 78 of the scaffolding component 45 or of the scaffolding bar 45. This surface, viewed in the vertical section containing the vertical plane of symmetry 90, is disposed at a slight distance 137 below the outer surface 155 of the round tube 78. The said surface 138 of the upper wall part 140 or the top side of the wedge pivot counter-bearing 86 has a vertical distance 156 from the shoulder slot surface 107 of the shoulder 100. This distance amounts to about 18.3 mm in the exemplary embodiment shown. The front delimitation edge 124 of the wedge pivot counter-bearing 86 has a horizontal distance 142 from the impact ring surface 141 of the connection part 64. This distance amounts to about 22 mm in the exemplary embodiment shown.

As is particularly evident from FIGS. 24, 31, 34, and 35, the accommodation pocket 132 is delimited, in the region of its transverse center, containing the vertical plane of symmetry 90, in other words laterally, by two centering support tabs 143.1, 143.2. The centering support tabs 143.1, 143.2 have centering support surfaces 144.1, 144.2 that lie opposite one another, for the wedge 62. The wedge 62 is supported laterally between the centering support surfaces 144.1, 144.2, at its lower wedge end 109, with little play, when the wedge 62 is supported on the wedge support surfaces 144.1, 144.2 of the wedge support body 85 with its lower wedge end 109. In this way, lateral tilting of the wedge 62 that passes through the upper wedge opening 80, relative to the vertical plane of symmetry 90, can be minimized, and thereby, during movement of the connection head 61, with its slot 67, in a or the essentially horizontal mounting direction 105, toward the front 79, radially toward the projection 44 or toward the perforated disk 44, and also during mounting of the connection head 61, with its slot 67, toward the front 79, radially onto the projection 44 or onto the perforated disk 44, more precise or more secure activation and release of the wedge 62 can be achieved. The centering support surfaces 144.1, 144.2 of the centering support tabs 143.1, 143.2 extend at a horizontal distance 157 relative to one another. The distance 157 amounts to about 10 mm in the exemplary embodiment. This distance 157 is slightly greater than the thickness 145 of the wedge 62. The thickness 145 of the wedge 62 amounts to about 6 mm in the exemplary embodiment. The centering support tabs 143.1, 143.2 are disposed in an upper region 146 of the accommodation pocket 132, in other words in the region or in the vicinity of the wedge pivot counter-bearing 86. The centering support tabs 143.1, 143.2 extend toward the front 79 and bottom 115 into the wedge accommodation space 84. These two measures have proven to be particularly advantageous when the wedge 62 is supported, at its lower wedge end 109, on the wedge support surfaces 108 of the accommodation pocket 132 or of the wedge support body 85, in order to then achieve more secure guidance of the wedge 62 in the region of its lower wedge end 109, until its release.

A zinc run-out opening 147 opens into the accommodation pocket 132, preferably essentially above the wedge support surfaces 108. This opening extends from the accommodation pocket 132 at a slant toward the rear 52 and bottom 115, at an inclination angle 136 relative to the vertical axis 148, all the way into a cavity 149 of the connection head 61, which stands in a passage connection with the perforation 82 in the connection part 64 of the connection head 61. In the exemplary embodiment shown, the inclination angle 136 amounts to about 57 degrees. The zinc run-out opening 147 has an inside diameter 150. This diameter amounts to about 6 mm in the exemplary embodiment shown. The zinc run-out opening 147 opens into the accommodation pocket 132, in a central region between the centering support surfaces 144.1, 144.2 of the centering support tabs 143.1, 143.2 and the wedge support surfaces 108. By means of the above measures, the zinc can flow out of the accommodation pocket 132 well in the case of zinc-plating of the connection head 61, so that no disruptive zinc collections can come about in this region. However, it is understood that in place of a central zinc run-out opening 147, at least two zinc run-out openings that open into the accommodation pocket 132 and are particularly disposed to the side of the vertical plane of symmetry 90, in each instance, can also be provided. These openings can be provided, for example, vertically below the centering support tabs 143 or in horizontally spaced apart edge regions of the upper side wall parts 71.1, 71.2, in each instance.

Figure 36:
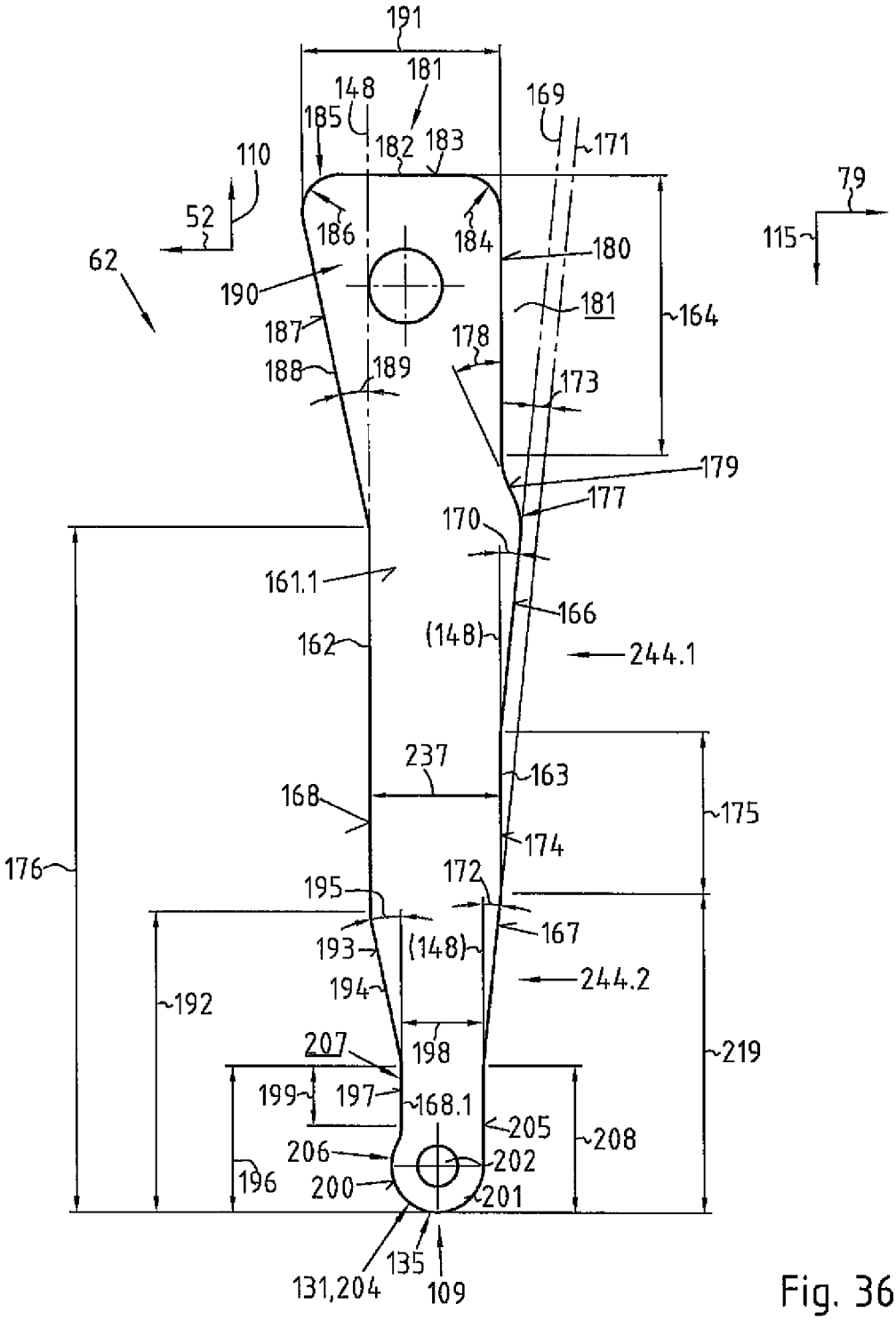
Figure 37:
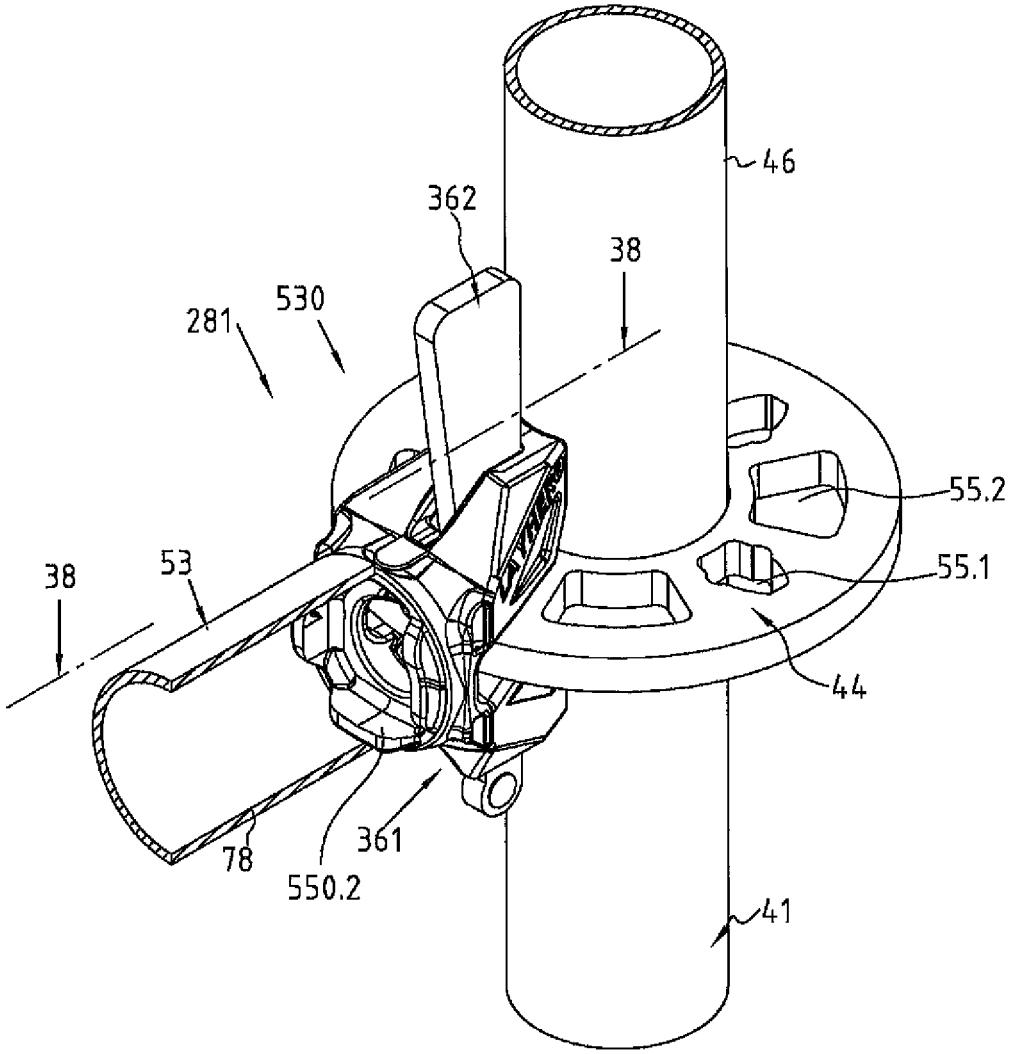
FIGS. 37 to 50 a second exemplary embodiment of a connection node according to the invention or of an arrangement according to the invention or of a connection head according to the invention, along with a wedge according to the invention.
Figure 38:
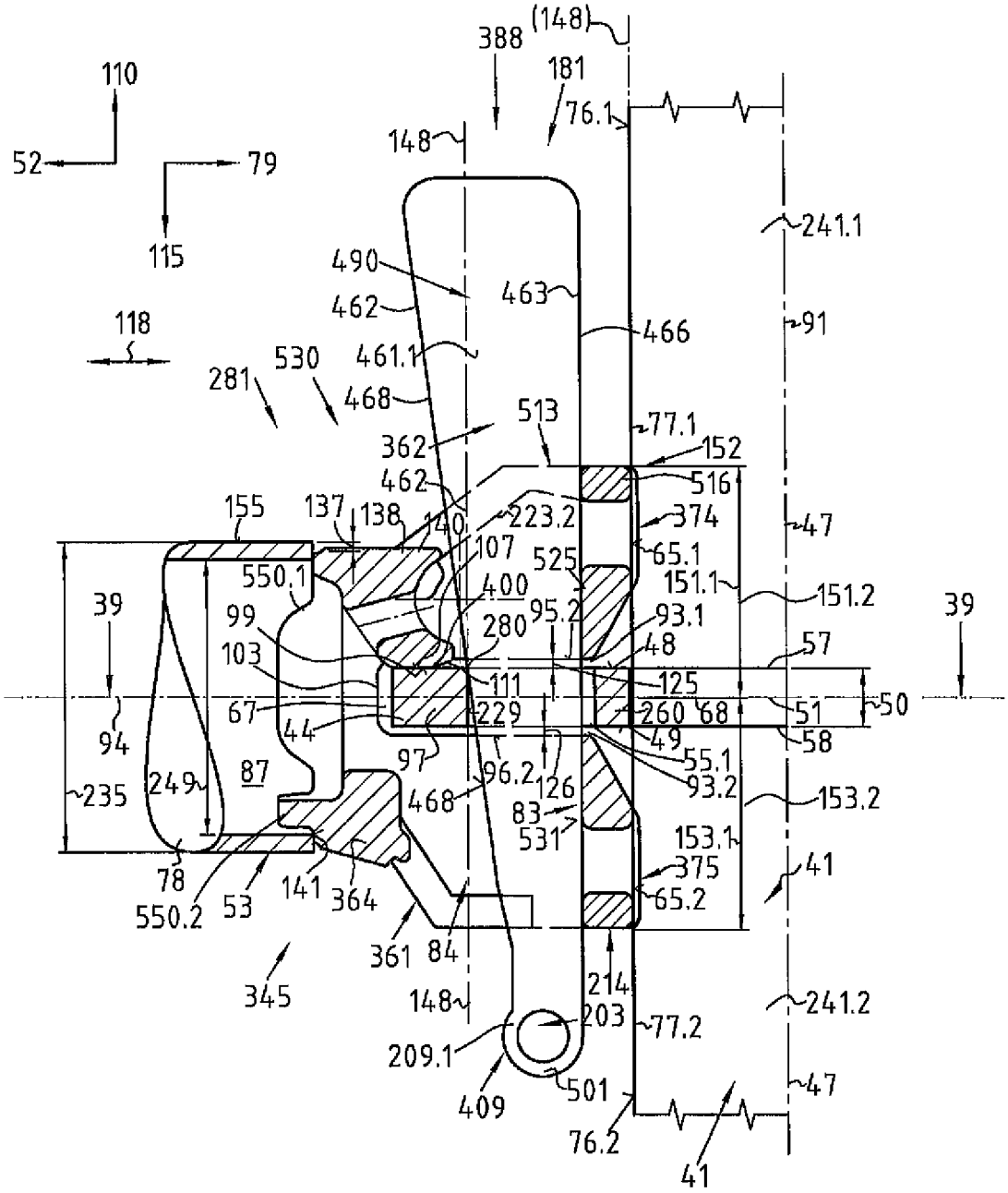
Figure 39:
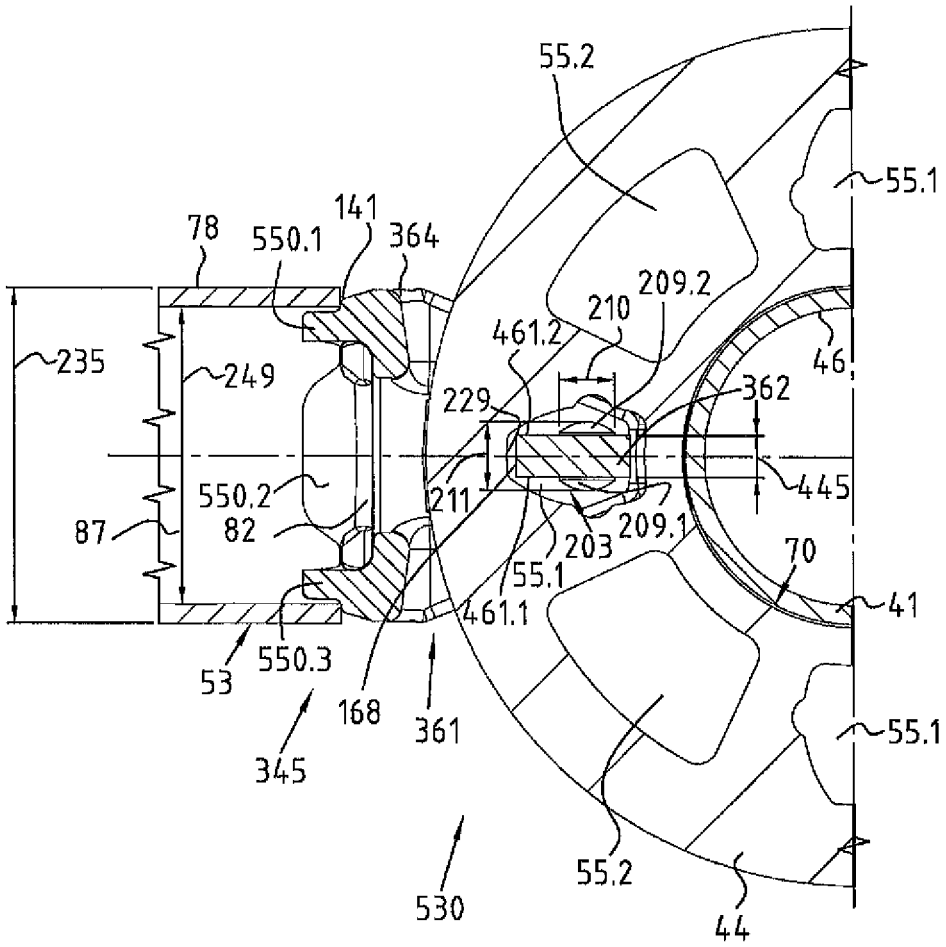
Figure 40:
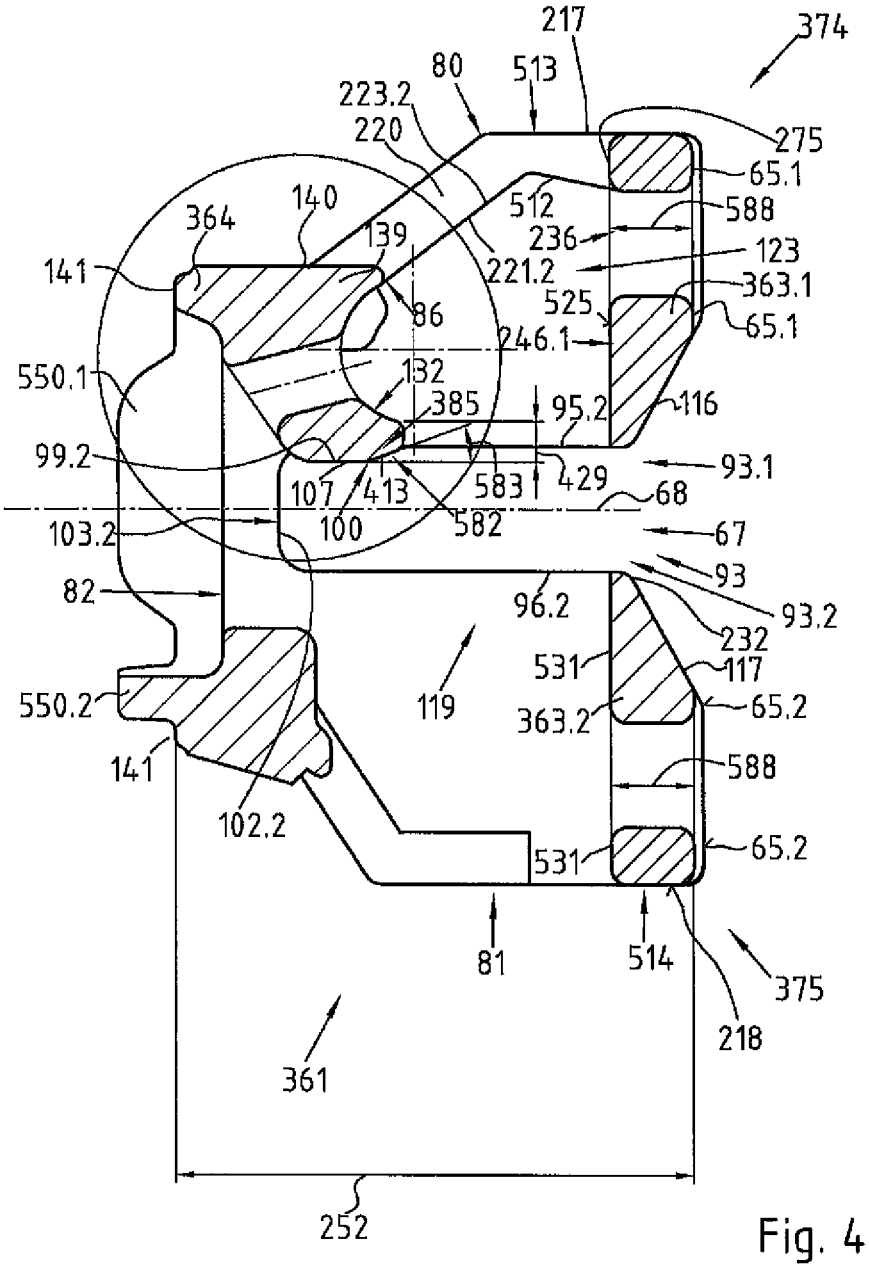
Figure 41:
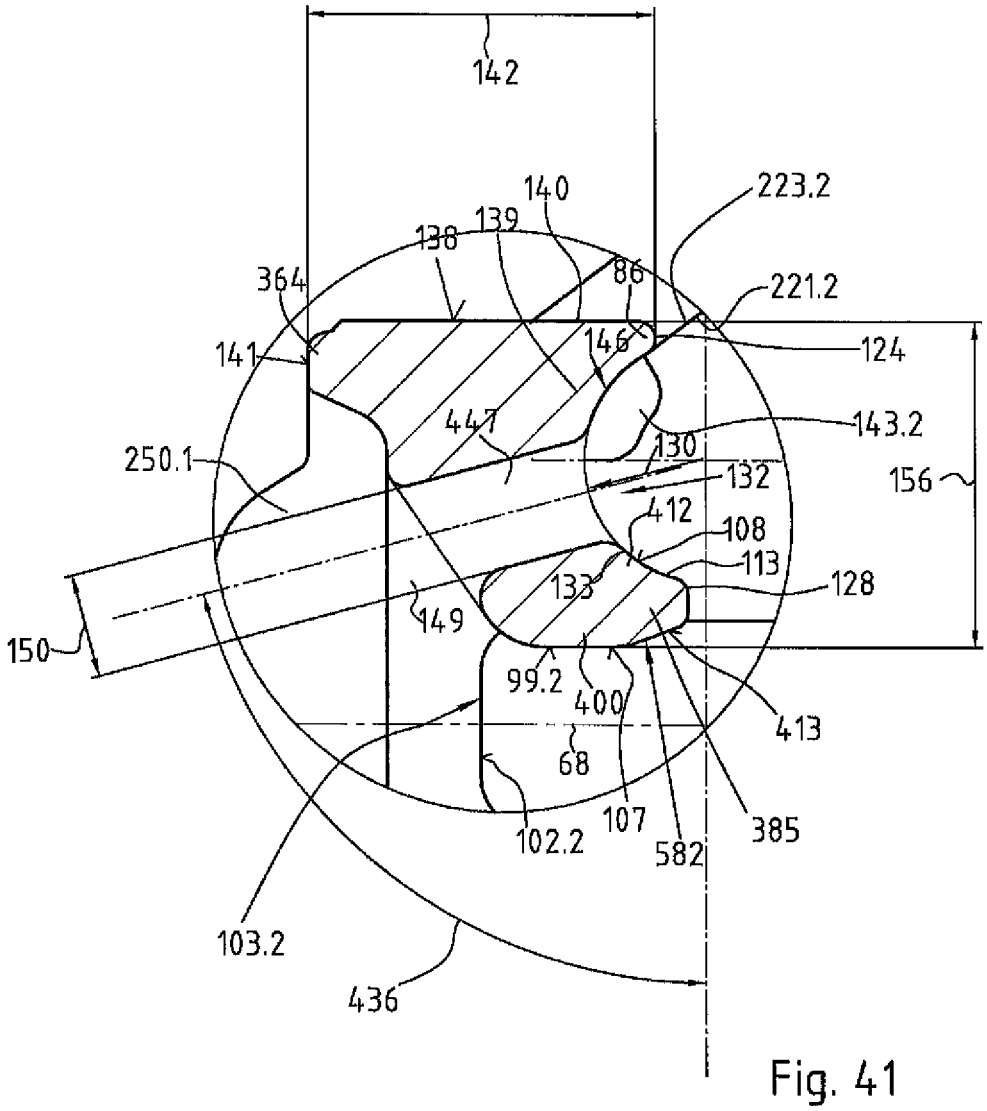
Figure 42:
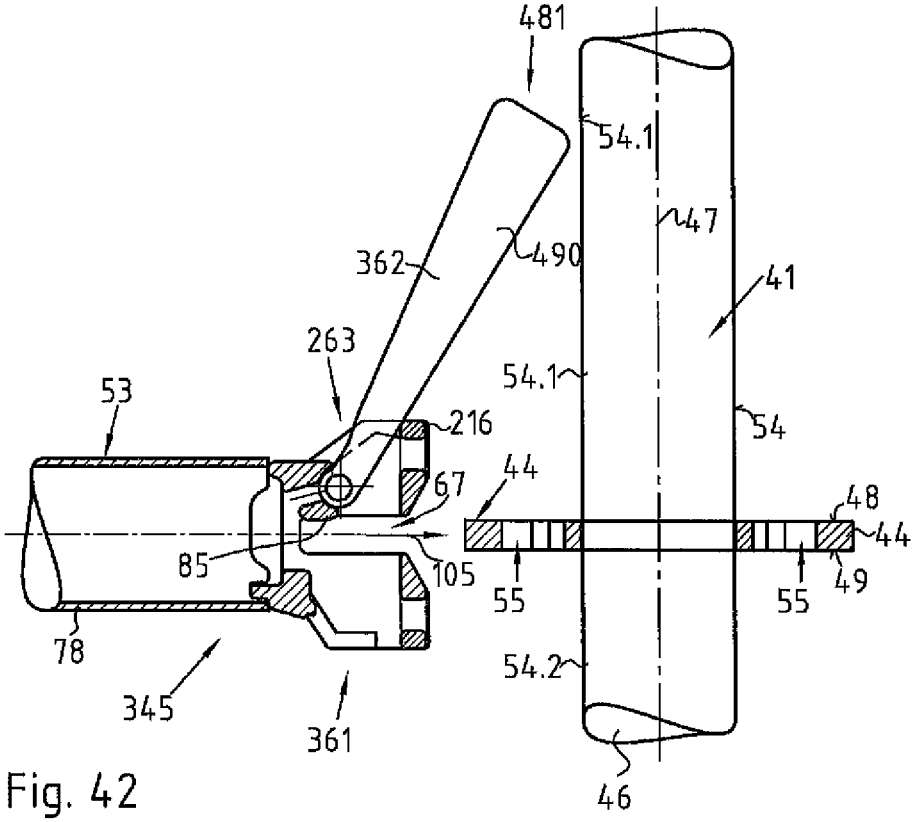
Figure 43:
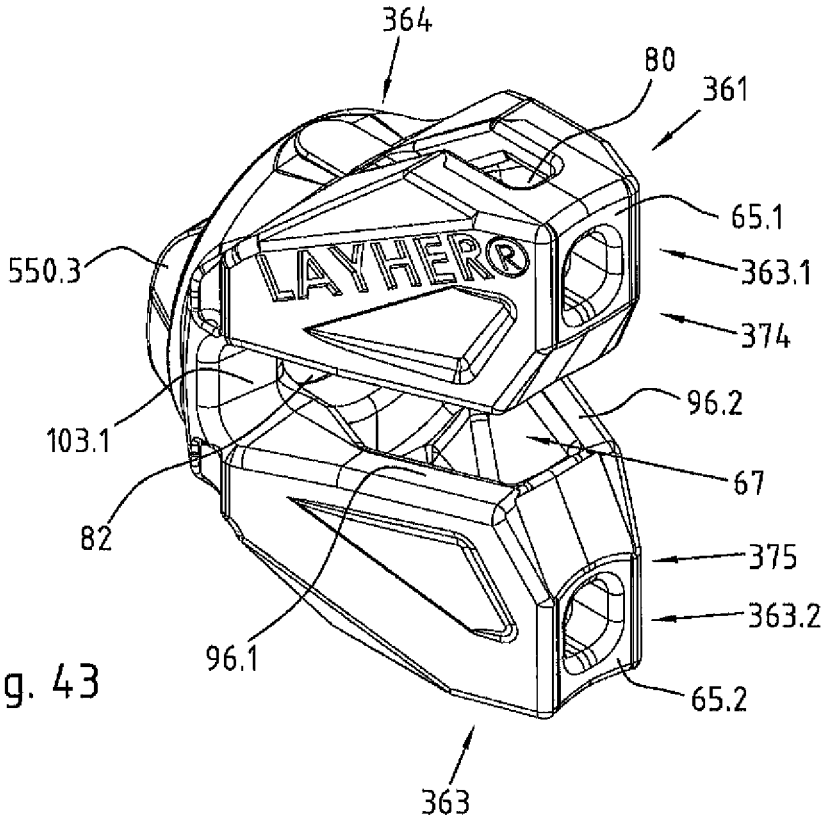
Figure 44:
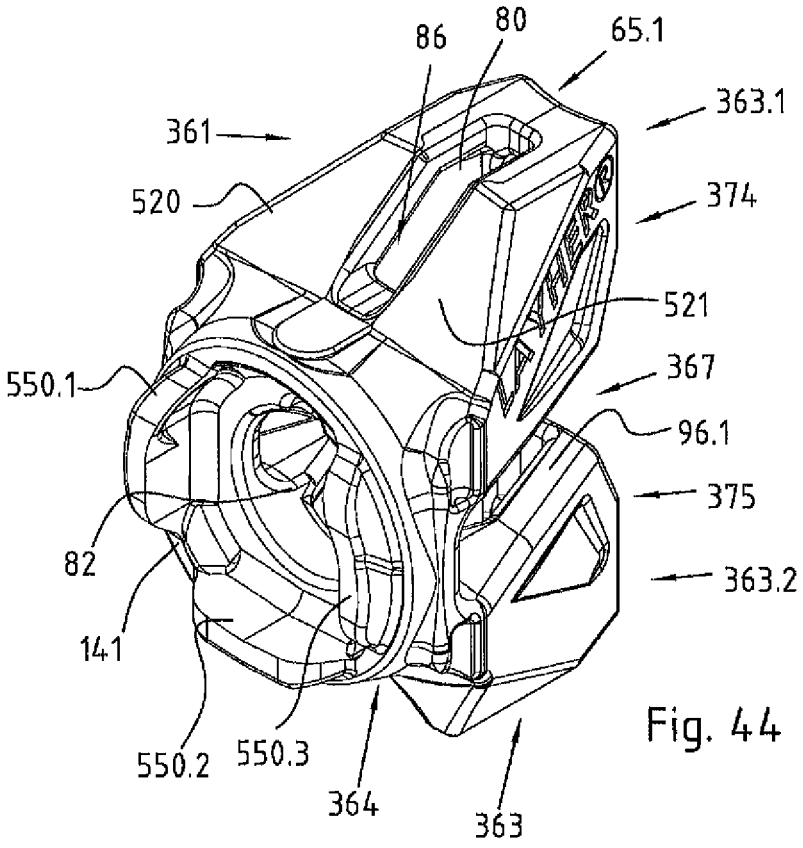
Figure 45:
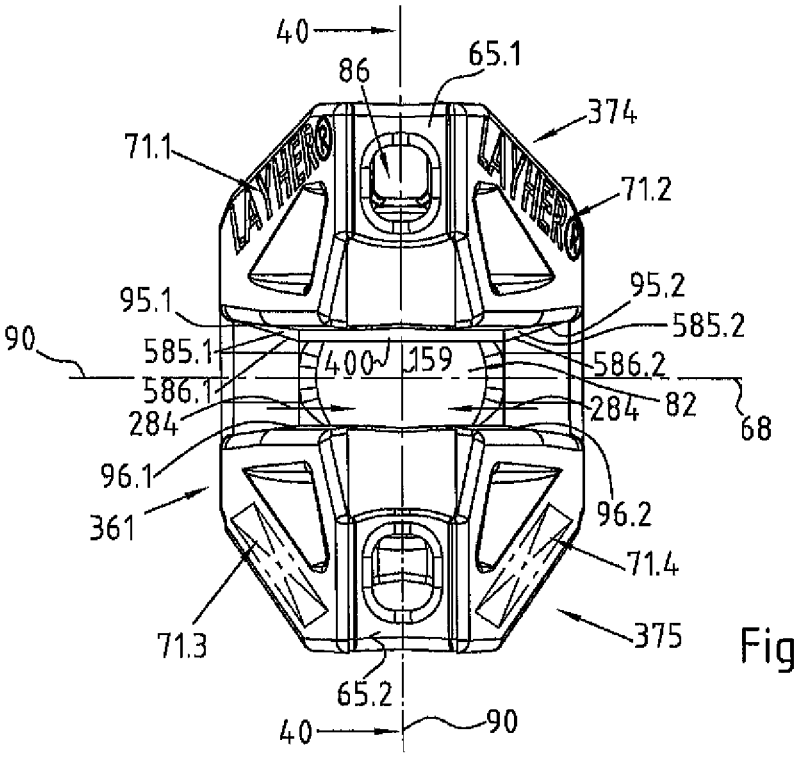

In the following, the wedge 62 according to the invention will be described in greater detail; it is shown separately in FIG. 36, in an installation position:

The wedge 62 consists of flat material, particularly of steel. It has an essentially constant wedge thickness 145. This thickness amounts to about 6 mm in the exemplary embodiment. The wedge 62 has parallel wedge side surfaces 161.1, 161.2 that face away from one another. The wedge 62 is delimited toward the rear 52 by a rear, first wedge face edge 162, and toward the front 79 by a front, second wedge face edge 163. The rear or first wedge face edge 162 is delimited by a vertical, rear, essentially level contact surface 164, which runs parallel to a or the vertical axis 148. The front or second wedge face edge 163 has an essentially level, upper contact surface 166 and an essentially level, lower contact surface 167, which runs parallel to the upper contact surface 166. The upper contact surface 166 and the lower contact surface 167 of the front or second wedge face edge 163 face toward the front 79, away from the contact surface 168 of the rear or first wedge face edge 162 that faces toward the rear 52. The upper contact surface 166 extends along a first slanted axis 169, at a slant toward the bottom 115 and the rear 52. The first slanted axis 169 is inclined at an inclination angle 170 relative to the vertical axis 148. The lower contact surface 167 also extends at a slant toward the bottom 115 and the rear 52 along a second slanted axis 171. The second slanted axis 171 is inclined at an inclination angle 172 relative to the vertical axis 148, which angle is equal in size to the inclination angle 170 of the first slanted axis 169 relative to the vertical axis 148. The inclination angle 170, 172, in each instance, amounts to about six degrees in the exemplary embodiment shown. The first slanted axis 169 or the upper contact surface 166 is configured to be offset toward the rear 52, relative to the second slanted axis 171 or the lower contact surface 167, by a specific contact surface distance or amount 173. The said amount 173, by which the upper contact surface 166 is offset toward the rear 52 relative to the lower contact surface 167, amounts to about 3.0 mm in the exemplary embodiment shown, viewed in a plane that runs parallel to the wedge side surfaces 161.1, 161.2, or viewed in an imaginary vertical plane that contains the first slanted axis 169 and the second slanted axis 171 as well as in a direction perpendicular to the second slanted axis 171.

In the region between the front, lower contact surface 167 and the front, upper contact surface 166 of the front or second wedge face edge 163, the latter is delimited by a vertical front face surface 174 that runs parallel to the vertical axis 148 or parallel to the vertical rear contact surface 168 of the rear or first vertical wedge face edge 162. This face surface 174 extends vertically over a length 175. This length amounts to about 21.5 mm in the exemplary embodiment. The upper contact surface 166 makes a transition into a slanted support surface 179 that is inclined at an inclination angle 178, toward the rear 52 and top 110, at a wedge part distance 176, toward the top 110, which distance preferably amounts to about 92.4 mm from the lower wedge end 109, preferably rounded at a rounding radius 177 that amounts to about 10 mm, for example; this surface in turn makes a transition, toward the top 110, into a vertical support surface 180 of the front or second wedge face edge 163, which surface runs parallel to the vertical axis 148. In this manner, a toe board fitting recess 158 that extends vertically above the said slanted support surface 179 is formed, which recess allows accommodation of a toe board fitting of a toe board, not shown in the figures. The toe board fitting can be supported, on its side facing the vertical support surface 180, laterally on this vertical support surface 180 of the front or second wedge face edge 163. It can be supported vertically downward on or on top of the slanted support surface 179 of the front or second wedge face edge 163. On its side facing away from the vertical support surface 180, the toe board fitting can be supported on a vertical outer surface 76.1 of a vertical scaffolding element, for example of a post 41, when the connection head 61 is mounted onto a projection, for example onto a perforated disk 44 of the vertical scaffolding element 41, and locked in place by means of the wedge 62, preferably also braced (see also FIGS. 21 and 24). The vertical support surface 180 extends vertically in the direction toward the top 110 to the upper wedge end 181, over a length 164. This length can preferably amount to about 40 mm. The vertical support surface makes a transition, with a rounding radius 184, preferably of about 5 mm, into an upper drive-in surface 183 on the upper wedge end 181 or drive-in end of the wedge 62. The upper wedge end 181 or drive-in end is formed by a horizontal upper wedge edge 182 that runs parallel to the vertical axis 148. This edge is delimited by the upper drive-in wedge surface 183 for driving in the wedge 62 with a hammer. The drive-in wedge surface 183 makes a transition, in the region of its rear upper end 185, particularly rounded with a radius 186 that also amounts to about 5 mm, for example, into an upper slanted wedge surface 187 of a slanted wedge edge 188. The slanted wedge edge 188 is configured inclined toward the front 79 and bottom 115 at an inclination angle 189, which preferably amounts to about 12 degrees relative to the vertical axis 148. The slanted wedge surface 187 extends at a slant toward the bottom 115 and front 79, until it makes a transition into the vertical rear contact surface 168 of the rear or first wedge face edge 162 at a wedge part distance 176 from the lower wedge end 109. The upper wedge part 190 delimited by the slanted wedge surface 187, the upper drive-in wedge surface 183, and the vertical support surface 180 extends beyond the upper head part 74 of the connection head 61, vertically toward the top 110 (see also FIG. 24), when the connection head 61, with its slot 67, has been mounted onto the projection or onto the perforated disk 44 and locked and braced in a or the locking position 88. The upper wedge part 190 has a maximal wedge part width 191 in the region of the upper wedge end 181. This width amounts to about 27 mm in the exemplary embodiment. It is selected to be of such a size that the wedge 62, when the connection head 61 or the scaffolding component 45 having the connection head 61 is handled separately, and when the wedge 62 is inserted not only through the upper wedge opening 80 but also through the lower wedge opening 81, definitely cannot fall out downward through the lower wedge opening 81.

In the vertical region where the rear contact surface 168 of the first or rear wedge face edge 162 and the front face surface 174 of the second or front wedge face edge 163 extend parallel to one another, the wedge has a wedge width 237. This width preferably amounts to about 17.8 mm. The vertical rear contact surface 168 makes a transition, at a distance 192 from the lower wedge end 109 that preferably amounts to slightly less than about 43 mm, into a slanted surface 193 inclined toward the front 79 and bottom 115, of a lower slanted wedge edge 194, which is configured at an inclination angle 195, which preferably amounts to about 12 degrees, relative to the vertical axis 148. The slanted surface 193 of the lower slanted wedge edge 194 makes a transition into a vertical surface 197 of the rear or first wedge face edge 163, 162 that runs parallel to the vertical axis 148, at a distance 196 from the lower wedge end 109 that preferably amounts to about 20.2 mm.

There, the wedge 62 has a lower wedge width 198 between the vertical surfaces 197, 205 of the rear and the front wedge face edge 162, 163, which run parallel there. This width amounts to about 11 mm in the exemplary embodiment. The said vertical surface 197 extends parallel to the vertical axis 148 over a length 199. This length amounts to about 10 mm in the exemplary embodiment. The vertical surface 197 makes a transition, toward the bottom 115, into a wedge end surface 200 of a wedge end part 201 that delimits the lower wedge end 109. In this part, a bore 160 for accommodating a retainer, here a rivet 203, is placed. The wedge end surface 200 of the lower wedge end part 201 is rounded with a radius 204 that is greater than half the lower wedge width 198, in which the wedge 62 is delimited by the rear vertical surface 197 of the rear or first wedge face edge 162 and by the front vertical surface 205 of the front or second wedge face edge 163, which surface runs parallel to the former surface. In a lower region, in which the wedge end surface 200 delimits the rear or first wedge face edge 162 toward the rear 52, the wedge end surface 200 rises slightly toward the rear 52, beyond the said rear vertical surface 197, so that an elevation 206 is configured there. The elevation 206, delimited by the rounded wedge end surface 200, the vertical surface 197 that follows it at a slant toward the top 110, and the slanted surface 193 that follows that at a slant toward the rear 52 and the top 110, delimit a bridging recess 207. This recess is provided for ensuring that the wedge 62, when it is inserted through the upper wedge opening 80 and undetachably secured by means of the retainer 203, can be laid against the outer surface 155 of a rod element firmly connected with the connection head part 64 of the connection head 61, here of the round tube 78, after having been pulled upward or in a pulled-upward state, in which the retainer 203 prevents further pulling out of the wedge 62 toward the top, in the course of pivoting toward the rear 52 and bottom 115, until the wedge 62 makes contact, with its rear or first wedge face edge 162, in the region of the upper wedge end 181. In this manner, optimal space-saving accommodation of the wedge 62 for transport purposes is possible, and the risk of hooking onto other scaffolding components is minimized.

The rounded wedge end surface 200 of the lower wedge end part 201 makes a transition into the front lower vertical surface 205 of the front or second wedge face edge 163, in a partial region assigned to the front, second wedge face edge 163, tangentially toward the top 110. This vertical surface 205 extends all the way to a distance 208 from the lower wedge end 209. This distance 208 amounts to about 19.5 mm in the exemplary embodiment. The said vertical surface 205 makes a transition into the lower, front contact surface 167 of the front or second wedge face edge 163 toward the top 110, preferably at a distance 219 from the lower wedge end 109.

The wedge 62 is undetachably connected with the connection head 61. For this purpose, the wedge 62 has a retainer 203 in the form of a material thickening in the region of its lower wedge end 109, here on the wedge end part 201. In the exemplary embodiment, a rivet 203 is provided as the retainer. This rivet has rivet heads 209.1, 209.2 that project laterally beyond the level wedge side surfaces 161.1, 161.2 of the wedge 62. A truss-head rivet or a blind rivet, for example, can be used as the rivet 203. Preferably, the truss-head rivet can be riveted by machine, while the blind rivet can preferably be riveted by hand. The rivet heads 209.1, 209.2 span a maximal rivet head diameter 210 that is greater than the inside diameter of the accommodation bore 202 provided on the lower wedge end 109 of the wedge 62. Preferably, the maximal rivet head diameter 210 is less than twice the rounding radius 204 with which the lower wedge end part 201 is rounded (see, for example, FIGS. 25 and 36).

The rivet 203 projects laterally beyond the two wedge side surfaces 161.1, 161.2 of the wedge 62, with its rivet heads 209.1, 209.2, at a rivet width 211, which is greater than the slot width 114 of the upper wedge opening 80. As a result, the wedge 62 cannot be pulled out of the connection head 61 toward the top 110, but rather the wedge 62 can only be pulled upward up to an impact of at least one of its rivet heads 209.1, 209.2 against the inner delimitation surfaces 212 of the wall parts that delimit the upper wedge opening 80, particularly of the upper horizontal wall part 213, of the upper head part 74 of the connection head 61.

The lower wedge opening 81 of the lower head part 75 is larger than the upper wedge opening 80 of the upper head part 74, specifically so large that the lower wedge end 109, with the rivet 203 fastened in place there, can be inserted through the lower wedge opening 81, toward the bottom 115, without problems.

The upper wedge opening 80 structured as a longitudinal slot 215 extends on both sides of the vertical plane of symmetry 90 of the connection head 61. The longitudinal slot 215 has a slot width 114 that is only slightly greater than the thickness 145 of the wedge 62. The slot width 114 amounts to about 7.2 mm in the exemplary embodiment.

The upper wedge opening 80 is delimited, toward the front 79, by a front wall part 216 of the contact wall part 63.1 of the upper head part 74. This front wall part 216 is also an integral part of the upper horizontal wall part 213, which delimits the upper head part 74, toward the top 110, by a horizontal outer surface 217, which is configured parallel to the center plane 68 of the slot 67. Toward the inside 123, toward the wedge accommodation space 84, the upper horizontal wall part 213 is delimited by a horizontal inner surface 212 that runs parallel to the horizontal outer surface 217. The horizontal wall part 213 makes a transition, toward the rear 52, into a rear wall part 220 that runs at a slant toward the bottom 115, up to the connection part 64. The latter part is delimited by outer surfaces 221 in the form of partial circular cylinders. The horizontal inner surfaces 212 of the upper horizontal wall part 213 make a transition, on both sides of the upper wedge opening 80, toward the rear 52, into wedge guide surfaces 222.2, 222.2 of wedge guide edges 223.1, 223.2 that run toward the rear 52 and at a slant toward the bottom 115. The wedge guide edge 223.1, 223.2, in each instance, is configured with wedge guide surfaces 222.1, 222.2 that extend approximately perpendicular to the vertical plane of symmetry 90. These surfaces delimit the rear wall part 220, toward the front 79, toward the wedge accommodation space 84. The wedge guide edges 223.1, 223.2 or their wedge guide surfaces 222.1, 222.2 make a transition, at a slant toward the rear 52 and bottom 115, tangentially into the accommodation pocket 132 or its inner surfaces. The wedge guide edges 223.1, 223.2 or the wedge guide surfaces 222.1, 222.2 allow advantageous guidance of the wedge 62 on or by way of its material thickening, here the rivet heads 209.1, 209.2, which are provided in the region of the lower wedge end 109 of the wedge 62. This will be discussed in greater detail below.

The upper contact wall part 63.1 of the upper head part 74 that has the front upper contact support surfaces 65.1 is delimited, toward the rear 52 and bottom 115, toward the wedge accommodation space 84, by an inner, essentially level, upper wedge support surface 225. The upper wedge support surface 225 extends approximately from the upper horizontal outer surface 217 of the upper horizontal wall part 213 of the upper head part 74, in the direction at a slant toward the rear 52 and bottom 115, at the first inclination angle 170 relative to a or the vertical axis 148. The upper wedge support surface 225 extends at a slant toward the bottom 115, up to a specific height 226 above the upper slot surfaces 95.1, 95.2 in the introduction region 93. This height amounts to about 8 mm in the exemplary embodiment. In this way, the upper contact wall part 63.1 of the upper head part 74 is delimited, toward the inside, toward the wedge accommodation space 84, over the said height 226, by a preferably level inner surface 227 that runs parallel to the vertical axis 148. In this way, the wedge 62 that has been inserted through the upper and through the lower wedge opening 80, 81, can be pulled up, particularly proceeding from the locking position 88 shown in FIG. 24, particularly easily and without hindrance, toward the top 100, over the projection or over the perforated disk 44.

The vertical axis 148 is determined by an essentially level, vertical wedge support surface 229 that delimits a, preferably each perforation 55; 55.1, 55.2 of the perforations 55; 55.1, 55.2 of the perforated disk 44 radially toward the outside 52, which perforation extends from the upper delimitation surface 48 all the way to the lower delimitation surface 49 of the perforated disk 44. This vertical axis 148, with which the longitudinal axis 47 of the post 41 also runs parallel, ideally corresponds to the plumb line, in the constructed state of the post 41 or of the arrangement 230 for a scaffolding 40 or of a scaffolding 40 that contains this post and the connection head 61 with the wedge 62. It is understood that the vertical axis 148 can be inclined relative to the plumb line, at a certain inclination angle, within the scope of construction or suspension deviations that occur in practice.

The lower contact wall part 63.2 of the lower head part 75 is delimited, toward the rear 52 and bottom 115, toward the wedge accommodation space 84, by an inner, essentially level, lower wedge support surface 231. The lower wedge support surface 231 extends approximately from the front end 232 of the lower introduction region 93.2 of the lower head part 75, in the region of the lower introduction bevel 117, at a slant in the direction toward the rear 52 and bottom 115, at the second inclination angle 172 relative to the vertical axis 148. In this connection, the lower wedge support surface 231 extends approximately to a lower horizontal surface 218 of the lower horizontal wall part 214 of the lower head part 75, which surface delimits the lower head part 75 toward the bottom 115. The first inclination angle 170 is equal in size to the second inclination angle 172. It therefore also amounts to six degrees, in each instance, in the exemplary embodiment shown, as in the case of the wedge 62.

The upper horizontal wall part 213 is delimited, toward the top 110, by an upper horizontal surface 217, and the lower horizontal wall part 214 is delimited, toward the bottom 115, by a lower horizontal surface 218, which surfaces extend parallel to one another and parallel to the center plane 68 of the slot 67. The upper horizontal wall part 213 or its upper horizontal surface 217, and also the lower horizontal wall part 214 or its horizontal surface 218, viewed in vertical section containing the vertical plane or the vertical plane of symmetry 90, have a length 233, 234 of equal size. In the exemplary embodiment shown, this length amounts to about 21 mm.

The first inclination angle 170 and the second inclination angle 172 and, accordingly, the upper wedge support surface 225 and the lower wedge support surface 231, run parallel to one another. The upper wedge support surface 225 or the first slanted axis 169 is configured to be offset relative to the lower wedge support surface 231 or the second slanted axis 171, toward the rear, by a specific wedge support surface distance 243 or amount 243. This amount 243 or the wedge support surface distance 243 is equal in size to the contact surface distance 173 or the amount 173 by which the upper contact surface 166 of the wedge 62 is offset toward the rear 52 relative to the lower contact surface 167 of the wedge 62.

The said amount 243, by which the upper wedge support surface 225 is offset backward, toward the rear 52, relative to the lower wedge support surface 231, amounts, in the exemplary embodiment shown, viewed in a vertical section that runs in the vertical plane of symmetry 90, as well as viewed in a direction normal to the lower wedge support surface 231, or amounts, viewed in an imaginary vertical plane that contains the first slanted axis 189 and the second slanted axis 171, as well as in a direction perpendicular to the second slanted axis 171, to about 3.0 mm.

In other words, not only does the wedge 62 have at least two wedge steps 244.1, 244.2 at its front edge 163, having parallel contact surfaces 166, 167 for the connection head 61, offset by a specific amount 173, parallel to the wedge side surfaces 161.1, 161.2, but also the connection head 61 has at least two connection head steps 246.1, 246.2 having parallel wedge support surfaces 225, 231, which correspond to the contact surfaces 166, 167 of the wedge 62, offset parallel relative to the vertical plane or relative to the vertical plane of symmetry 90 by the same amount 243, on an inner edge 89.1, 89.2 of the contact wall part 63.1, 63.2 or on inner edges 89.1, 89.2 of its contact wall parts 63.1, 63.2, or on an inner side 83 of the passage 84. It is understood that the wedge 62 and the connection head 61 can also have more than two such steps. However, what is important is that the contact surfaces of the wedge steps run parallel to one another, and that the wedge support surfaces of the connection head steps also run parallel to one another, so that when the wedge is driven in, no twisting of the wedge can come about.

The connection part 64 of the connection head 61 is delimited, toward the rear 52, by an impact ring surface 141 that runs continuously on the entire circumference, which surface is configured perpendicular to the vertical plane of symmetry 90 and perpendicular to the center plane 68 of the slot or perpendicular to the longitudinal axis 94 of the rod element 78 or of the round tube 78. The impact ring surface 141 is delimited, in the radial direction toward the outside, with reference to an intersection line at which the vertical plane of symmetry 90 and the center plane 68 of the slot 67 intersect perpendicularly, or, with reference to the longitudinal axis 94 of the rod element 78, in the radial direction toward the outside, by an outside diameter 247 that is slightly less than the outside diameter 235 of the rod element 78 in the connection region. In this way, advantageous automatic welding conditions are obtained.

The impact ring surface 141 is delimited, with reference to the intersection line in which the vertical plane of symmetry 90 and the center plane 68 of the slot intersect perpendicularly, or, with reference to the longitudinal axis 94 of the rod element 78, in the radial direction toward the inside, by an inside diameter 248. This diameter is slightly less than the inside diameter 249 of the rod element 78 in the connection region.

Three centering tabs 250 extend in the direction toward the rear 52, beyond the impact ring surface 141, which tabs can be inserted into the rod element or into the round tube 78 or are inserted there. The centering tabs 250 are disposed offset relative to one another at the same circumference angles 251 of 120 degrees, in each instance, about the said intersection line or about the longitudinal axis 94. In this way, advantageous centering conditions occur between rod element 78 and connection head 61, with simultaneously further reduced weight as compared to the previous connection heads or scaffolding components containing them.

The impact ring surface 141, viewed in a longitudinal section that contains the vertical plane or the vertical plane of symmetry 90, has a distance from the front contact support surfaces 65.1, 65.2 of the upper and the lower contact wall part 63.1, 63.2 of the connection head 61, which distance is equal in size to the corresponding distance 252 of the previous connection heads of the LAYHER Allround scaffolding system or corresponding scaffolding systems. This distance 252 amounts to about 50 mm. The connection head 61 according to the invention is therefore structured in optimized manner, also in this regard, while maintaining the general design conditions predetermined by the modular system. However, not only all the measures according to the invention relating to the connection head 61, but also all the measures according to the invention relating to the wedge 62 are optimized, according to the invention, in such a manner that integration or combinability with the existing scaffolding parts is easily possible.

In the following, an arrangement 230 according to the invention will be described, in which the connection head 61 of the scaffolding component 45, with its slot 67, is mounted horizontally onto the perforated disk 44, and in which the wedge 62 is inserted through the upper wedge opening 80, through a perforation 55.1 of the perforations 55.1, 55.2 of the perforated disk, 44, and through the lower wedge opening 81, so that the wedge 62 is in a locking position 88, in which the connection head 61 is locked, with shape fit, to the perforated disk 44, to prevent removal of the connection head 61 from the perforated disk 44, in all possible directions, and in which the connection head 61 can only be removed from the perforated disk 44 after the wedge 62 has been unlocked by means of a force that acts on the wedge 62. Such an arrangement 230 or installation and fastening situation is particularly illustrated in FIGS. 21 to 25.

In the locking position 88, the wedge 62 can be laid or is laid, with the vertical, essentially level contact surface 168 of its rear or first wedge face edge 162, over its full area, against the corresponding, essentially level vertical wedge support surface 229 of the perforated disk 44, which surface delimits the perforation 55.1 of the perforated disk 44 toward the rear 52 and extends parallel to the vertical axis 148. At the same time, the wedge 62, with the essentially level, upper contact surface 166 of its front wedge face edge 163, which extends in the direction toward the rear 52 and bottom 115 at the first inclination angle 170 relative to the vertical axis 148, along the first slanted axis 169, can be laid or is laid, over its full area, against the corresponding inner, upper wedge support surface 225 of the upper head part 74, which faces toward the rear 52, which surface also extends in the direction toward the rear 52 and bottom 115 at the first inclination angle 170 relative to the vertical axis 148, along the first slanted axis 169. Furthermore, the wedge 62 can simultaneously be laid or is laid, with the essentially level, lower contact surface 167 of its front or second wedge face edge 163, which extends in the direction toward the rear 52 and bottom 115 at the second inclination angle 172 relative to the vertical axis 148, along the second slanted axis 171, over its full area, against the inner, lower wedge support surface 231 of the lower head part 75, which surface faces toward the rear 52, and also extends in the direction toward the rear 52 and bottom 115 at the second inclination angle 172 relative to the vertical axis 148, along the second slanted axis 171.

In another representation of the arrangement according to the invention of a scaffolding component 45 having a connection head 61 and a vertical scaffolding element 41 that extends in the direction of a longitudinal axis 47, a projection 44 that extends transversely, in other words in a transverse direction 118 relative to the longitudinal axis 47 of the scaffolding element 41, away from the latter, in other words toward the outside 52, can be fastened onto this element, onto which projection the connection head 61 is mounted, with the formation of a releasable connection.

The projection 44 has an upper delimitation surface 48 and a lower delimitation surface 49. Preferably, these delimitation surfaces 48, 49 extend on both sides of a horizontal center plane 51 of the projection 44.

The projection 44 has at least one recess in the form of a perforation 55; 55.1, 55.2 for insertion of a wedge 62 through it, which is disposed between an inner projection part 260 of the projection, in the transverse direction 118, and an outer projection part 97, in the transverse direction 118, and which extends vertically between the upper and the lower delimitation surface 48, 49.

The connection head 61 has an upper head part 74 having an upper wedge opening 80, and a lower head part 75 having a lower wedge opening 81, for the wedge 62 that can be inserted through the wedge openings 80, 81.

The connection head 61 has a contact part 63, with contact wall parts 63.1, 63.2 having vertically extending contact support surfaces 65.1, 65.2, for making contact with corresponding, vertically extending outer surfaces 54; 54.1, 54.2 of the vertical scaffolding element.

The upper head part 74 has an upper contact support surface 65.1 of the contact support surfaces 65.1, 65.2 for making contact with a corresponding upper outer surface 54.1 of a scaffolding element part 241.1 of the vertical scaffolding element 41 that extends above the projection 44.

The lower head part 75 has a lower contact support surface 65.2 of the contact support surfaces 65.1, 65.2 for making contact with a corresponding lower outer surface 54.2 of a scaffolding element part 241.2 of the vertical scaffolding element 41 that extends downward below the projection 44.

A slot 67 open toward the front 79 toward the contact support surfaces 65.1, 65.2 is disposed between the upper head part 74 and the lower head part 75, with which slot the connection head 61 is mounted onto the projection 44.

The slot 67 is delimited, in a front introduction region 93 of the slot 67, toward the top 110, by upper slot surfaces 95.1, 95.2 of the upper head part 74, and, toward the bottom 115, by lower slot surfaces 96.1, 96.2 of the lower head part 75. Preferably, the slot surfaces 95.1, 95.2; 96.1, 96.2 extend on both sides of a horizontal center plane 68 of the slot 67. The slot 67 is delimited in the transverse direction 118, toward the rear 52, by slot surfaces 102.1, 102.2 of a slot bottom 103.1, 103.2 that extend vertically.

A passage 84 for the wedge 62, also referred to as a wedge accommodation space, is configured between the upper wedge opening 80 and the lower wedge opening 81, which passage extends through the upper head part 74 and through the lower head part 75, intersecting the slot 67, and which approximately aligns with the recess 55; 55.1, 55.2 of the projection 44.

The wedge 62 is inserted through the passage 84 and through the recess 55; 55.1, 55.2 of the projection 44, so that the connection head 61 of the scaffolding component 45 is locked, with shape fit, to the projection 44, using the wedge 62, which is in a locking position 88.

The wedge 62 can be moved, for unlocking the connection head 61 from the projection 44, through the passage 84, toward the top 110, at least all the way to above the upper delimitation surface 48 of the projection 44, so that then, the connection head 61 can be removed from the projection 44.

Either already when the wedge 62 is in the locking position 88, or when the wedge 62 is in the locking position 88 and the connection head 61 is braced against the vertical scaffolding element 41 using the wedge 62, the upper head part 74 is supported on the upper outer surface 54.1 of the scaffolding element 41 with the upper contact support surface 63.1, and the lower head part 75 is supported on the lower outer surface 54.2 of the scaffolding element 41 with the lower contact support surface 63.2.

The upper head part 74 sits on the upper delimitation surface 48 of the projection 44, in a support position, with a support body 100 delimited by an upper slot surface 107 of the slot 67.

Preferably, in the support position, the upper contact support surface 65.1 extends vertically toward the top 110 all the way to an upper end 152 that is disposed at a first distance 151.1 from the horizontal center plane 68 of the slot 67 and at a first distance 151.2 from the horizontal center plane 51 of the projection 44.

Preferably, in the support position, the lower contact support surface 63.2 extends vertically toward the bottom 115 all the way to a lower end 154 that is disposed at a second distance 153.1 from the horizontal center plane 68 of the slot 67 and at a second distance 153.2 from the horizontal center plane 51 of the projection 44.

The outer projection part 97 has an essentially level, vertical wedge support surface 229 that delimits the recess 55; 55.1, 55.2 toward the outside 52 in the transverse direction 118, and extends parallel to or along or in the direction of a vertical axis 148 between the upper delimitation surface 48 and the lower delimitation surface 49 of the projection 44.

The upper head part 74, on a side 236 of the passage 84 or of the wedge accommodation space, which side lies transverse to the longitudinal axis 47 of the vertical scaffolding element 41 or post, in other words in the transverse direction 118 or radially inward, can have an essentially level, upper wedge support surface 225 for the wedge 62, facing radially toward the outside 52 or radially toward the rear in the transverse direction 118, extending at a first inclination angle 170 relative to the vertical axis 148, along a first slanted axis 169, in the direction toward the outside 52 and toward the bottom 115. The lower head part 75, on a side 236 of the passage 84 or of the wedge accommodation space, which side faces in the transverse direction 118 or radially inward, can have an essentially level, lower wedge support surface 231 for the wedge 62, facing in the transverse direction 118 or radially toward the outside 52, extending at a second inclination angle 172 relative to the vertical axis 148, along a second slanted axis 171, in the direction toward the outside 52 and toward the bottom 115. The upper wedge support surface 225 and the lower wedge support surface 231 are configured parallel to one another. The wedge 62 can furthermore have a first wedge face edge 162 that faces in a transverse direction 118 or radially to the outside 52, which has an essentially level vertical contact surface 164 that extends along the vertical axis 148, which surface corresponds to the vertical wedge support surface 229 of the projection 44 in such a manner that the vertical contact surface 164 of the wedge 62 and the vertical wedge support surface 229 of the projection 44 can be displaced relative to one another, parallel to one another and lying against one another with their full area, along the vertical axis 148. The wedge 62 can furthermore have a second wedge face edge 163 that faces away from the first wedge face edge 162, in the transverse direction 118 or radially toward the inside 79, which edge has an essentially level upper contact surface 166 and an essentially level lower contact surface 167 parallel to it. The upper contact surface 166 extends along the first slanted axis 169, toward the bottom 115 and toward the outside 52, and the lower contact surface 169 extends along the second slanted axis 171, toward the bottom 115 and outside 52. The upper contact surface 166 of the second wedge face edge 163 corresponds to the upper wedge support surface 225 of the upper head part 74, in such a manner that the upper contact surface 166 of the wedge 62 and the upper wedge support surface 225 of the upper head part 74 can be displaced relative to one another, parallel to one another and lying against one another with their full area, along the first slanted axis 169. The lower contact surface 167 of the second wedge face edge 163 corresponds to the lower wedge support surface 231 of the lower head part 75, in such a manner that the lower contact surface 167 of the wedge 62 and the lower wedge support surface 231 of the lower head part 75 can be displaced relative to one another, parallel to one another and lying against one another with their full area, along the second slanted axis 171.

Figure 25:
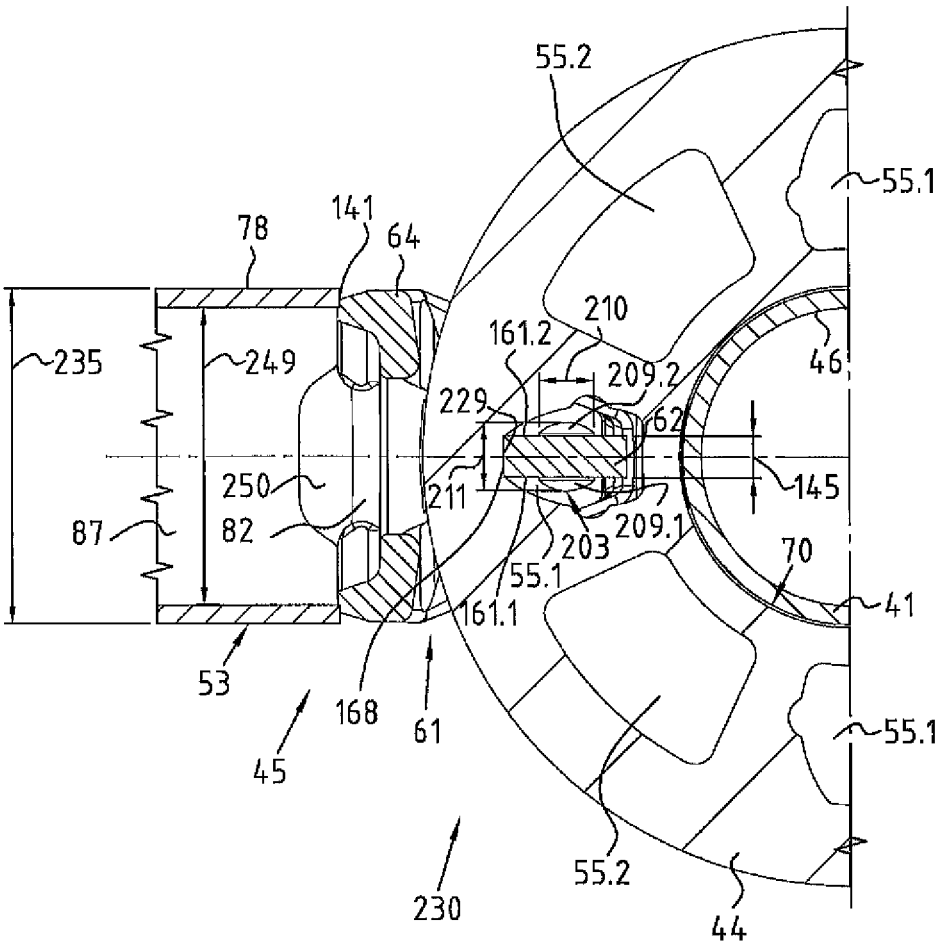
Figure 26:
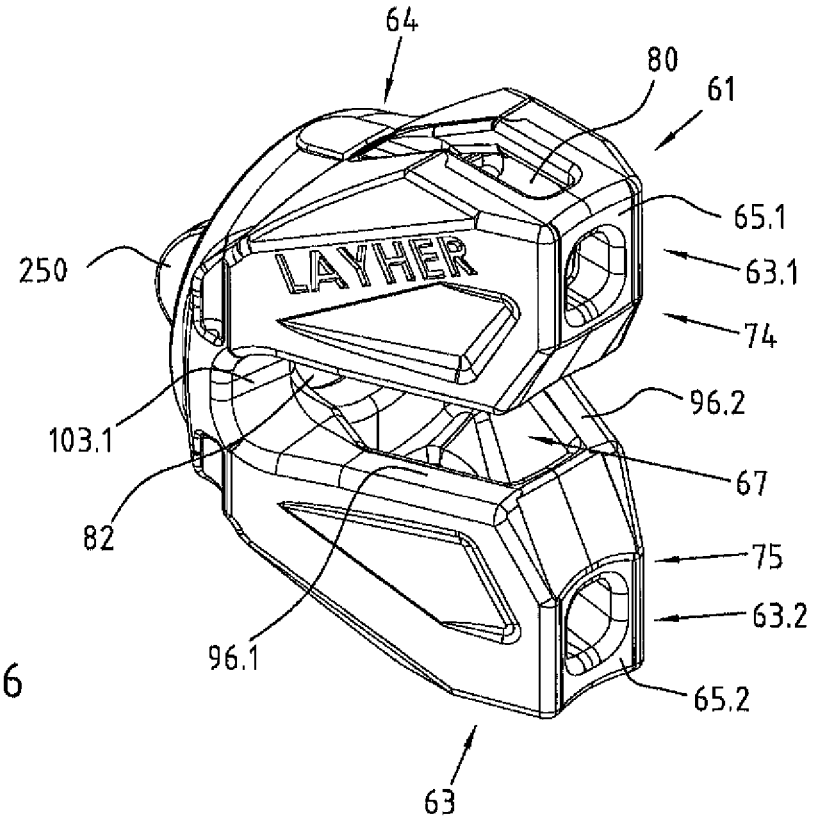
Figure 27:
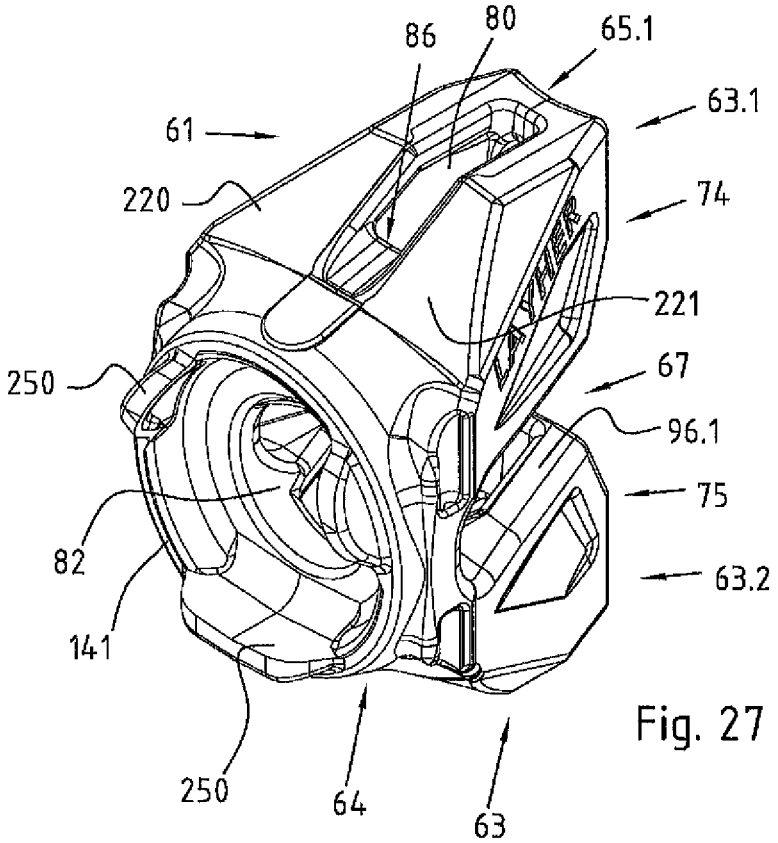

As is particularly evident in FIG. 25, when the wedge 62 is in the locking position 88, the upper head part 74 can already be supported on the outer surface 54.1 of the post 41, which surface extends to above the perforated disk 44, with the upper contact support surface 65.1, and also, the lower head part 75 can be supported on the outer surface 54.2 of the post 41, which surface extends to below the perforated disk 44, with the lower contact support surfaces 65.2. However, it is also easily possible, within the scope of the idea of the invention, that the upper head part 74 is supported on the outer surface 54.1 of the post 41, which surface extends to above the perforated disk 44, with the upper contact support surface 65.1, and also, the lower head part 75 is supported on the outer surface 54.2 of the post 41, which surface extends to below the perforated disk 44, with the lower contact support surfaces 65.2, only once the wedge 62 is in the locking position 88 and when the connection head 61 is braced against the vertical scaffolding element 41, using the wedge 62.

Proceeding from its locking position 88, for example by means of a hammer blow from above onto its drive-in end 181, the wedge 62 can be braced against the perforated disk 44 and the post 41. In this way, displacement of the wedge 62 relative to the perforated disk 44, on the one hand, and a displacement of the wedge 62 relative to the connection head 61, on the other hand, are brought about.

In this connection, the vertical contact surface 168 of the rear or first wedge face edge 162, which lies displaceably, relative to the wedge support surface 229, in the direction 42 of the vertical axis 148, against the corresponding vertical wedge support surface 229, which surface, delimiting the perforation 55; 55.1, 55.2 radially toward the outside, extends parallel to the vertical axis 148 and delimits the outer edge crosspiece 97 of the perforated disk 44 radially toward the front 79 or toward the inside, slides downward in the direction of the vertical axis 148, relative to this wedge support surface 229.

At the same time, the slanted, upper contact surface 166 of the front or second wedge face edge 163, which lies displaceably, in the direction of the first slanted axis 169, against the corresponding, parallel, slanted, inner, upper wedge support surface 225 of the upper wall part 63.1, slides downward relative to the upper wedge support surface 225, in the direction of the first slanted axis 169.

In turn, at the same time, the slanted, lower contact surface 167 of the front or second wedge face edge 163, which lies displaceably, in the direction of the second slanted axis 171, against the corresponding, parallel, slanted, inner, lower wedge support surface 231 of the lower contact wall part 63.2, slides downward relative to the lower wedge support surface 231, in the direction of the second slanted axis 171.

When the wedge 62 is supported on the wedge support surfaces 108 of the wedge support body 85 with its lower wedge end 109, it projects, with a wedge part 190, out of the upper head part 74 of the connection head 61, and then furthermore projects toward the front or beyond the connection head or beyond its front, vertical contact support surfaces 65.1, 65.2 with an upper wedge end 181, as is shown, for example, in FIGS. 9 to 20. As is also evident there, the wedge 62, in the installation position 263, in which it is supported at its lower wedge end 109 on the wedge support surfaces 108 of the wedge support body 85, with its own weight or as the result of gravity, can be pivoted in the imaginary longitudinal center plane of the wedge openings or in the imaginary vertical plane of symmetry 90 of the connection head 61, relative to the connection head 61, specifically into a contact pivot position 261 inclined toward the front. In this contact pivot position 261, the wedge 62 is supported, with its front or second wedge face edge 163, on a wall part 216 of the upper contact wall part 63.1 or of the upper horizontal wall part 213 of the upper head part 74 that delimits the upper wedge opening 80 toward the front 79 or radially inward.

Figure 10:
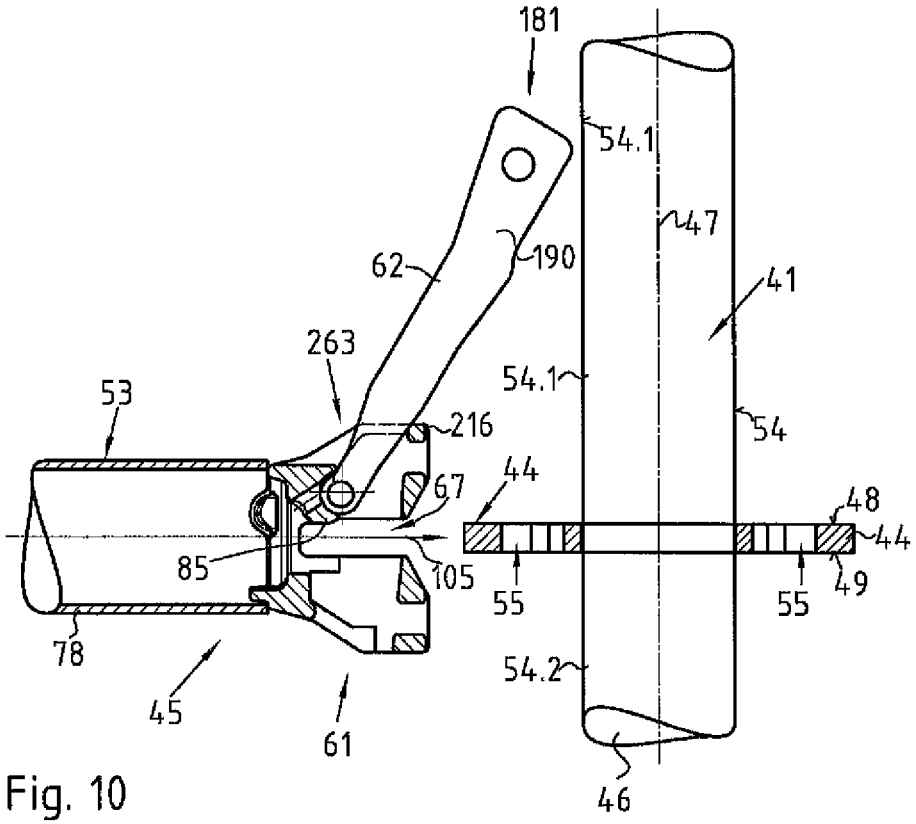
FIG. 10 an arrangement that contains the scaffolding component and a vertical scaffolding element in the form of a scaffolding post provided with a perforated disk, whereby the end region of the scaffolding component according to FIG. 9 is shown in a horizontal starting position, proceeding from which the scaffolding component can be radially mounted onto the perforated disk of the scaffolding post shown with the post section, with its connection head and the latter's slot leading, whereby the wedge does not yet touch the post.

In the following, the method according to the invention will be described in greater detail using an exemplary embodiment particularly shown in FIGS. 1 to 25, based on a scaffolding component or based on a connection head according to the first embodiment, whereby the method according to the invention is carried out or can be carried out accordingly, using a scaffolding component or connection head and a wedge according to the second exemplary embodiment and according to the third exemplary embodiment, which will still be described in greater detail below:

Before the connection head 61, with its slot 67, is mounted all the way onto the perforated disk 44 in an essentially horizontal direction, a radial mounting direction with reference to the post 41 or to its perforated disk 44, the wedge 62 is moved into an installation position 263, which position allows mounting of the connection head 61, with its slot 67, onto the perforated disk 44, in the essentially horizontal mounting direction 105, radially, without blockage by the wedge 62, in which position the wedge 62 is supported on the wedge support surface 108 of the wedge support body 85 with its lower wedge end 109, and in which position the wedge 62 projects, with a wedge part 190, beyond the upper head part 74, toward the top 110, and also toward the front 79 in front of the connection head 61, in other words in front of the upper head part 74 and the lower head part 75 or toward the front 79 in front of the front contact support surfaces 65.1, 65.2 that align vertically with one another. Such a starting situation or starting position is shown in FIG. 10.

Figure 11:
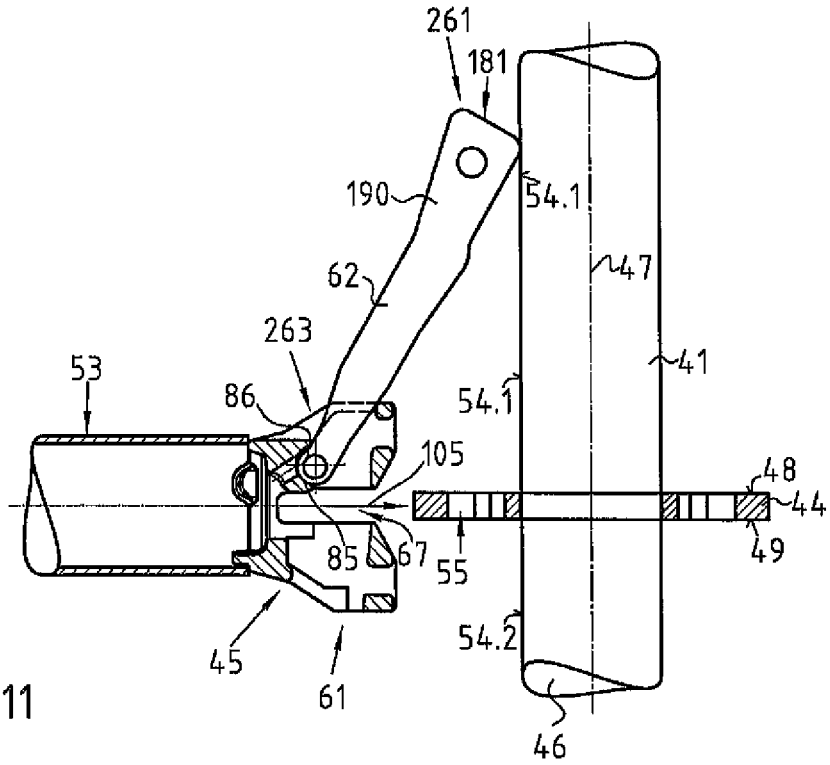
FIG. 11 the arrangement according to FIG. 10 in a later mounting phase, in which the connection head, with its slot, is moved further toward the front, in the horizontal direction, radially in the direction toward the perforated disk or the post, in a position in which the wedge, which is in an impact pivot position, just hits up against the outer surface of the post that extends above the perforated disk with its upper wedge end, in other words just touches it.
Figure 12:
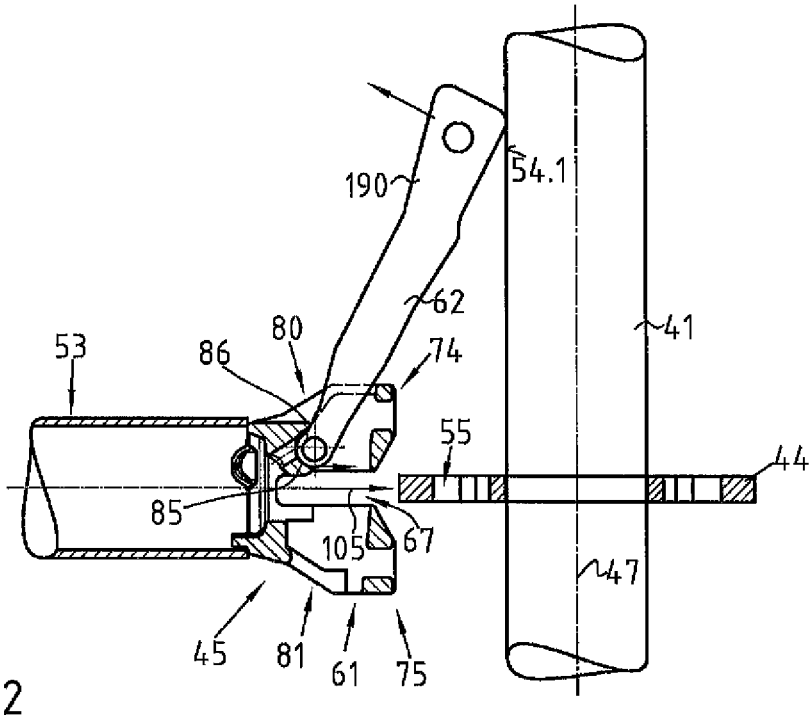
FIGS. 12 to 20 an arrangement, in each instance, of the scaffolding parts according to FIG. 11, whereby the scaffolding component, with its connection head and the latter's slot leading, in each instance, is moved slightly further horizontally in the direction toward the front, as compared with the mounting position shown in the preceding figure, in each instance, radially toward the post, to illustrate the processes that occur in this connection, particularly during pivoting of the wedge on a wedge pivot counter-bearing of the connection head, until just before release of the latter.
Figure 13:
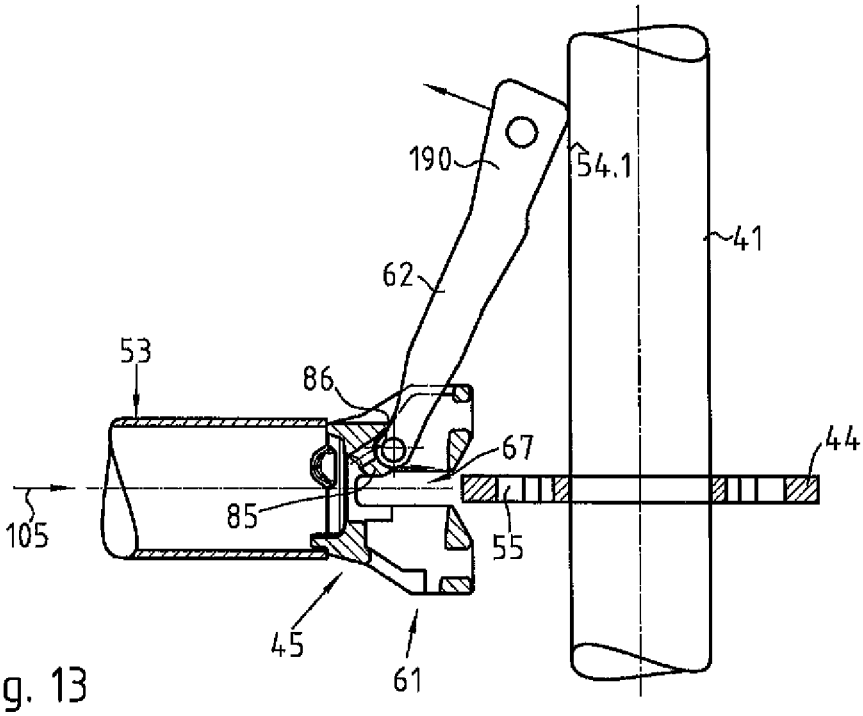
Figure 14:
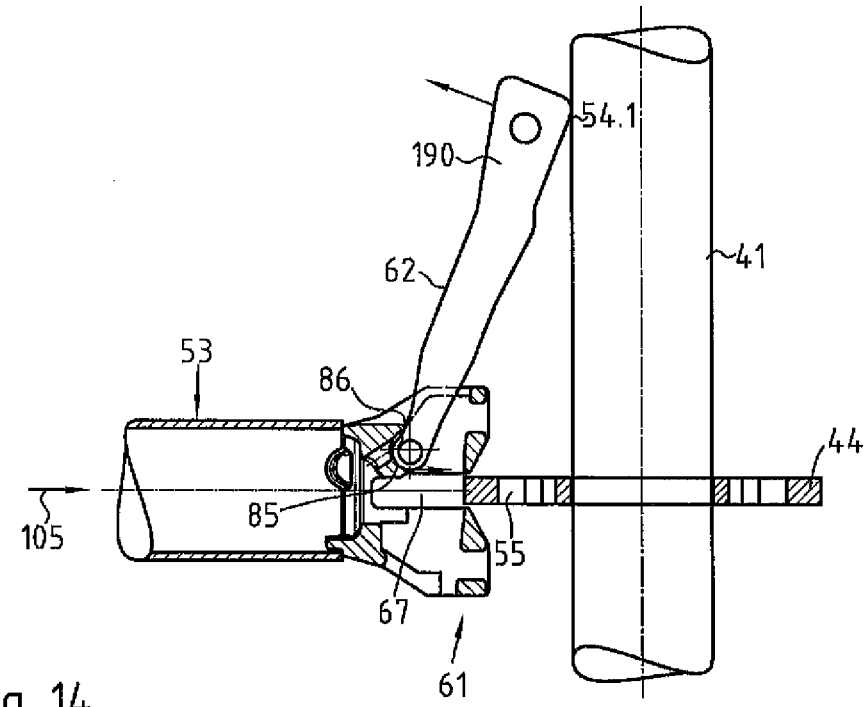
Figure 15:
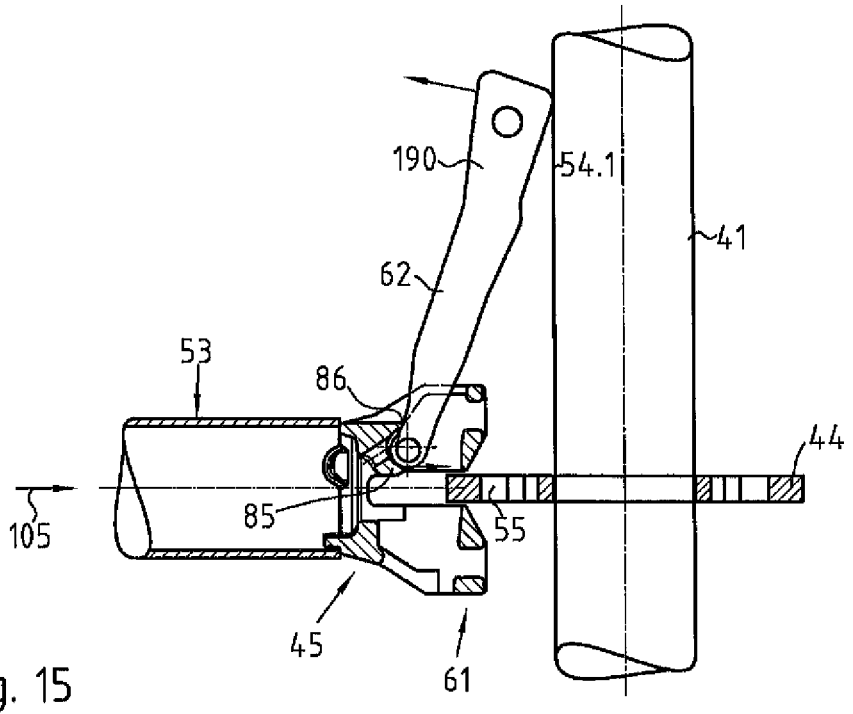

Proceeding from this, the connection head 61, together with the wedge 62, which is in its installation position, is moved, with its slot 67, in an essentially horizontal mounting direction 105, further at about the height of the perforated disk 44, radially toward the perforated disk 44, until the wedge 62 impacts, in an impact pivot position, in the region of its upper wedge end 181, with a wedge face edge, against the outer surface 54.1 of the upper post part 241.1 of the post 41, which surface extends to above or above the perforated disk 44, in an impact pivot position 261, as shown in FIG. 11, for example.

The connection head 61, with its slot 67, is then moved further in an essentially horizontal mounting direction 105, at the height of the perforated disk 44, radially toward the front 79, toward the perforated disk 44, thereby causing the wedge 62, which is vertically supported on the wedge support body 85 with its lower wedge end 109, and, at the same time, lying against the outer surface 54.1 of the post in the region of its upper wedge end 181, to be pivoted toward the rear 52, relative to the connection head 61, with its wedge part 190 that projects upward.

At the same time or shortly after continued movement of the connection head 61, with its slot 67, in an essentially horizontal mounting direction 105, at the height of the perforated disk 44, radially toward the front 79, toward the perforated disk 44 and toward a perforation 55.1 of its perforations 55; 55.1, 55.2, the wedge 62 then lies against the wedge pivot counter-bearing 86, in the region of its lower wedge end 109, with a lower face surface 168.1 of its rear or first wedge face edge 162, about which counter-bearing the wedge 62 is then pivoted relative to the connection head 61, in such a manner that its upper wedge part 190, which projects out toward the top 110 beyond the upper wedge opening 80, is pivoted toward the rear and, at the same time, its lower wedge end 109 is pivoted toward the front 79. This becomes clear from a sequence according to FIGS. 12 to 20, in which the connection head 61, with its slot 67, is continuously moved radially toward the front 79, in an essentially horizontal mounting direction 105, at the height of the perforated disk 44, and toward a perforation 55.1 of its perforations 55; 55.1, 55.2 (FIGS. 12 to 14), and finally pushed radially further onto the perforated disk 44 (FIGS. 15 to 20).

As is also evident from FIGS. 12 to 20, the wedge 62 still continues to remain supported in the installation position or in a functionally equivalent installation position during this continued horizontal movement of the connection head 61 relative to the perforated disk 44, against the wedge support surfaces 108 of the wedge support body 85, at least until a mounting limit position 262 has been reached, starting from which the wedge 62 would automatically move downward into the said perforation 55.1 of the perforated disk 44, as the result of gravity, during continued pushing of the connection head 61 with its slot 67 radially onto the perforated disk 44, in an essentially horizontal mounting direction 105. Such a mounting limit position 262 has been achieved in FIG. 20.

In order to arrive at automatic locking of the connection head 61 into the perforated disk 44, by means of the wedge 62, the connection head 61 is pushed further, radially toward the front 79, onto the perforated disk 44, beyond the mounting limit position 262, and thereby or so that the wedge 62 comes loose from the wedge support surfaces 108 or the front delimitation edge 128 of the wedge support body 85, which edge then functions as a release edge, with its lower wedge end 109 or with the wedge end part 201 that is provided there, as the result of its continued pivoting about the wedge pivot counter-bearing 86, whereupon the wedge 62 automatically moves through the perforation 55.1 of the perforated disk 44 and through the lower wedge opening 81, all the way into a or the locking position 88, with its lower wedge end 109, as the result of gravity. In this locking position 88, the connection head 61 is locked to the perforated disk 44, with shape fit, using the wedge 62, in such a manner that it cannot be removed from the perforated disk 44 in any possible direction, whereby the connection head 61 can be removed from the perforated disk 44 only after unlocking of the wedge 62, by means of a force acting on the wedge 62. In other words, the connection head 61 cannot be removed from the projection 44 in the said locking position 88 of the wedge 62, without prior unlocking of the wedge 62 by means of a force that acts on the wedge 62.

It is understood that the wedge 62, in order to bring it into the initial installation position 263 mentioned above, proceeding from which the method according to the invention can be applied, can be brought into the said initial installation position 263 by an installer 265, for example, manually, by grasping it and moving it by hand, before the connection head 61 or the scaffolding component 45 with its connection head 61 is fastened into a perforated disk 44, using the method according to the invention.

If the scaffolding component 45, as shown in FIGS. 1 to 4, is a comparatively long rod element, particularly a longitudinal bar 45, which is supposed to be installed by the installer 265 from a position 266 secured to prevent him from falling down, for example as a leading railing 267, the installer 265, from the secured position 266 standing on a scaffolding deck 269 of a scaffolding field 270.1 that has already been secured with a railing 268, would have to move the wedge 62 into its installation position 263 manually, by means of grasping and moving it with one hand, and would subsequently have to guide the scaffolding bar 45, while holding the scaffolding bar 45 in his hands, with the connection head 61 in question leading, in the direction of a perforated disk 44 of the post 41 of an adjacent scaffolding field, all the way to this perforated disk 44, which is situated at a horizontal distance from the installer that is greater than the maximal reach or arm length of the installer 265 who is staying in the secured position 266. Because of the required change of hands or grasp required while the scaffolding bar 45 is manually set forward, greater vibrations can occur, thereby making it possible that the wedge 62 might fall downward from its installation position 263, as the result of gravity, crossing the slot 67, so that then, the slot 67 would be blocked for mounting onto the perforated disk 44.

Figure 7:
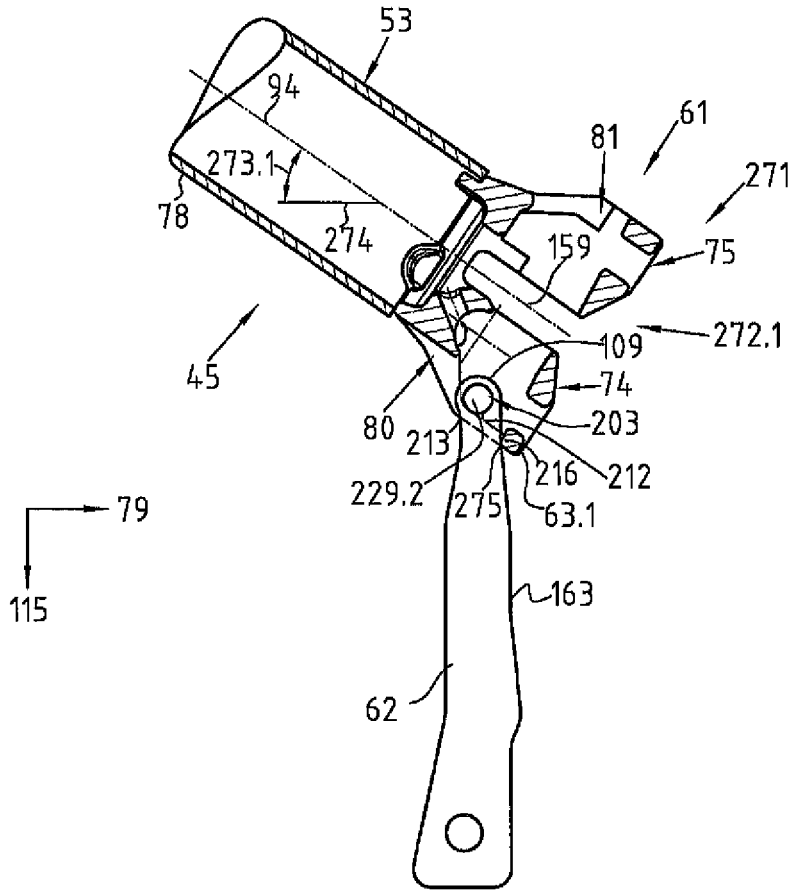
FIG. 7 the end region of the scaffolding component according to FIG. 5 or FIG. 6 at a later installation preparation time point, in a corresponding inclination position, but now in an installation preparation position in which the wedge has fallen downward into a transition position, as the result of gravity, in which position it hangs vertically downward, secured to prevent it from falling out, by way of a retainer affixed to its lower wedge end, here situated in an upper position.

In order to prevent this, an alternative method can be used, according to the invention, by means of which the wedge 62 can be moved into its initial installation position 263 without having to be grasped by hand or being grasped by hand, specifically at a point in time when the installer 265 can already have moved the scaffolding component, here the scaffolding bar 45, with its connection head 61, in the direction toward the front 79, in the vicinity of the specific perforated disk 44 onto which the connection head 61 to be fastened, automatically locking by means of the wedge 62. Starting from this position, the installer 265 can then, holding the scaffolding component 45 in his hands, bring the scaffolding component 45 into an essentially horizontal position at the height of the perforated disk 44 in question, essentially without vibrations, proceeding from which position he can move the scaffolding component 45 with its connection head 61, with its slot 67, essentially horizontally 105 and radially in the direction toward the said perforated disk 44. This alternative method is described below:

In this connection, one can advantageously proceed from a starting position 271 of the connection head 61 or of the scaffolding component 45 with its connection head 61, in which the scaffolding component 45 with its connection head 61 is inclined in an inclination position 272.1, toward the front 79 and bottom 115, and at a corresponding inclination angle 273.1 relative to the horizontal 274, and in which the wedge 62, held by way of the retainer 203 provided in the region of its lower wedge end 109, supported on inner support surfaces 212 of the upper head part 74, hangs downward as the result of gravity or because of its inherent weight, and in which the wedge 62 is supported, with its front wedge face edge 163, on a rear edge 275 of the upper contact wall part 63.1 or of the upper wall part 213 of the upper head part 74, which faces downward in this position, which edge delimits the upper wedge opening 80, for example as shown in FIG. 7.

Figure 5:
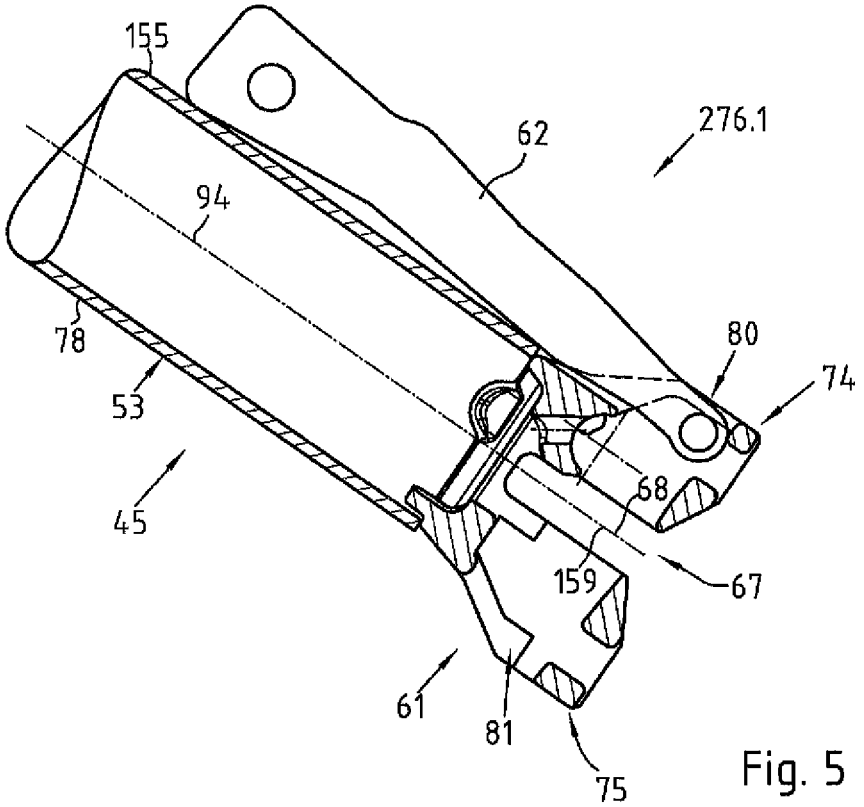
FIG. 5 an end region of a scaffolding component according to the invention, in longitudinal section, in one of multiple possible installation starting positions, in which the scaffolding component, with its connection head, is inclined toward the front and toward the bottom, in an inclination position, whereby the connection wedge, which has been pulled upward, is laid, pivoted toward the rear, onto an upper outer surface of a tube part of the scaffolding component.
Figure 6:
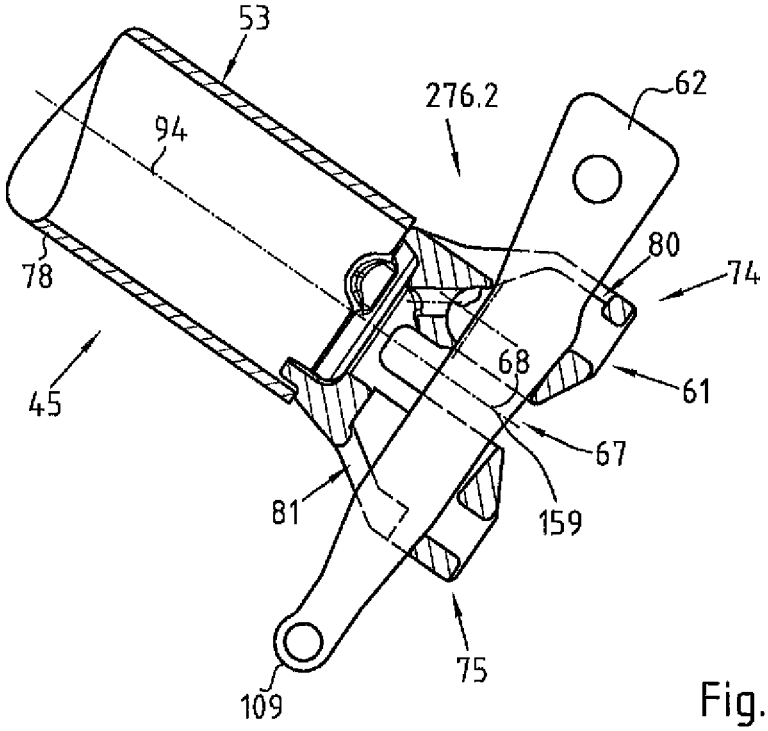
FIG. 6 the end region of the scaffolding component according to FIG. 5, in an alternative installation starting position, in which the scaffolding component is once again inclined toward the front and bottom in an inclination position, with the connection head, in which now, however, the connection wedge is loosely inserted through the upper and the lower wedge opening of the connection head, so that it is not jammed there, or is at most insignificantly jammed.

Before this starting position 271 is reached, one can proceed, for example, from a preparation position 276.1 of the connection head 61 or of the scaffolding component 45 with its connection head 61, in which the wedge 62 is folded in, in the direction onto or on top of the outer surface 155 of the round tube 78 of the scaffolding bar 45, as shown in FIG. 5, for example, or from an alternative preparation position 276.2, in which the wedge 62 is loosely inserted through the upper and through the lower wedge opening 80, 81, as shown in FIG. 6, for example.

In particular proceeding from one of these alternative preparation positions 276.1, 276.2, the scaffolding component 45 or, here, the scaffolding bar 45 can be rotated about a longitudinal axis 159 in the form of an intersection line 159, at which the horizontal center plane 68 of the slot 67 and the vertical plane, preferably the vertical center plane, particularly the vertical plane of symmetry 90, of the connection head 61 intersect and/or about a longitudinal axis 94 of the rod element 78 axis or of the scaffolding component 45, which preferably runs parallel to the horizontal center plane 68 of the slot 67 about an angle of up to about 180 degrees, so that consequently, the wedge 62 then hangs downward, as the result of gravity, held by way of the retainer 203 provided in the region of the lower wedge end 109, supported on inner support surfaces 225 of the upper head part 74. In this manner, one can therefore also arrive at the starting position 271 of the scaffolding component 45 or, here, of the scaffolding bar 45, that has already been mentioned.

Figure 8:
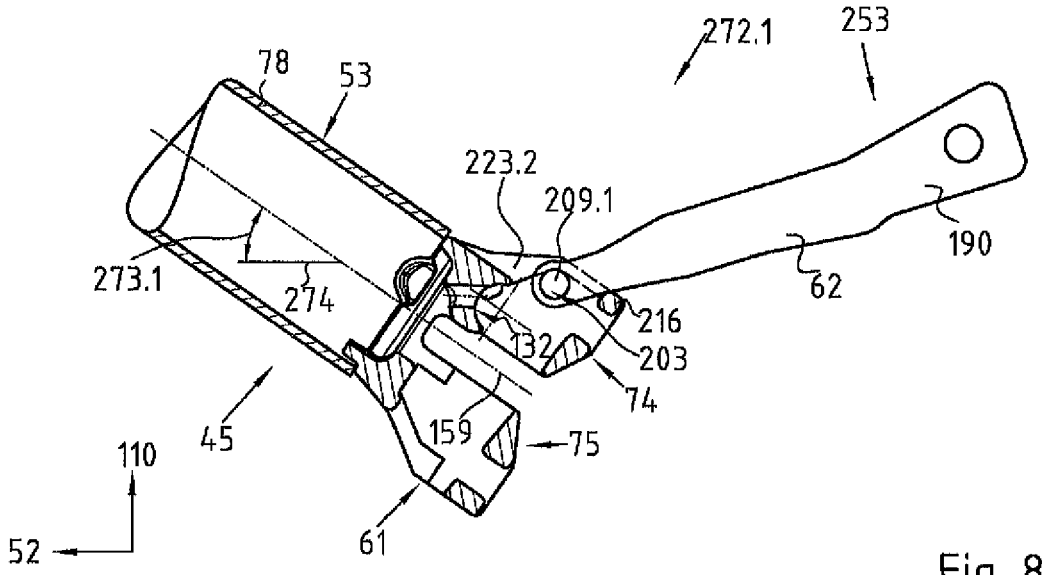
FIG. 8 the end region of the scaffolding component according to FIG. 7 at a later installation preparation time point, in a corresponding inclination position, but now in an installation preparation position rotated back or further, about the longitudinal axis of the scaffolding component, by about 180 degrees, in which position the wedge is in an upper pivot position in which it projects beyond the connection head, or in front of the connection head, toward the front, or beyond its front contact support surfaces with its upper wedge end.

Proceeding from such a starting position 271, the scaffolding component 45 can then be rotated, while maintaining a corresponding inclination position 272.1 or a corresponding inclination angle 273.1, about the longitudinal axis 159 of the connection head and/or about the longitudinal axis 94 of the scaffolding component 45, by an angle of about 180 degrees, back or further, so that as a result, the wedge 62 moves into an upper pivot position 253 in which its upper wedge part 190 projects, toward the top 110, beyond, and toward the front 79, in front of or beyond the upper head part 74, as shown in FIG. 8, for example.

Figure 9:
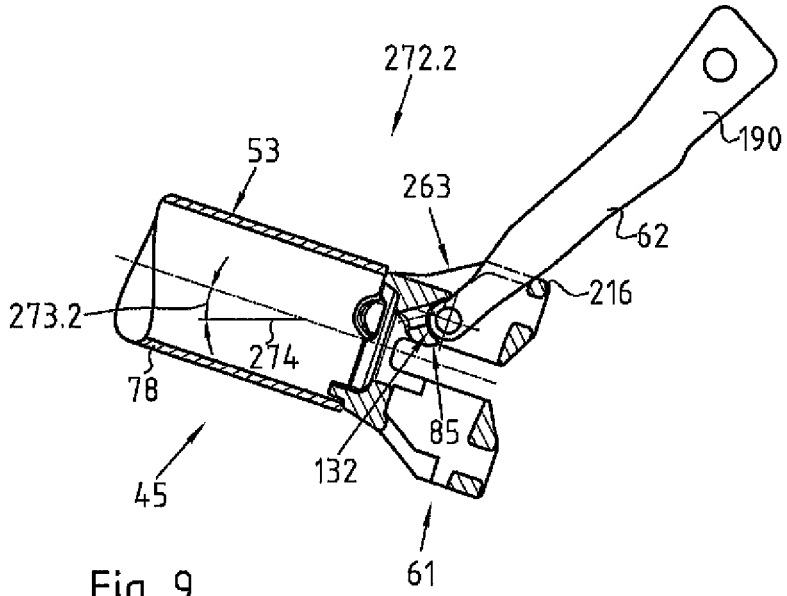
FIG. 9 the end region of the scaffolding component according to FIG. 8 at a later installation preparation time point, in an essentially horizontal inclination position, in which the inclination angle is therefore reduced, relative to the inclination position shown in the previous figures, and in which position the wedge has already moved downward, as the result of gravity, all the way to contact of its lower wedge end with wedge support surfaces of a wedge support body, whereby the wedge, which is vertically supported there, projects in front of the connection head, toward the front, or beyond its front contact support surfaces, with its wedge part that projects upward beyond the upper head part.

Subsequently, the scaffolding component 45, with its connection head 61, is pivoted out of the said inclination angle 272.1, into a less greatly inclined inclination position 272.2, at an inclination angle 273.2 reduced to be equal to or less than twelve degrees, or, if necessary, at least to approximately the horizontal 274, thereby causing the wedge 62 to move, as the result of gravity or as the result of its inherent weight, from its upper pivot position 253 (see FIG. 8) downward into an installation position 263 in which it is supported on the wedge support surfaces 108 of the wedge support body 85 (FIG. 9).

During the movement of the wedge 62 from its upper pivot position 253 (FIG. 8) toward the rear 52 and bottom 115 into the installation position (FIG. 9), the wedge 62 is guided, by way of the retainer 203 provided in the region of its lower wedge end 109, here by way of at least one rivet head 209.1, 209.2 of the rivet heads 209.1, 209.2 of the rivet 203, lying against the wedge guide edge 223.1, 223.2 that has already been mentioned above, or against the wedge guide edges 223.1, 223.2 that have already been mentioned above, tangentially downward all the way into the accommodation pocket 132.

Subsequently, the connection head 61, with its slot 67 leading, is moved toward the perforated disk 44, at the height of the perforated disk 44, radially toward the front 79, in an essentially horizontal direction 105, until the wedge 62 impacts against the outer surface 54.1 of the post 41 in the region of its lower wedge end 181, as is evident from a comparison of FIGS. 10 and 11. The further course of the method according to the invention has already been described above, so that reference can be made to these explanations.

If the scaffolding component 45, here the scaffolding bar 45, as shown in FIGS. 1 to 4, has a connection head 61, 61, in each instance, at its ends 56.1, 56.2 that face away from one another, fastening of the scaffolding component 45 onto the perforated disks 44, 44 of two adjacent posts 41, 41 can be carried out as follows:

An installer 265, who is standing on a scaffolding deck 269 of this scaffolding field 270.1, in a position 266 secured to prevent him from falling down, by means of a scaffolding bar 45 that functions as a back or hip railing 268, holding the scaffolding bar 45 in his hands, as has already been described above, can fasten the scaffolding bar 45, with the front connection head 61, which faces away from the installer 265 toward the front 79, using the method according to the invention, onto the related perforated disk 44 of the post 41 set up at a distance from the installer 265, so that the said front connection head 61 is automatically locked in place there by means of its wedge 62, whereupon this wedge 62 is in its locking position 88, in which the front connection head 61 is locked, with shape fit, onto the perforated disk 44 of the said post 41. In this locking position 88, the wedge 62 is at first only inserted loosely through the upper and through the lower wedge opening 80, 81, as the result of its inherent weight, in other words is not yet braced against this perforated disk 44 or against this post 41. As a result of this, and as a result of the shape or form of the aperture 55.1 of the perforated disk 44, through which the wedge 62 is inserted in its locking position 88, the scaffolding bar 45 locked in place at this front end 56.1 can still be pivoted slightly to the side, in a horizontal plane that essentially runs parallel to the center plane 68 of the perforated disk 44 or contains this center plane 68, with its other or rear end 56.2 or with its other connection head 61. For this reason, the installer 265 can not only mount the scaffolding bar 45 in question, as shown in FIG. 1, already from the side of the post 41 situated in his vicinity, essentially radially onto the remote perforated disk 44, but also, the installer 265, after having fastened the front connection head 61 onto this remove perforated disk 44, according to the invention, can pivot the scaffolding bar 45, if this has not already been done, toward the bottom 115 into the horizontal 274, from where the installer 265 can mount the scaffolding bar 45, with its other connection head 61, with its slot 67, laterally or tangentially onto the other perforated disk 44, which is situated in his vicinity. For this purpose, the wedge 62 of this other connection head 61 must first have been pivoted toward the rear in the direction toward the outer surface 155 of the rod element 53 or round tube 78, so that this wedge 62, during lateral or tangential pivoting of this connection head 61 inward toward the assigned perforated disk 44, does not collide with the post 41 onto which this perforated disk 44 is fastened.

Figure 3:
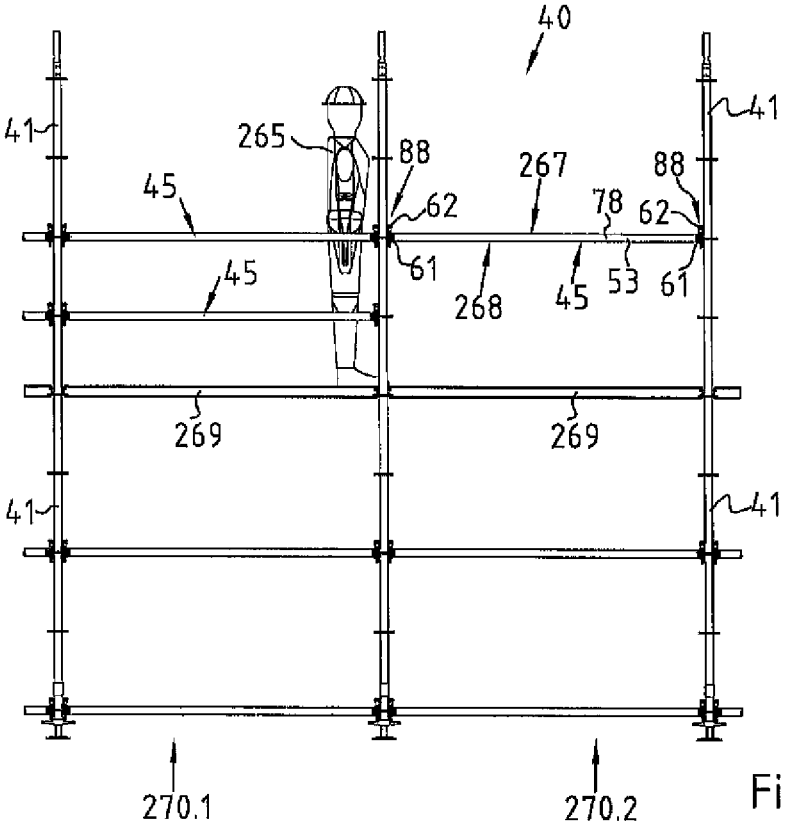
FIG. 3 the scaffolding section according to FIG. 1 in yet a later construction phase, as compared with the construction situation in FIG. 2, in which phase the pre-assembled scaffolding bar is installed as a leading hip or back railing.

When the said other connection head 61, with its slot 67, has been laterally or tangentially pushed onto the assigned perforated disk 44, a fastening situation has been achieved as shown in FIG. 2. Then, the installer 265 can grasp the wedge of the said other connection head 61 by hand, as shown, and then pivot the wedge 62 up, toward the top, by hand, all the way into a vertical pivot position in which the wedge 62, after being let go, moves downward through the assigned perforation 55.1 of this other perforated disk 44 all the way into and through the lower wedge opening of this other connection head 61, as the result of gravity or as the result of its inherent weight, or, if applicable, after a hammer blow, also into a locking position 88. Then, the installer 265 can wedge this wedge 62 in place by means of a hammer blow, from above, onto its drive-in end 181, in other words brace it against the related perforated disk 44 and against the related post 41. This can, however, also take place only at a later point in time, if necessary. This fastening situation, in which the scaffolding bar 45 pre-assembled according to the invention or mounted as a leading railing 267 is locked, with shape fit, into the related perforated disk 44, 49, with each of its two connection heads 61, 61, by means of the wedge 62, 62 that is in its locking position 88, 88, in each instance, is shown in FIG. 3. When the scaffolding bar 45 is locked, with shape fit, to the perforated disk 44, 44, in each instance, in this manner, with its two connection heads 61, 61, at least in the manner described above, the scaffolding bar 45 has already been secured so well that it offers the installer 265 sufficiently good security to prevent him from falling down to the side.

For this reason, the installer 265 can subsequently, as illustrated as an example in FIG. 4, now step onto the adjacent scaffolding deck 269 of the adjacent scaffolding field 170.2, which is secured to prevent him from falling down to the side by means of the pre-assembled scaffolding bar 45, mounted as a leading hip or back railing 268, and from there can wedge the wedge 62 of the front connection head 61 in place, and, if this has not already been done, can also wedge the wedge 62 of the other connection head 61 in place, by means of a hammer blow, so that in this manner, both connection heads 61, 61 are braced against the related perforated disk, 44, 44, in each instance, and against the related post 41, 41, in each instance, by means of the wedge 62, 62, in each instance.

Figure 4:
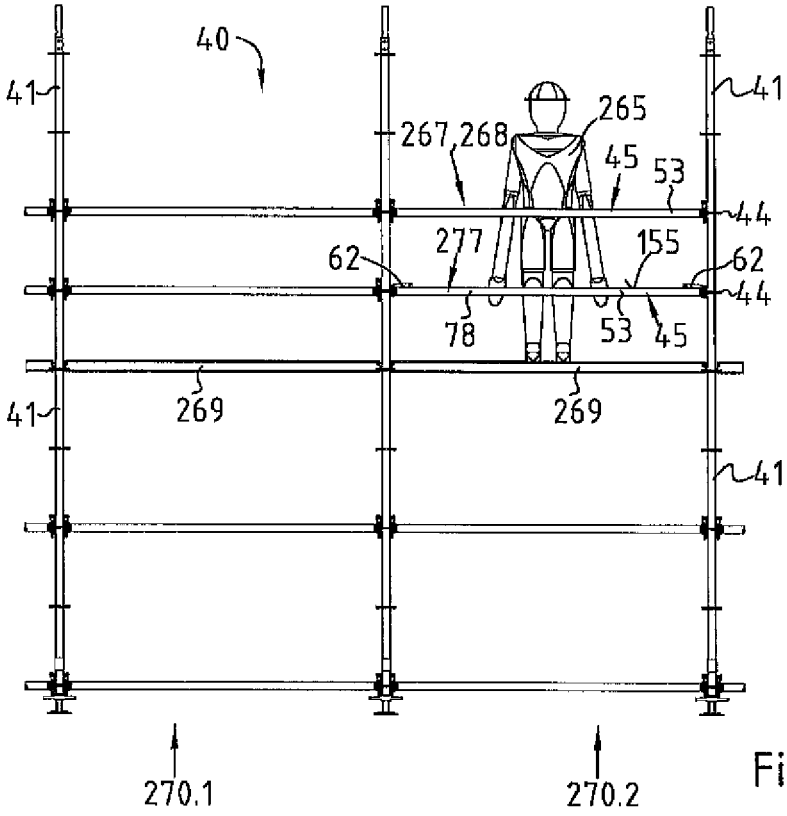
FIG. 4 the scaffolding section according to FIG. 1 in yet a later construction phase, as compared with the construction situation in FIG. 3, in which phase the installer is now secured to prevent him from falling down, by the leading railing that has already been installed, and, while standing on a scaffolding deck assigned to this railing, installs a further scaffolding bar, with its connection heads, as a knee rail, onto assigned perforated disks of adjacent scaffolding posts disposed at a horizontal distance from one another.

Subsequently, as is also illustrated in FIG. 4, the installer 265 can fasten a further scaffolding bar 45 as a knee rail 277, below the previously pre-assembled or leadingly mounted scaffolding bar 45 that functions as a hip or back railing 268, onto the perforated disks 44, 44 disposed there, at about half height, above the scaffolding deck 269 of the scaffolding field 270.2. For this purpose, the installer 265, standing on the scaffolding deck 269 of this scaffolding field 270.2, can mount this further scaffolding bar 45, laterally or tangentially, in each instance, onto the related perforated disk 44, 44, in each instance, with its two connection heads 61, 61. For this purpose, as is also shown in FIG. 4, the wedges 62, 62 of these two connection heads 61, 61 must first have been pivoted toward the rear, in the direction toward the outer surface of the rod element or round tube 78 of this scaffolding bar 45, so that during lateral or tangential pushing on of this scaffolding bar 45, no collision of these wedges 62, 62 with the related posts 41, 41 occurs. After lateral or tangential pushing on of this scaffolding bar 45, with its connection heads 61, 61, onto the related perforated disks 44, 44, the installer 265 can manually pivot the wedges 62, 62 of these connection heads 61, 61 up, and then let them go, so that the wedges 62, 62 then move into their locking position 88, 88, in each instance, as the result of gravity or, if necessary, after a hammer blow from above onto the drive-in end 181. Subsequently, the installer 265 can wedge these wedges 62, 62 in place, so that the scaffolding bar 45, then installed as a knee rail 277, is braced against the related perforated disks 44, 44 and the related posts 41, 41.

In FIGS. 37 to 51, a second exemplary embodiment of an arrangement 530 according to the invention or of a scaffolding element 345 according to the invention or of a connection head 361 according to the invention, with a related wedge 362, is shown. This arrangement 530 differs from the arrangement 230 shown in FIGS. 21 to 25 exclusively in the configuration of the connection head and of the wedge. Corresponding changed elements, parts, and dimensions are provided with a reference symbol increased by the number 300 in FIGS. 37 to 51, while elements, parts, and dimensions that are the same are provided with the same reference symbol. Accordingly, in the second exemplary embodiment, the connection head is provided with the reference symbol 361, and the wedge is provided with the reference symbol 362, for example.

In the arrangement 530 according to the second exemplary embodiment, the scaffolding element or the scaffolding post 41, with its at least one projection or its at least one perforated disk 44, as well as the scaffolding tube or rod element 53, are structured and configured in the same way as in the arrangement 230 according to the first exemplary embodiment. It is understood, however, that these elements or components can also be structured and/or configured differently, within the scope of the invention, individually or in combination.

Figure 16:
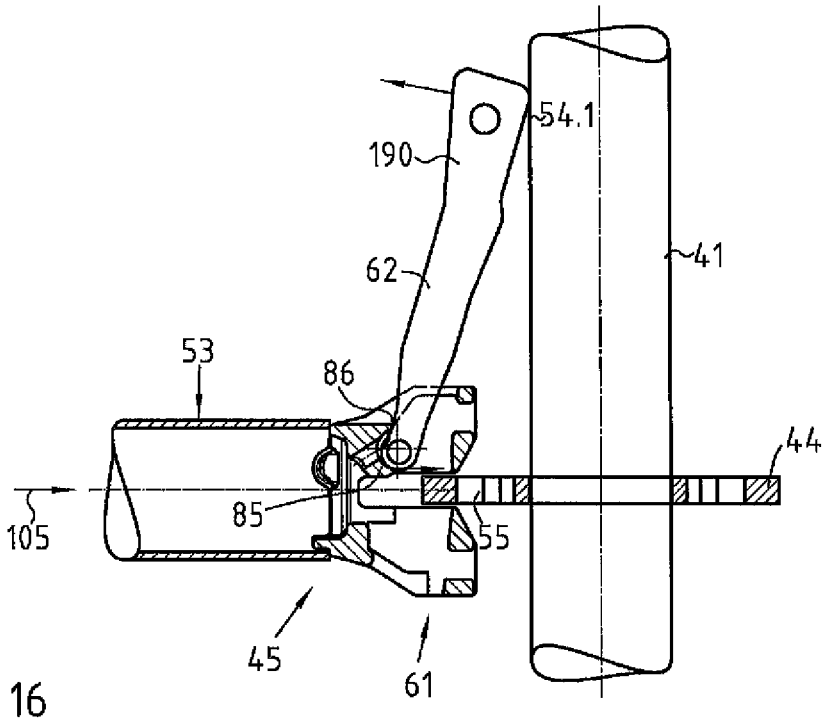
Figure 17:
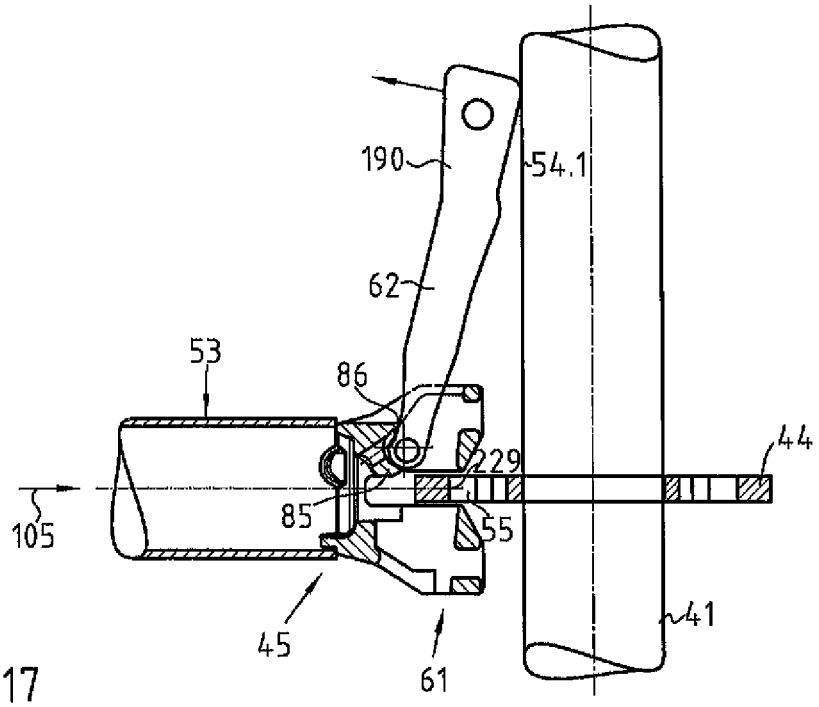

In the following, the connection head 361, with a matching wedge 362, according to the second exemplary embodiment, will be discussed, with their differences in comparison with the connection head 61 shown in FIGS. 3 to 15, and the matching wedge 62, shown separately in FIG. 16, according to the first exemplary embodiment:

In the case of the connection head 361 according to the second exemplary embodiment, shown in FIGS. 37 to 50, the upper head part 374, on an inner side 383, in the transverse direction 118, of the passage 384, has an essentially level upper wedge support surface 525 for the wedge 362, which surface faces toward the outside 52 in the transverse direction 118 and extends parallel to the vertical axis 148 of the vertical scaffolding element 41. The lower head part 375, on an inner side 383, in the transverse direction 118, of the passage 384, has an essentially level lower wedge support surface 531 for the wedge 362, which surface faces toward the outside 52 in the transverse direction 118 and extends parallel to the vertical axis 148. The upper wedge support surface 525 and the lower wedge support surface 531 are configured to be parallel to one another and without lateral offset from one another or to align with one another.

Figure 51:
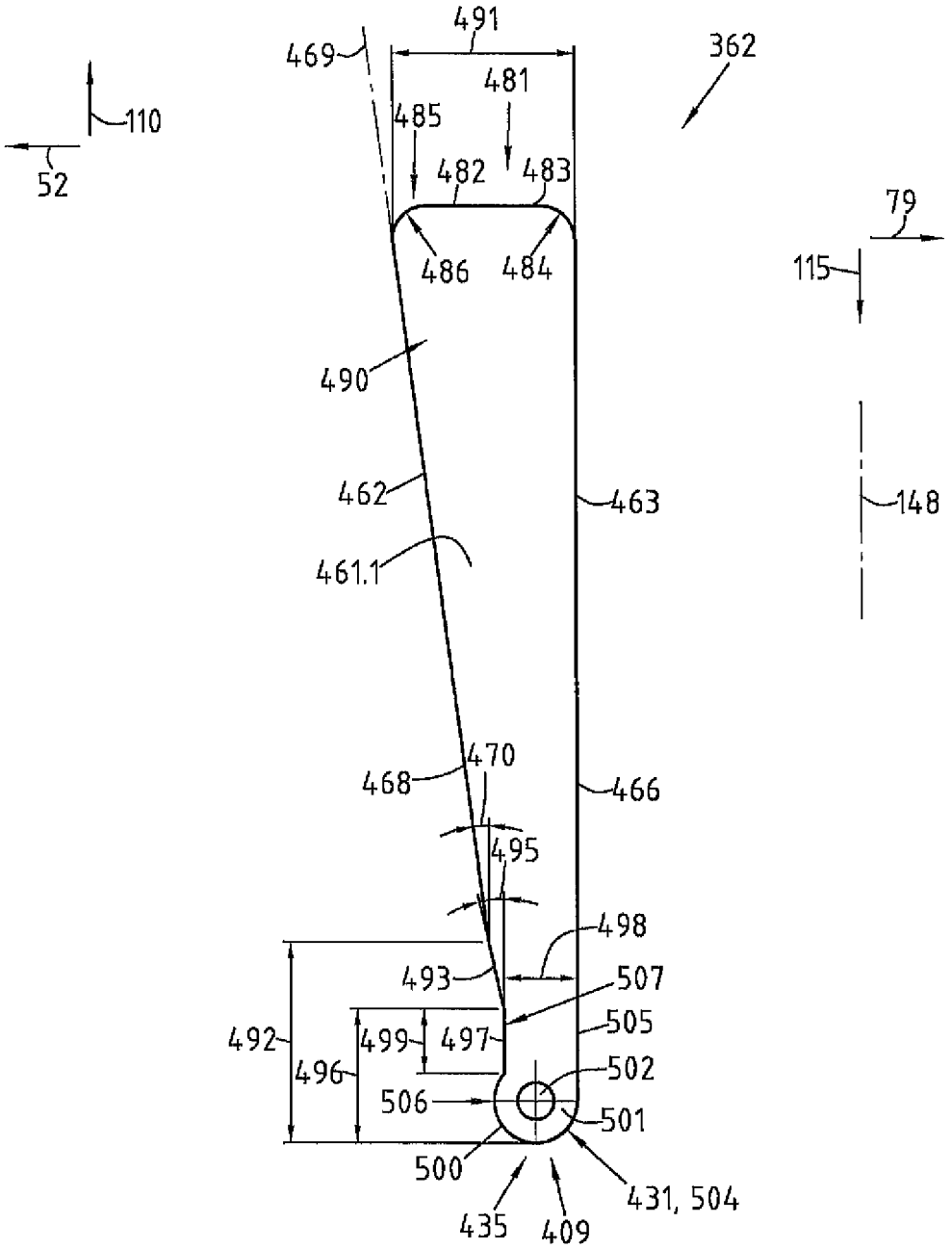
FIG. 51 a side view of the wedge according to the invention.
Figure 52:
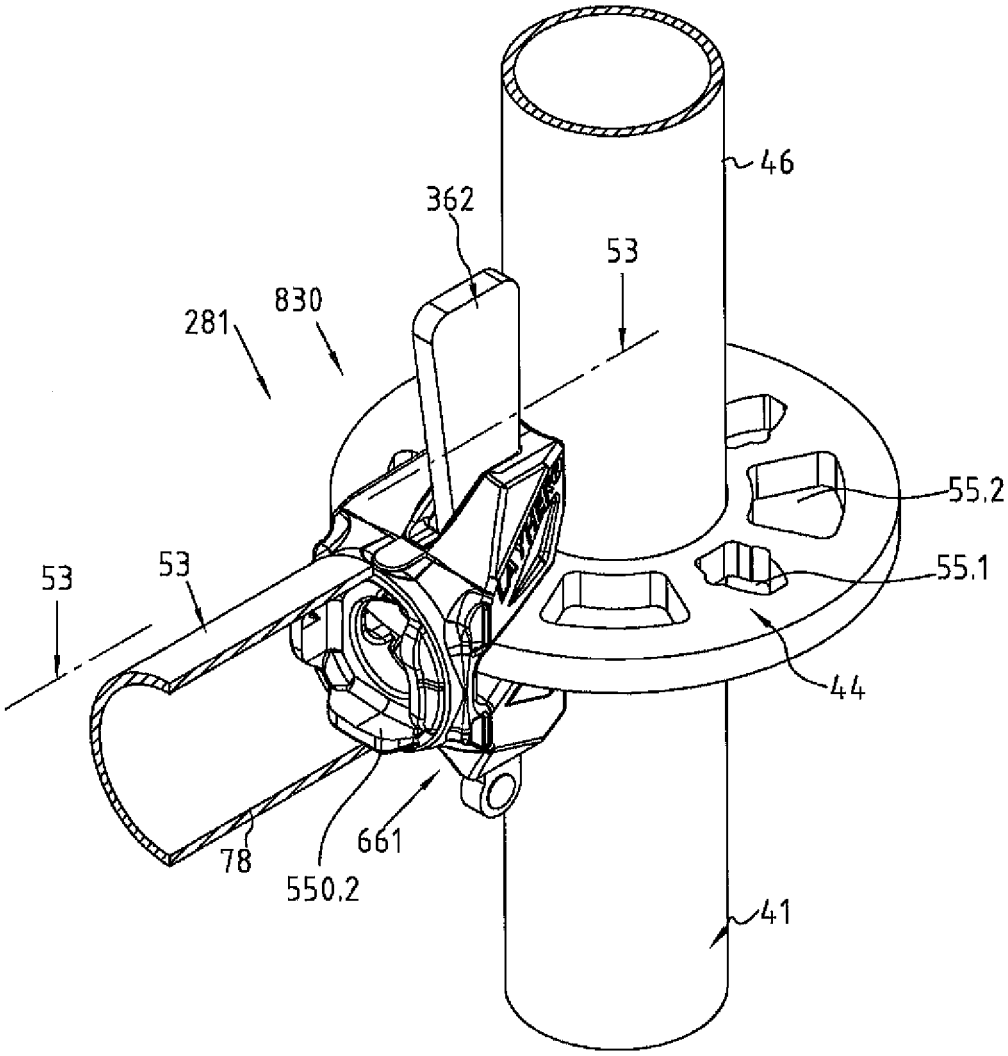
FIGS. 52 to 65 a third exemplary embodiment of a connection node according to the invention or of an arrangement according to the invention or of a connection head according to the invention, with a wedge according to the invention according to FIG. 51.
Figure 53:
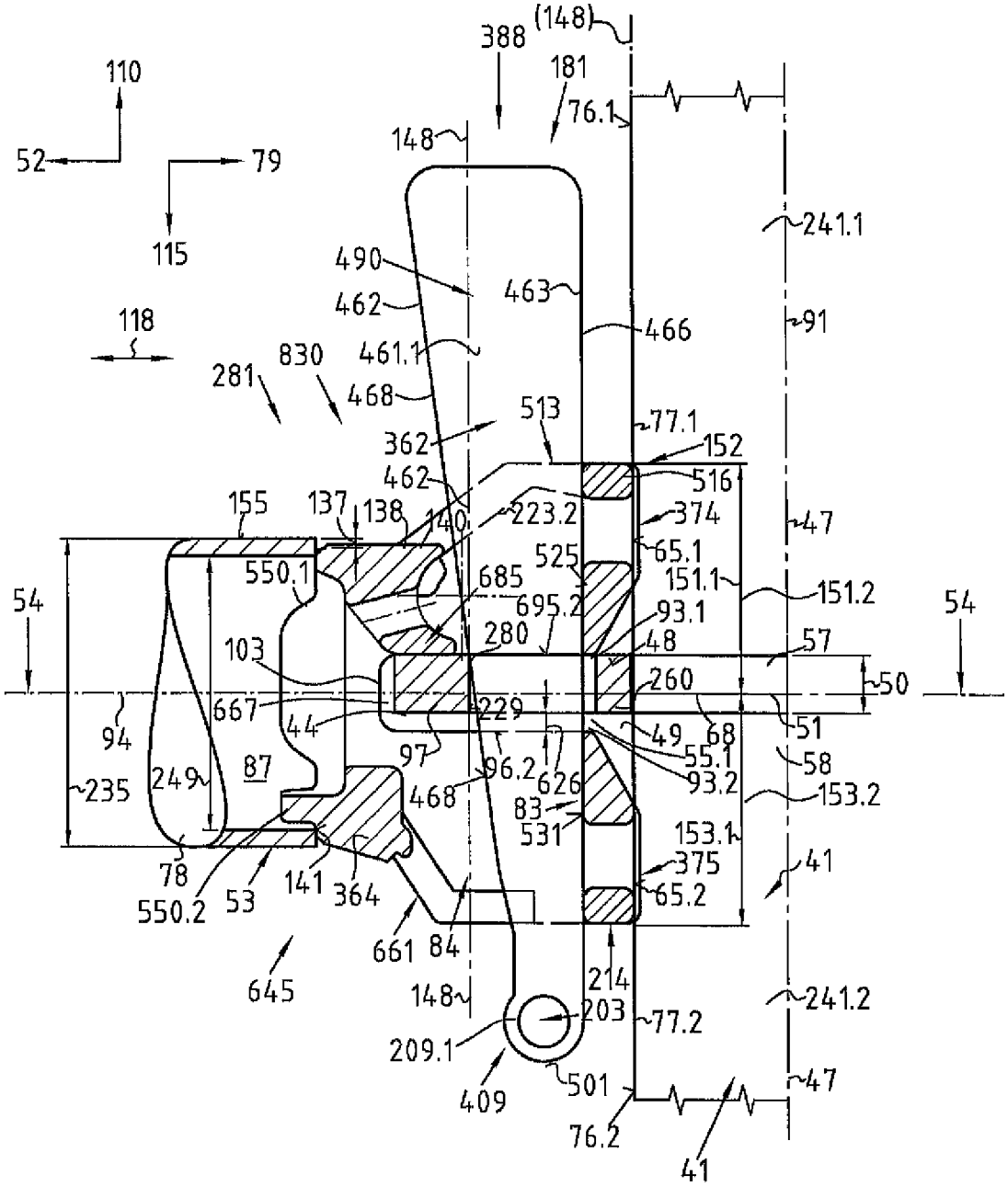
Figure 54:
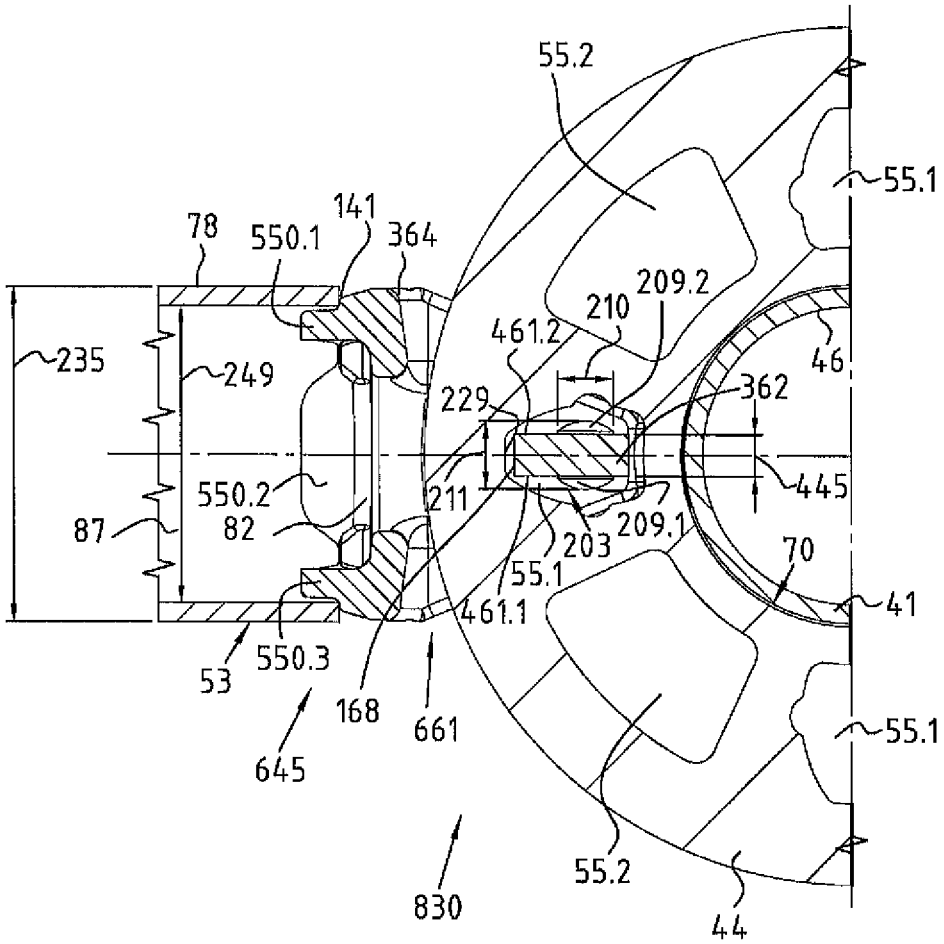
Figure 55:
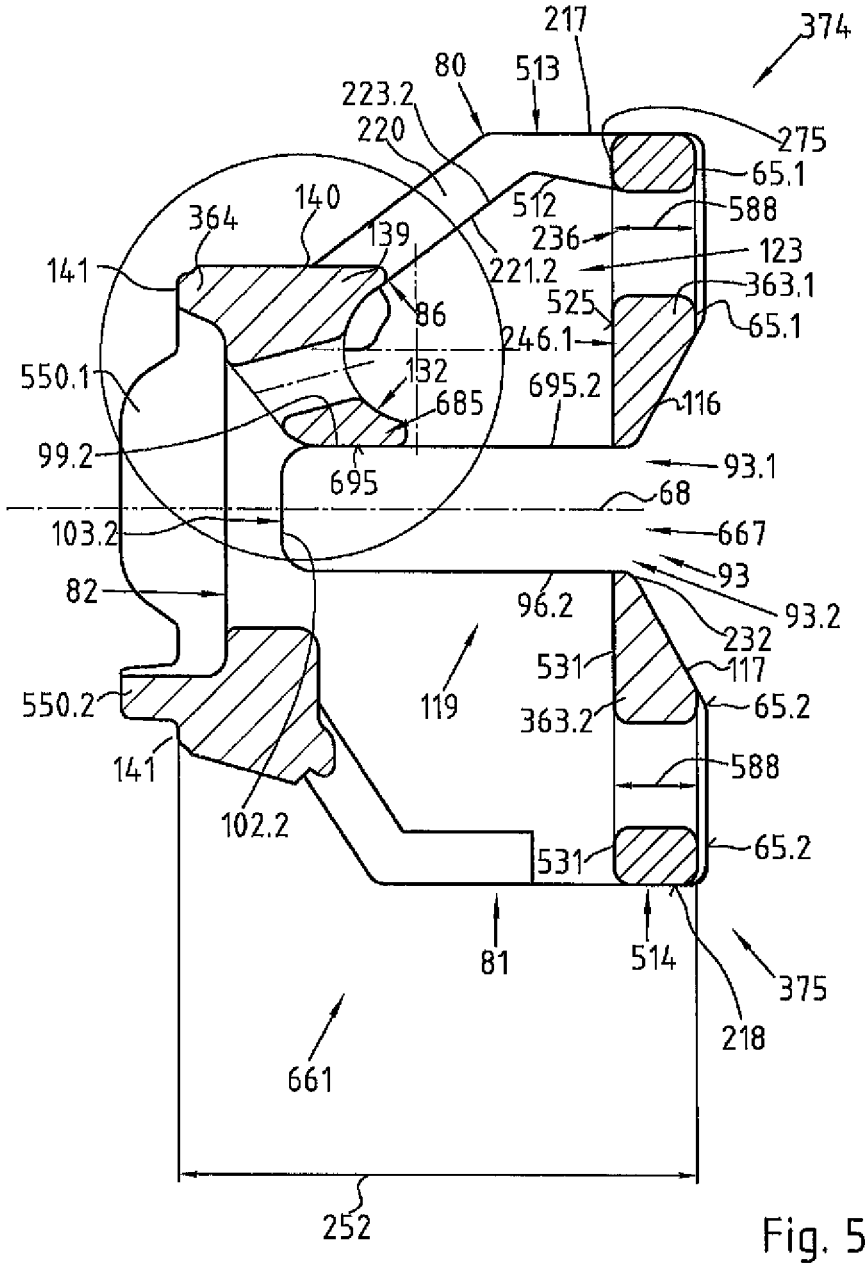
Figure 56:
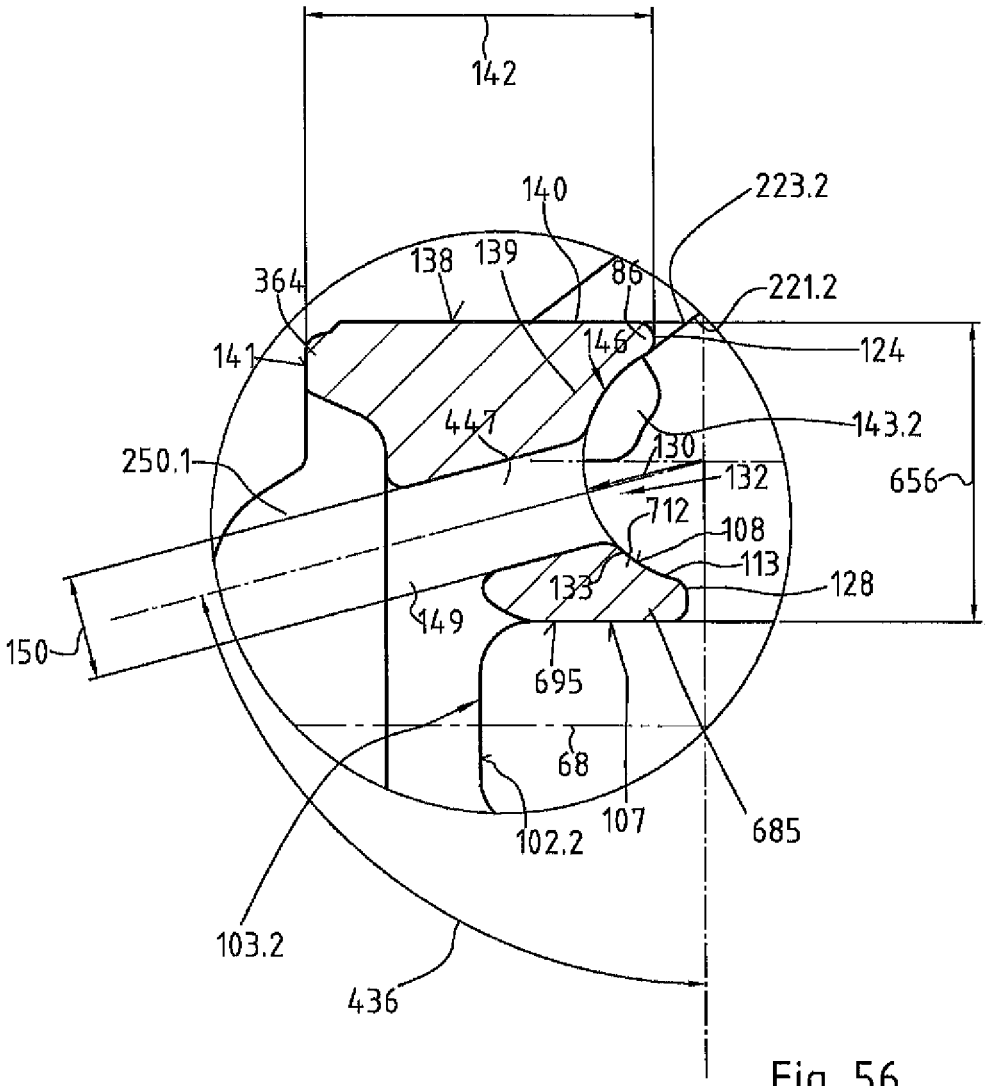
Figure 57:
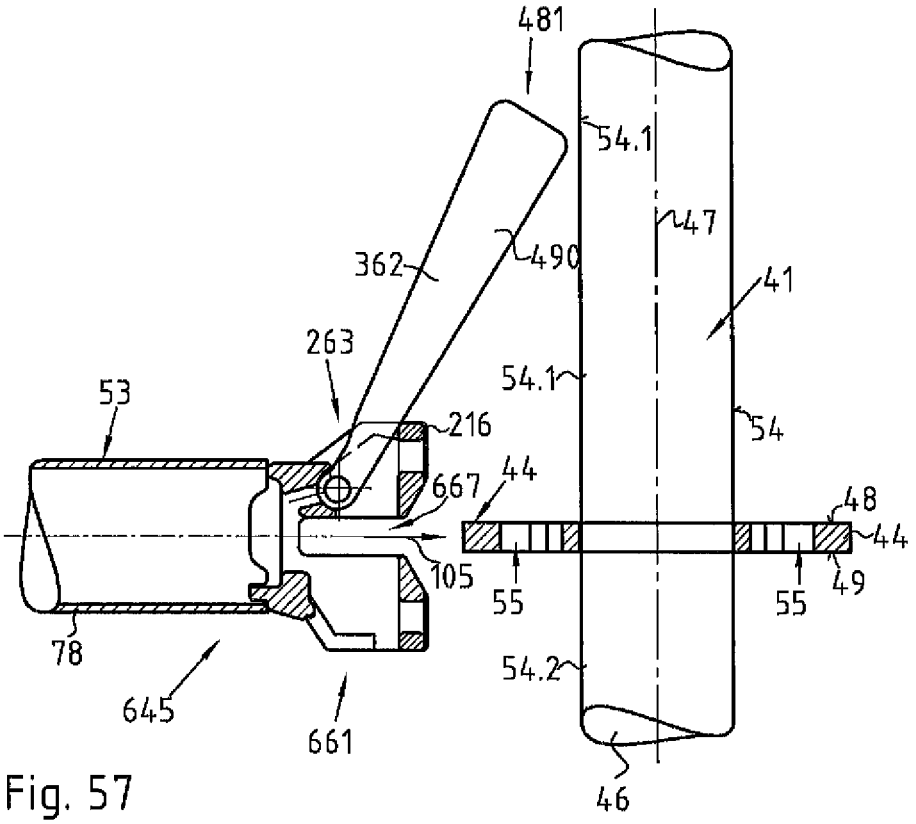
Figure 58:
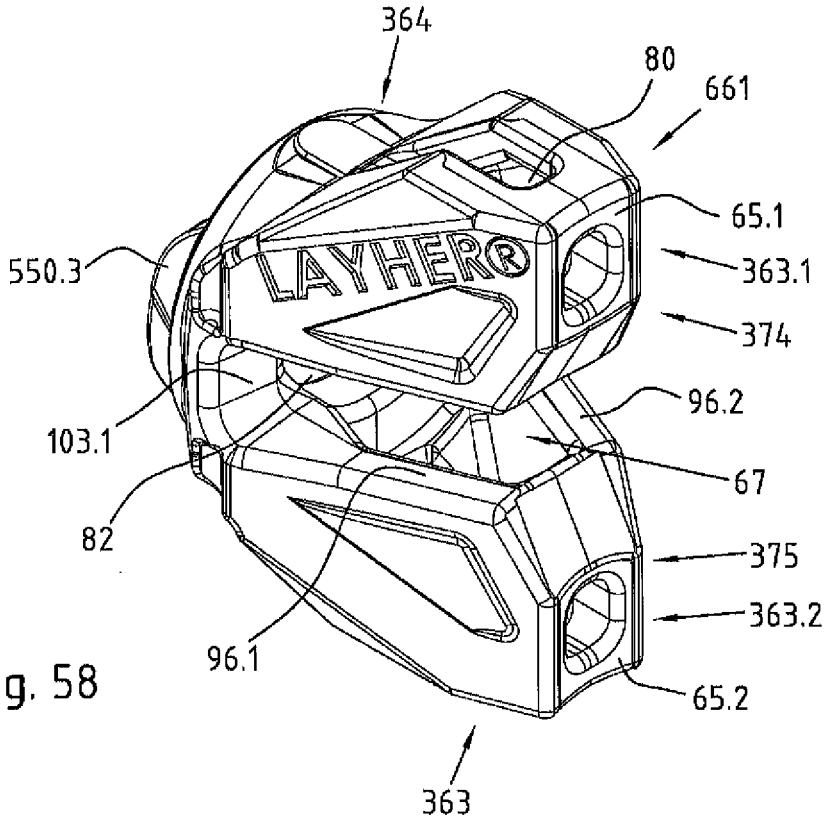
Figure 59:
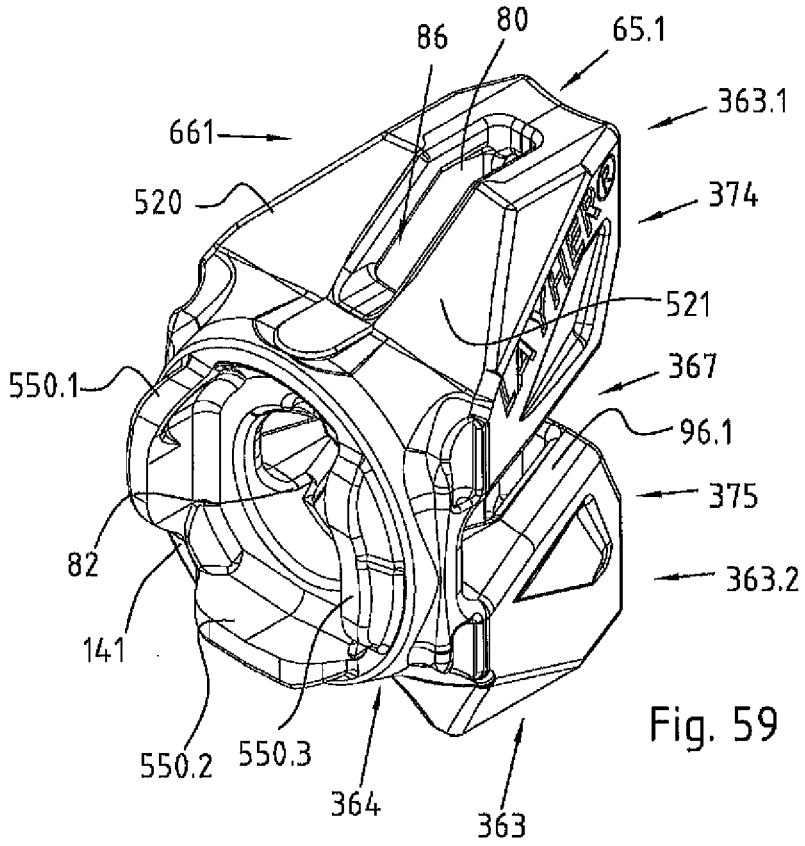
Figure 60:
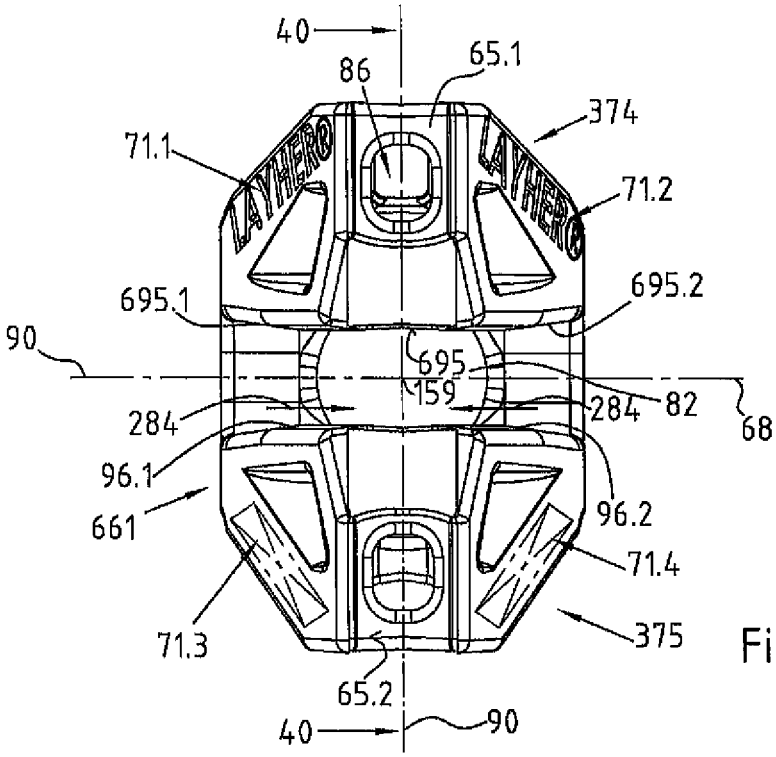
Figure 61:
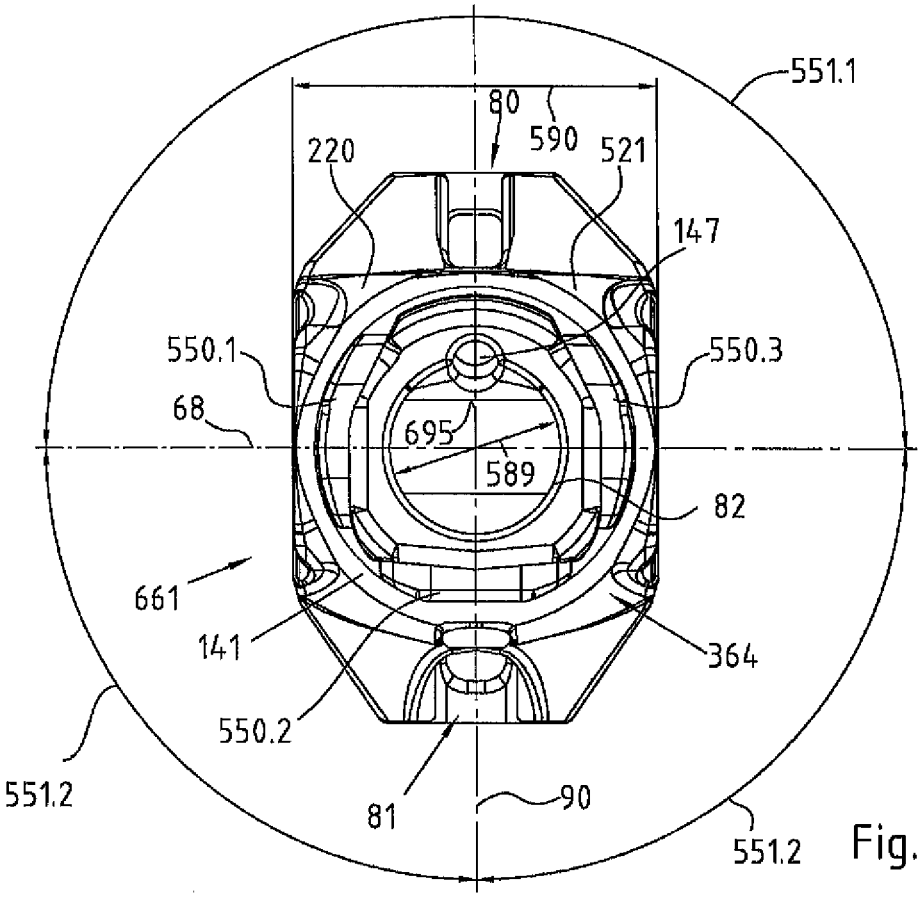
Figure 62:
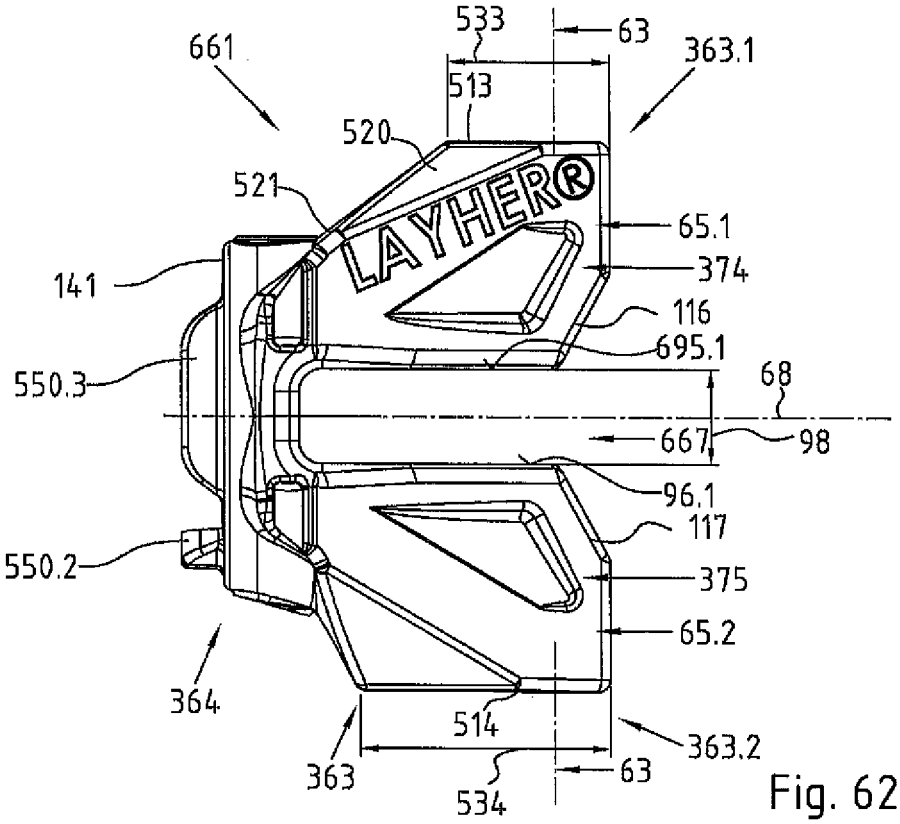
Figure 63:
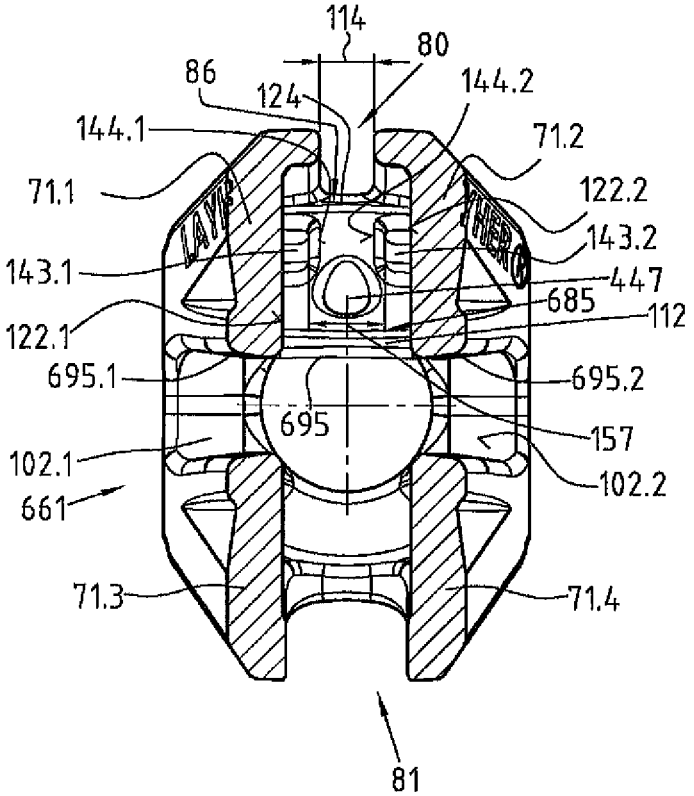
Figure 64:
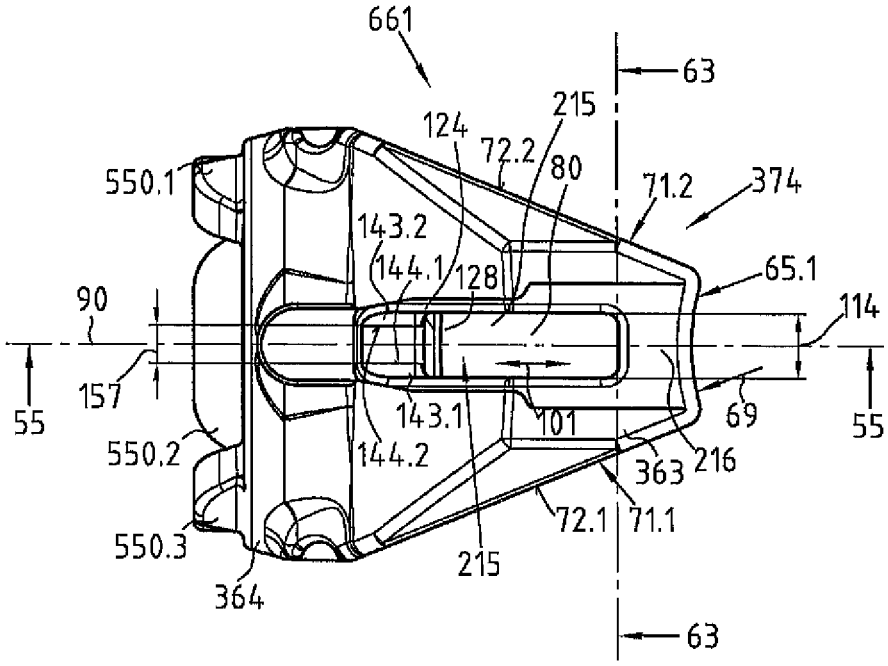
Figure 65:
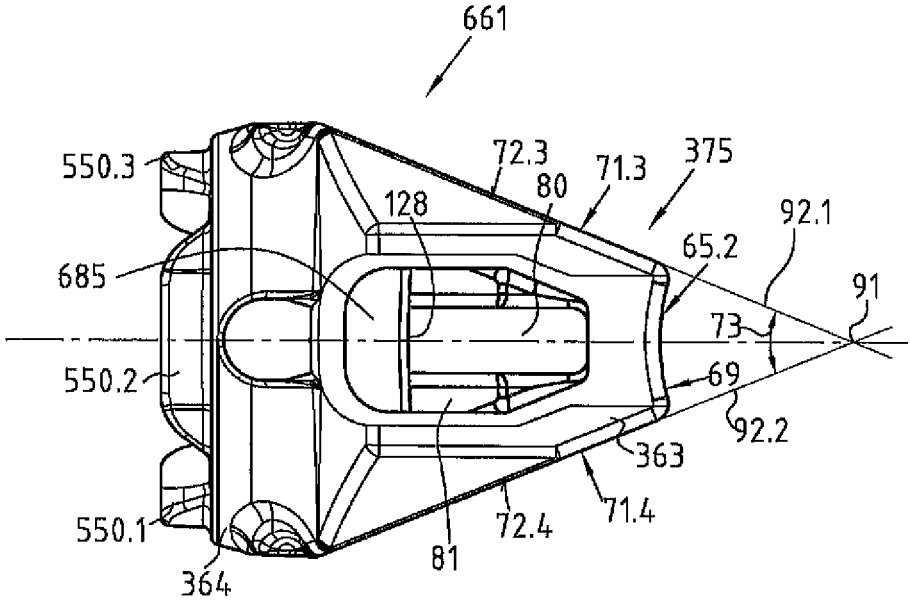

The wedge 362 according to the second exemplary embodiment, shown separately in FIG. 51, in an installation position, is similar in terms of its configuration or shape to a wedge known from the state of the art. The wedge 362 also consists of flat material, particularly of steel. It has an essentially constant wedge thickness 445. This thickness amounts to about 6 mm in the exemplary embodiment. The wedge 362 has parallel wedge side surfaces 461.1, 461.2 that face away from one another. Toward the rear 52, the wedge 362 is delimited by a rear, first wedge face edge 462, and toward the front 79 by a front, second wedge face edge 463. The rear or first wedge face edge 462 is delimited by a rear, essentially level contact surface 468, which extends at a slant toward the bottom 115 and front 79, at an inclination angle 470 relative to a or the vertical axis 148.

The inclination angle 470 amounts to about eight degrees, particularly 7.7 degrees, in the exemplary embodiment shown. The front or second wedge face edge 463 has an essentially level contact surface 466. The contact surface 466 of the front or second wedge face edge 463 faces away, toward the front 79, from the rear contact surface 468 of the rear or first wedge face edge 462, which faces toward the rear 52.

The vertical front contact surface 466 makes a transition, toward the top 110, with a rounding radius 484, preferably of about 5 mm, into an upper drive-in surface 483 at the upper wedge end 481 or drive-in end of the wedge 362. The upper wedge end 481 or drive-in end is formed by a horizontal upper wedge edge 482 that runs perpendicular to the vertical axis 148. This edge is delimited by the upper drive-in wedge surface 483 for driving the wedge 362 in with a hammer. The drive-in wedge surface 483 makes a transition, in the region of its rear upper end 485, particularly rounded with a radius 486 that also amounts to about 5 mm, for example, into the rear slanted contact surface 468 of the first wedge face edge 462. The upper wedge part 490, delimited by the slanted contact surface 468, the upper drive-in wedge surface 483, and the vertical contact surface 466, extends, when the connection head 361, with its slot 367, has been mounted onto the perforated disk 44 and locked and braced in a or the locking position 388, beyond the upper head part 374 of the connection head 361, vertically toward the top 110 (see also, for example, FIG. 38). The upper wedge part 490 has a maximal wedge part width 491 in the region of the upper wedge end 481. This width is selected to be so great that the wedge 362, when the connection head 361 or the scaffolding component 345 having the connection head 361 is handled separately, and when the wedge 362 has been inserted not only through the upper wedge opening 80 but also through the lower wedge opening 81, definitely cannot fall out downward through the lower wedge opening 81. The wedge 362 has a length of about 140 mm.

The vertical, rear contact surface 468 makes a transition, at a distance 492 from the lower wedge end 409 that amounts to about 33 mm, into a slanted surface 493 that is inclined toward the front 79 and bottom 115, which surface is configured at an inclination angle 495 relative to the vertical axis 148 that preferably amounts to about 13 degrees. The slanted surface 493 makes a transition, at a distance 496 from the lower wedge end 409 that preferably amounts to about 20 mm, into a vertical surface 497 of the rear or first wedge face edge 462 that runs parallel to the vertical axis 148. There, the wedge 362 has a lower wedge width 498 between the vertical surfaces 497, 505 of the rear and the front wedge face edge 462 or 463 that run parallel. This width amounts to about 11 mm in the exemplary embodiment. The said vertical surface 497 extends parallel to the vertical axis 148 over a length 499. This length amounts to about 10 mm in the exemplary embodiment. The vertical surface 497 make a transition, toward the bottom 115, into a wedge end surface 500 of a wedge end part 501 that delimits the lower wedge end 409. In this part, a bore 202 for accommodation of a retainer, here of a rivet 203, is affixed. The wedge end surface 500 of the lower wedge end part 501 is rounded with a radius 504 that is greater than half the lower wedge width 498 by which the wedge 362 is delimited by the rear vertical surface 497 of the rear or first wedge face edge 462 and by the front vertical surface 505 of the front or second wedge face edge 463 that runs parallel to the former. In a lower region, in which the wedge end surface 500 delimits the rear or first wedge face edge 462 toward the rear 52, the wedge end surface 500 rises slightly beyond the said rear vertical surface 497 toward the rear 52, so that there, an elevation 506 is configured. The elevation 506 delimited by the rounded wedge end surface 500, the vertical surface 497 that follows it vertically toward the top 110, and the subsequently slanted surface 493 that follows it at a slant toward the rear 52 and top 110 delimit a bridging recess 507. This recess is provided in order to ensure that the wedge 362, when it has been inserted through the upper wedge opening 80 and is undetachably secured to and connected with the connection head 361, by means of the retainer 203, can be laid without problems around the outer surface 155 of a rod element, preferably a round tube 78, that is firmly connected with the connection part 364 of the connection head 361, after having been pulled up or in a pulled-up state, in which the retainer 203 prevents further pulling out of the wedge 362 upward, during the course of pivoting toward the rear 52 and bottom 115, until the wedge makes contact with its rear or first wedge face edge 462, in the region of the upper wedge end 481. In this manner, optimal space-saving accommodation of the wedge 362 for transport purposes is possible, and the risk of hooking onto other scaffolding components is minimized. The rounded wedge end surface 500 of the lower wedge end part 501 makes a transition, tangentially toward the top 110, into the front contact surface 466 of the front or second wedge face edge 463, in a partial region assigned to the front, second wedge face edge 463.

The wedge 362 has a rear edge or first wedge face edge 462 that faces toward the rear or toward the outside 52, which edge has an essentially level contact surface 468 that extends at a slant in the direction toward the outside 52 and bottom 115, at an inclination angle 470 relative to the vertical axis 148, along a slanted axis 469. The contact surface 468 of the first wedge face edge 462 lies against the vertical wedge support surface 229 of the outer projection part 97 only locally, in the region of the upper recess edge 580 of a perforation 55; 55.1 of the projection or of the perforated disk 44, when the wedge 362 is in the locking position 388 and the connection head 361 is braced against the vertical scaffolding element 41 using the wedge 362, or when the wedge 362 is in the locking position 388.

The wedge 362 furthermore has a front edge or second wedge face edge 463 that faces toward the front or toward the inside 79 in the transverse direction 118, which edge has an essentially level contact surface 366 that extends parallel to the vertical axis 148 or in a straight line. This contact surface 366 corresponds not only with the upper wedge support surface 525 of the upper head part 374 and with the lower wedge support surface 531 of the lower head part 375, in such a manner that the vertical contact surface 366 of the wedge 362 and the vertical wedge support surfaces 525, 531 of the connection head 361 can be displaced, parallel to one another and lying against one another over their full area, relative to one another along or in the direction of the vertical axis 148.

Accordingly, the wedge 362 of the connection head 361, when the connection head 361 has been mounted onto a projection or onto a perforated disk 44 of a vertical scaffolding element or scaffolding post 41, as intended, in such a manner that the wedge has been inserted through the passage 384 configured in the upper head part 374 and in the lower head part 375, intersecting the slot 67, through a perforation 55; 55.1 of the projection or of the perforated disk 44, and is accordingly in a locking position 388, lies against the corresponding wedge support surface 525, 531 of the straight inner edges of the connection head 361 with its front, straight front edge 463 that faces in the direction of the vertical scaffolding element or scaffolding post 41, or with its contact surface 466, while the wedge 362, at the same time, lies against the upper recess edge 280 of the projection or of the perforated disk 44, with its rear, slanted rear edge 462, which faces away from the vertical scaffolding element or the scaffolding post 41, or its contact surface 468, in point form or horizontal-line form, against the inner edge that extends vertically or in a plumb line, or its wedge support surface 229 of a perforation 55; 55.1, 55.2.

In the following, further differences of the connection head 361 as compared with the connection head 61 will be briefly discussed:

Although the connection part 364 of the connection head 361 does also have three centering tabs 550.1, 550.2, 550.3, these now extend over a greater circumference angle, in each instance, in comparison with the centering tabs 250. As a result, the risk of damage or even breaking off of the centering tabs 550.1, 550.2, 550.3 during handling of same or in the event of dropping of same, for example onto a transport belt, is minimized, particularly when the connection head, as in the preferred exemplary embodiment, for example, is produced from or consists of tempered casting or hard casting.

Figure 46:
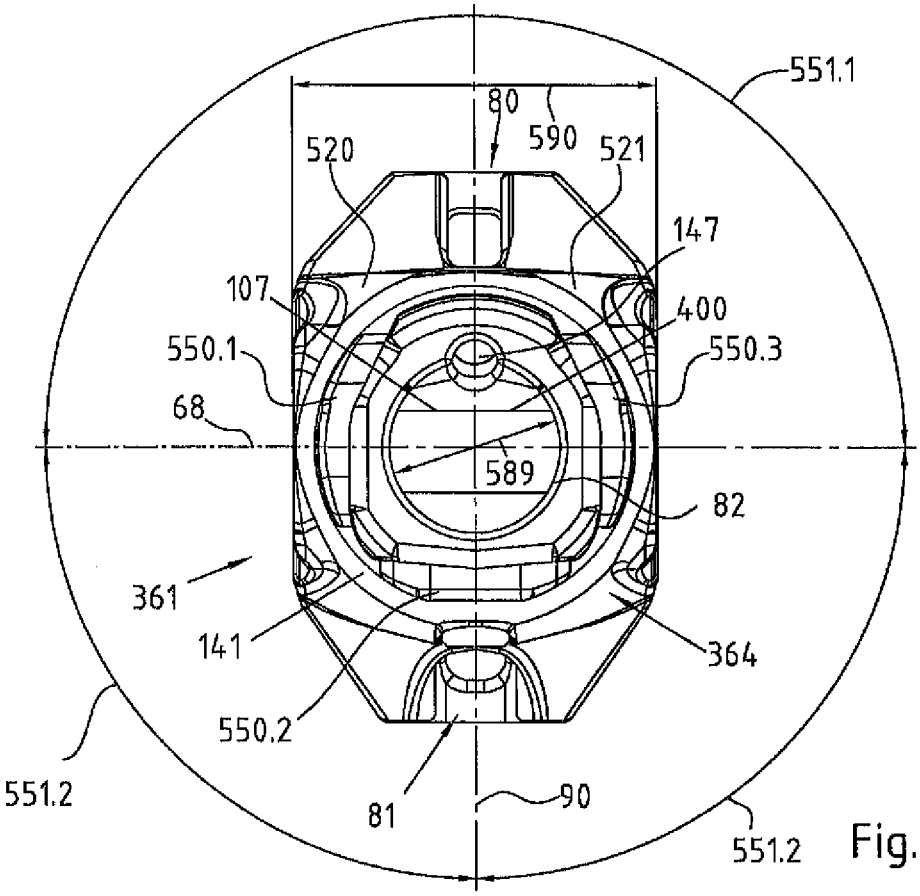
Figure 47:
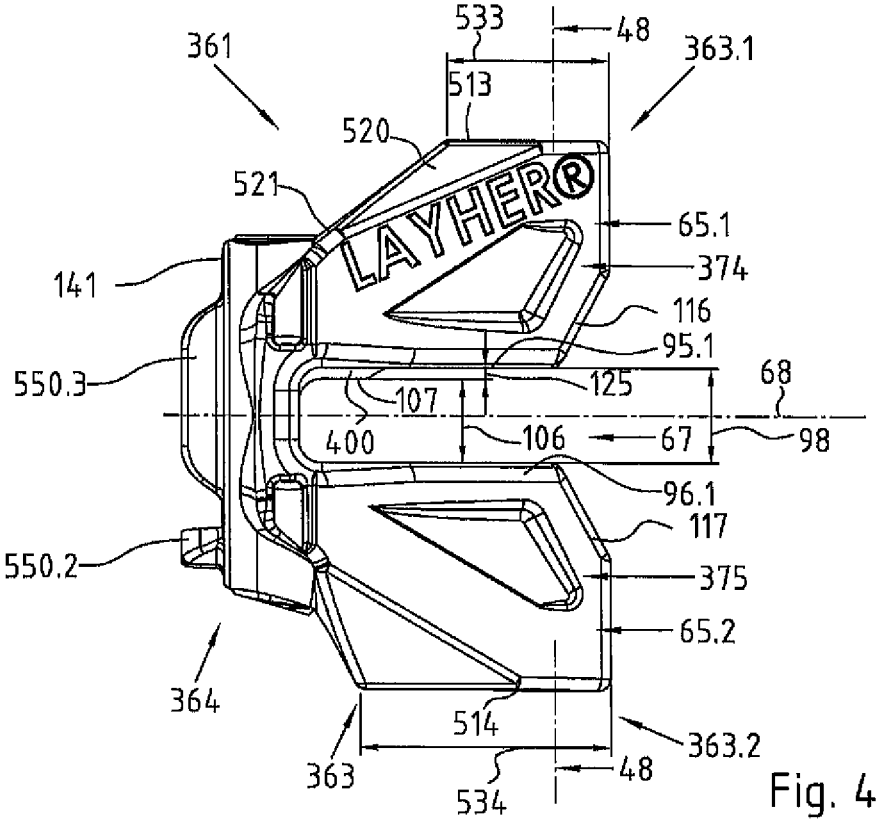

Furthermore, the centering tabs 550.1, 550.2, 550.3 are now no longer configured to be the same in the second exemplary embodiment shown, and are also no longer disposed offset at the same circumference angles relative to one another. It is understood, however, that such or similar centering tabs can also be disposed at the same circumference angles relative to one another. In the second exemplary embodiment shown, the two centering tabs 550.1 and 550.3 are disposed offset relative to one another by a circumference angle 555.1 of about 180 degrees. In contrast to this, the further centering tab 550.2, which is disposed between these two centering tabs 550.1 and 550.3, viewed in the circumference direction, is disposed offset by the same circumference angle 551.2, in each instance, relative to the adjacent centering tabs 550.1, 550.3, of only about 90 degrees (FIG. 46). In this connection, the said further centering tab 550.2 is assigned to the lower head part 375 of the connection head 361.

Figure 18:
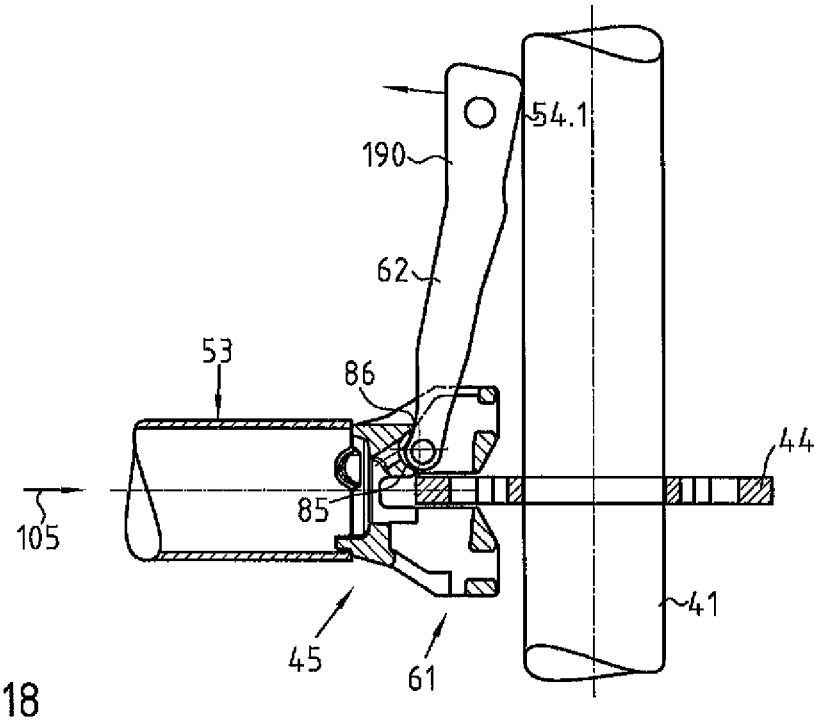
Figure 19:
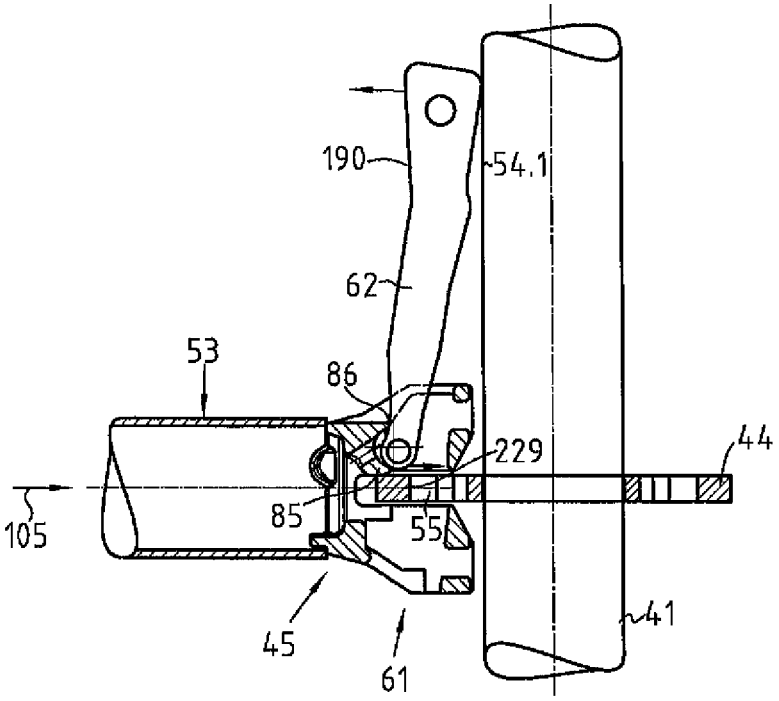
Figure 20:
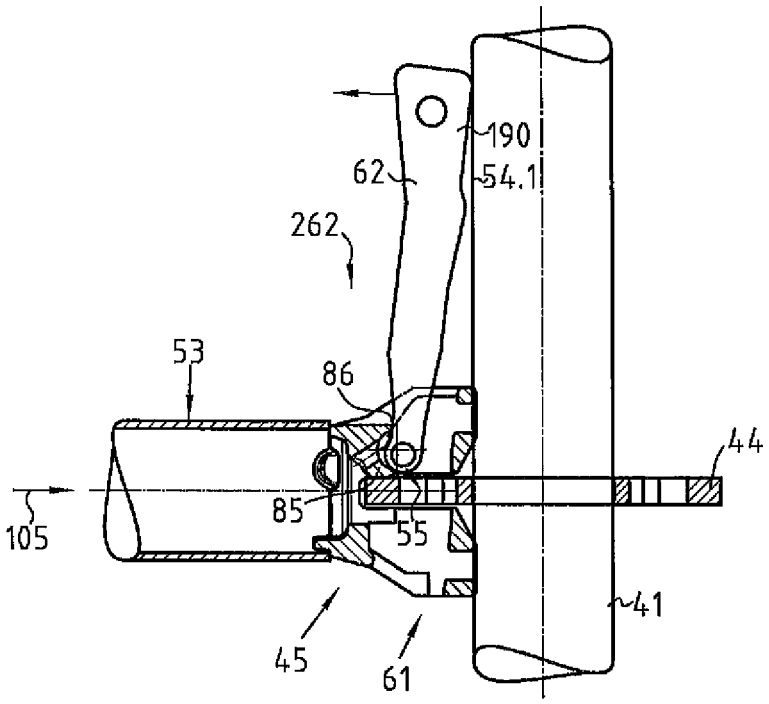
Figure 21:
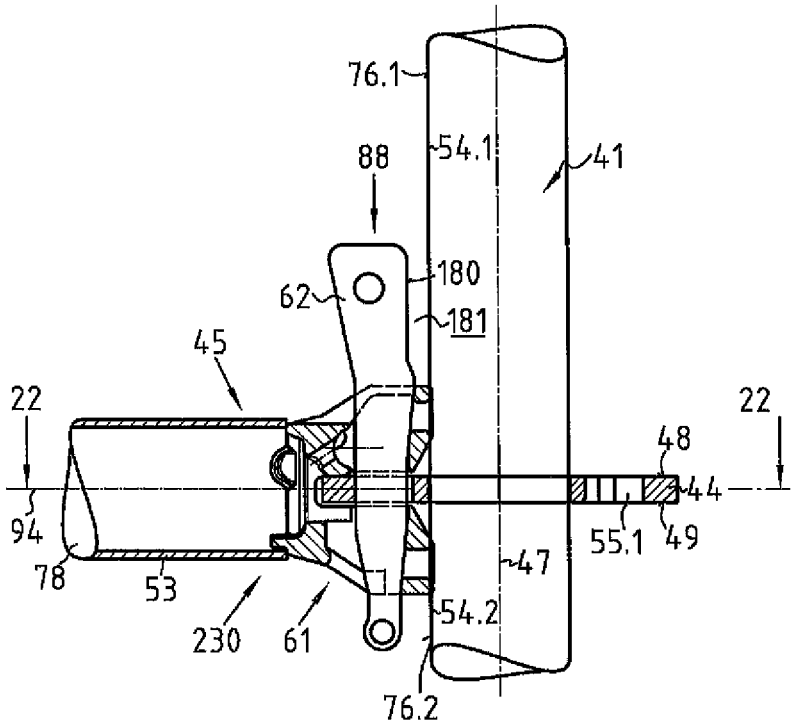
FIG. 21 an arrangement of the scaffolding parts according to the invention according to FIG. 20, whereby the connection head is now completely mounted onto the perforated disk, whereby the wedge, which is still loose, is in a locking position.
Figure 22:
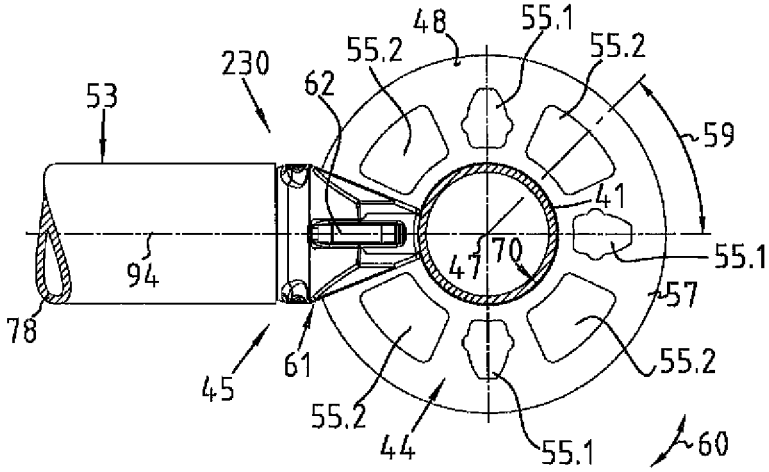
FIG. 22 a top view of the arrangement according to the invention, of the scaffolding parts according to the invention, with a partial section of the post, along the section lines 22-22 in FIG. 21.
Figure 23:
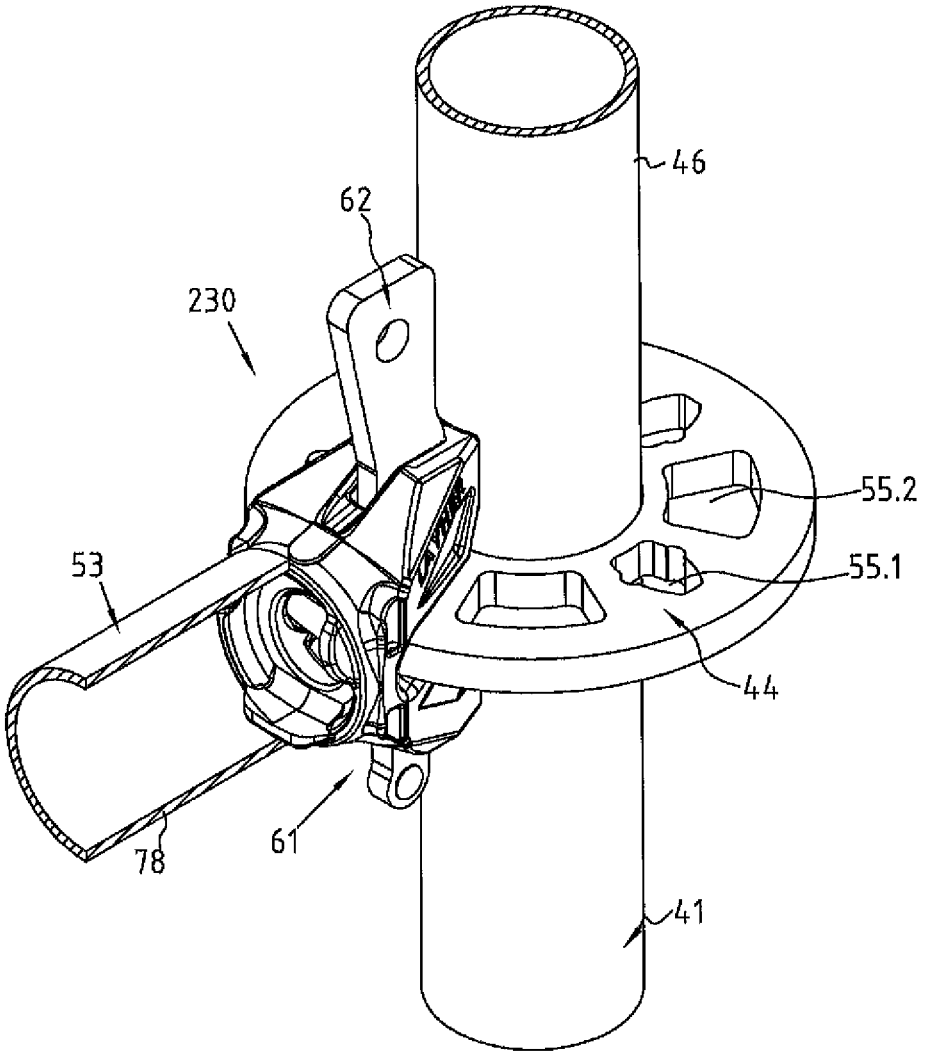
FIGS. 23 to 36 a first exemplary embodiment of a connection node according to the invention or of an arrangement according to the invention or of a connection head according to the invention, along with a wedge according to the invention.
Figure 24:
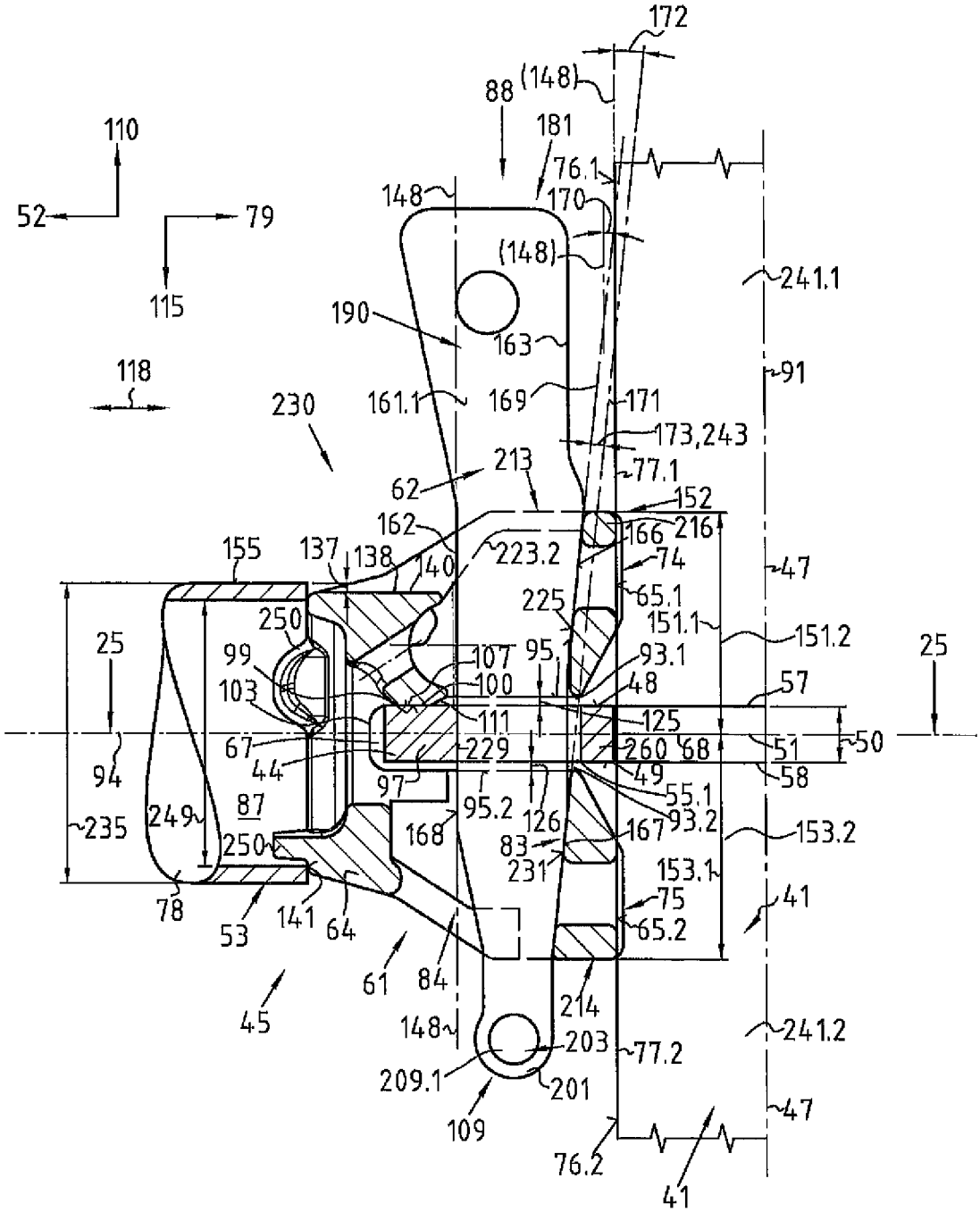

Furthermore, the inclination angle 436 of the zinc run-out opening 447 is enlarged from about 57 degrees to about 75 degrees in the case of the connection head 361 according to the second exemplary embodiment, as compared with the inclination angle 136 of the zinc run-out opening 447 in the case of the connection head 61 according to the first exemplary embodiment. In this way, the cross-sectional surface of the wedge support body 385, configured or shown in the vertical section according to FIG. 18, is increased accordingly. As a result, in turn, casting technology advantages are obtained, and also, an overall greater carrying capacity of the connection head 361 is obtained as compared with the connection head 61.

As was already the case for the connection head 61 according to the first exemplary embodiment, in the case of the connection head 361 according to the second exemplary embodiment, the slot 67 is structured, in the region of its slot bottom 103.1, 103.2, with a shoulder 400 of the upper head part 374 that extends to below the horizontal upper slot surfaces 95.1 of the slot 67 that are configured in the introduction region 93; 93.1, which shoulder is delimited, toward the bottom 115, by a horizontal upper shoulder slot surface 107 of the slot 67 or of the shoulder 400. Here, too, the shoulder 400, disposed above the horizontal upper delimitation surface 48 of the outer projection part 97 of the projection 44 in the support position 281, is supported, in the support position 281 and at least when the wedge 362 is in the locking position 388 and the connection head 361 is braced against the vertical scaffolding element 41, using the wedge 362, or already when the wedge 362 is in the locking position 388, on the upper delimitation surface 48 of the projection or of the perforated disk 44, over its full area, with a shoulder slot surface 107 that extends parallel to the horizontal upper delimitation surface 49 of the projection 44.

As was already the case for the shoulder 100 of the connection head 61, the shoulder 400 of the connection head 361 is delimited toward the front 79, in other words in the direction toward the introduction region 93 of the slot 67, by a slanted surface 113 of a front introduction bevel 282. This surface extends at a slant toward the bottom 115 and rear or outside 52, toward the slot bottom 103.1, 103.2, and makes a transition, in the direction toward the outside or rear 52, into the horizontal shoulder slot surface 107 of the shoulder 400. The slanted surface 113 also encloses an inclination angle 283, preferably amounting to about 20 degrees, with the horizontal 274 or with the shoulder slot surface 107.

Just as in the case of the shoulder 100 according to the first exemplary embodiment, in the case of the shoulder 400 of the second exemplary embodiment the wedge support surfaces 108 of the wedge support body 385 disposed in the region of or adjacent to the front release or delimitation edge 128 are disposed at a slight vertical distance 429 above the shoulder slot surface 107. Here, too, the distance 429 is less than half the slot height 98 or width in the introduction region 93 of the slot 67. Here, however, the distance 429 is slightly greater than the distance 129, so that in this region of the shoulder 400 or of the wedge support body 385, a greater material accumulation or a greater material thickness is achieved. In this way, correspondingly improved characteristic values of this connection head 361 can be achieved.

Figure 48:
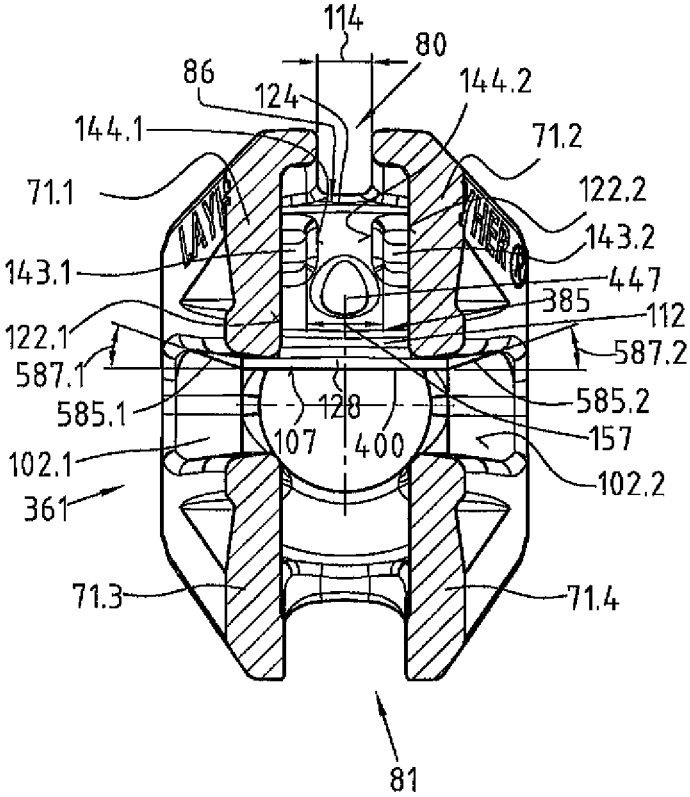
Figure 49:
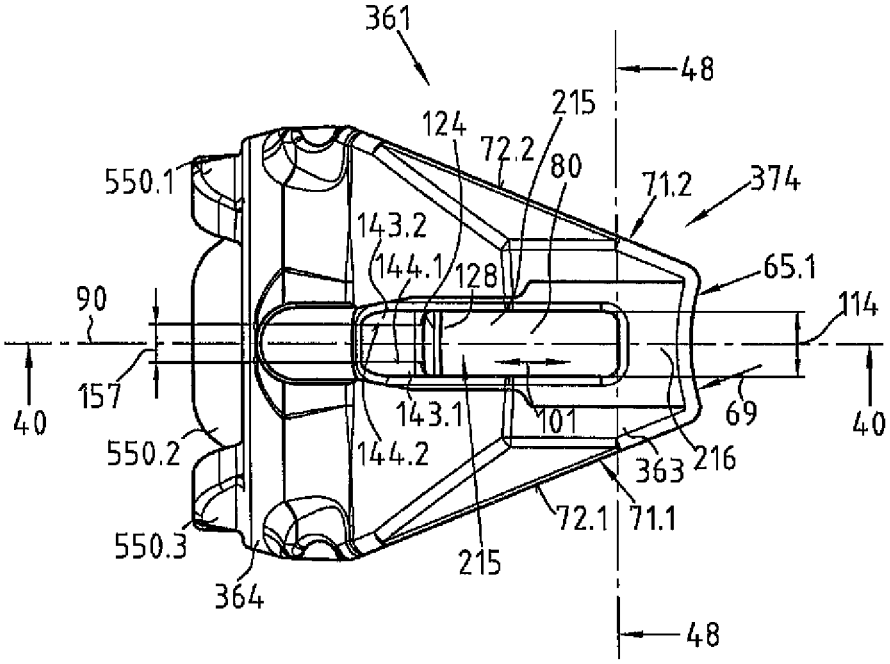
Figure 50:
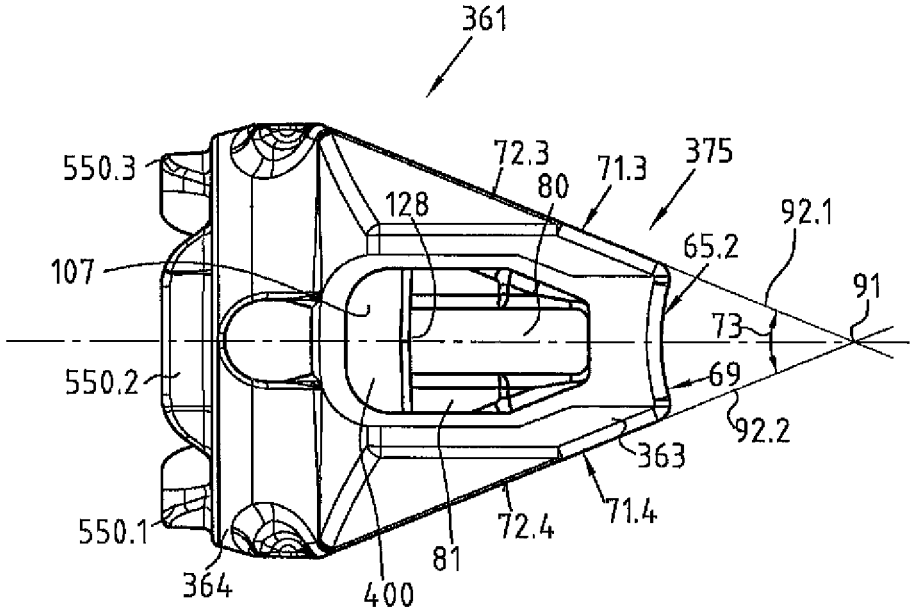

In contrast to the shoulder 100 according to the first exemplary embodiment, the shoulder 400 is additionally provided with lateral introduction bevels 585.1, 585.2. Each of these lateral introduction bevels 585.1, 585.2 is provided with a slanted surface 586.1, 586.2 that extends, proceeding from the horizontal shoulder slot surface 107 of the shoulder 400, at a slant toward the top 110 and laterally toward the vertical outer surface 72.1, 72.2, in each instance, of the upper side wall part 71.1, 71.2, in each instance. The slanted surface 586.1, 586.2, with the horizontal 274 or with the shoulder slot surface 107, also enclose an inclination angle 587.1, 587.2, which preferably amounts to about 20 degrees (FIG. 48). In this way, easier mounting or pushing on of the connection head 361 in a direction perpendicular to the vertical plane 90 or perpendicular to the transverse direction 118 and perpendicular to the vertical axis 148 or in a tangential direction toward the projection or toward the perforated disk 44 is possible. This is particularly advantageous if mounting or pushing on of the connection head 361 in the direction toward the front 79 or in a radial direction toward the projection or toward the perforated disk 44 is not possible, for example because insufficient space is available for this or because the scaffolding component 45 provided with the connection head 361 is already fastened onto a projection or onto a perforated disk 44 of another vertical scaffolding element or scaffolding post 41, at its end 56.2 facing away from the connection head 361, particularly by means of a second connection head 61 or 361 and a second wedge 62 or 362, by means of the second wedge 62 or 362 inserted through its perforation 55, in such a manner that the scaffolding component 45 can be pivoted in a horizontal plane relative to the projection 44.

For reasons of casting technology, not only was the upper horizontal wall part 513 of the connection head 361 modified slightly, in terms of its configuration, as compared with the upper horizontal wall part 213 of the connection head 61, but so was the rear wall part 520 of the connection head 361 as compared with the rear wall part 220 of the connection head 61.

Further adaptations in the structure and configuration of the connection head 361 in comparison with the connection head 61 are due to the changed wedge 362 and its position in the passage 384. Thus, the upper contact wall part 363.1 and the lower contact wall part 363.2, in the vertical section shown as an example in FIG. 41, now have a thickness 588 that remains the same or is the same, viewed in the vertical direction 110, 115. The thickness 588 preferably amounts to about 8.0 mm. Furthermore, viewed in the same vertical section, the wedge support surfaces 525, 531 not only of the upper contact wall part 363.1 of the upper head part 374, but also of the lower contact wall part 363.2 of the lower head part 375, which surfaces face toward the outside 52, now extend parallel to the two contact support surfaces 65.1 and 65.2.

For the remainder, the two connection heads 61 and 361, as is evident from the figures, only differ in a few or slight details, which do not need to be discussed in any detail at this point.

In FIGS. 52 to 65, a third exemplary embodiment of an arrangement 830 according to the invention or of a scaffolding component according to the invention or of a connection head 661 according to the invention, with a related wedge 362, is shown. This arrangement 830 differs from the arrangement 530 shown in FIGS. 37 to 51 according to the second exemplary embodiment exclusively in the configuration of the connection head. A wedge 362 as it has already been shown in connection with the second exemplary embodiment, particularly in FIG. 51, and described above, belongs to the connection head 661. Corresponding changed elements, parts, and dimensions are once again provided, in FIGS. 52 to 65, with reference numbers increased by the number 300, while the same elements, parts, and dimensions are provided with the same reference symbols. Accordingly, in the case of the third exemplary embodiment, the connection head is provided with the reference symbol 661, and the slot is provided with the reference symbol 667.

Also in the case of the arrangement 830 according to the third exemplary embodiment, the vertical scaffolding element or the scaffolding post 41, with its at least one projection or with its at least one perforated disk 44, as well as the scaffolding tube or rod element 53, are structured and configured in the same manner as in the case of the arrangement 230 and 530 according to the first and second exemplary embodiment, respectively. It is understood, however, that these elements or components can also be structured and/or configured differently, within the scope of the invention, individually or in combination. In the arrangement 830 or in the connection head 661 according to the third exemplary embodiment, an identical wedge 362 is provided as in the second exemplary embodiment (see FIG. 51) so that in this regard, reference can be made to the above explanations.

In contrast not only to the first exemplary embodiment but also to the second exemplary embodiment, in the connection head 661 according to the third exemplary embodiment the "shoulder" is left out. In other words, particularly in the region of the slot bottom 103; 103.1, 103.2, no "shoulder" is provided any longer, but rather the slot 667 of the connection head 661, in the same or a similar manner or configuration as for connection heads known from the state of the art, particularly those of the applicant, is not only delimited, toward the bottom 115, by essentially level, lower, horizontal slot surfaces 96.2, which extend, proceeding from the lower end of the upper introduction region 93.1 all the way to the slot bottom 103; 103.1, 103.2, with the exception of transition radii or transition regions, continuously horizontally, but rather the slot 667 is also delimited, toward the top 110, with essentially level upper horizontal slot surfaces 695.1, 695.2, which extend, proceeding from the lower end of the lower introduction region 93.2, all the way to the slot bottom 103; 103.1, 103.2, with the exception of transition radii or transition regions, continuously horizontally. As a result, the connection head 661 is supported, when the connection head 661 is mounted onto the projection or onto the perforated disk 44 as intended, and when the wedge 362 is in the locking position 388 and the connection head 661 is braced against the vertical scaffolding element or scaffolding post 41 using the wedge 362 and/or when the wedge 362 is in the locking position 388, directly on the horizontal upper delimitation surface 48 of the projection of or of the perforated disk 44, over its full area, with the said horizontal upper slot surfaces 695.1, 695.2 of the slot 667.

In the third exemplary embodiment, the wedge support body 685 that has the wedge support surfaces 108 is delimited, toward the bottom 115, by an essentially level, horizontal, upper slot surface 695 of the slot 667, which surface is disposed in the horizontal plane spanned by the slot surfaces 695.1, 695.2 of the slot 667. The slot 667, as a whole, is therefore delimited toward the top 110 by an essentially level upper slot surface 695.1, 695.2. The wedge support body 685 extends, as before, continuously between the upper side wall parts 71.1 and 71.2 of the connection head 661, and is produced or connected in one piece with the side wall parts 71.1, 71.2. For the remainder, the connection head 661 is structured the same or at least essentially the same as the connection head 361 according to the second exemplary embodiment.

It is characteristic not only for the connection head 361 with the related wedge 362 according to the second exemplary embodiment, but also for the connection head 661 with the related wedge 362 according to the third exemplary embodiment, or for a scaffolding component provided with at least one such connection head 361 or 661 with a related wedge 362, in each instance, that this head or this component is configured according to the features described herein, and that the method described herein can be carried out with it, in the same manner or accordingly.

It is understood that the invention is not restricted to the exemplary embodiments shown in the figures and described above, but rather that a scaffolding component according to the invention or an arrangement according to the invention or a fastening method according to the invention can also be configured, dimensioned and/or structured differently, or implemented differently, within the scope of the idea of the invention laid down in the claims and in the specification. In particular, the technical characteristics and measures that can be derived from the claims, the specification, and the drawings, to the extent that they can be implemented, are in accordance with the invention individually or can be combined in any desired number.

REFERENCE SYMBOL LIST

40 scaffolding/modular scaffolding
41 vertical scaffolding element/post/rod element
42 axial direction/vertical direction/thickness direction
43 grid dimension
44 connection element/projection/rosette/perforated disk
45 scaffolding component/connection, holding, support element/longitudinal bar/scaffolding bar
46 round tube
47 longitudinal axis of 41
48 upper delimitation surface of 44
49 lower delimitation surface of 44
50 perforated disk thickness
51 center plane/horizontal center plane of 44
52 toward the rear/outside
53 rod element
54 outer surface of 41
54.1 upper outer surface of 41
54.2 lower outer surface of 41
55 passage hole/perforation/aperture
55.1 small perforation
55.2 large perforation
56.1 end
56.2 end
57 top side of 44
58 underside of 44
59 circumference angle
60 circumference direction
61 connection head
62 wedge
63 contact part
63.1 upper contact wall part
63.2 lower contact wall part
64 connection part
65.1 upper contact support surface
65.2 lower contact support surface
67 slot
68 center plane/horizontal center plane
69 radius
70 outer radius of 46
71.1 upper side wall part
71.2 upper side wall part
71.3 lower side wall part
71.4 lower side wall part
72.1 upper vertical outer surface
72.2 upper vertical outer surface
72.3 lower vertical outer surface
72.4 lower vertical outer surface
73 wedge angle
74 upper head part
75 lower head part
76.1 upper outer surface of 41
76.2 lower outer surface of 41
77.1 post part of 41
77.2 post part of 41
78 component/rod element/round tube
79 toward the front/inside
80 upper wedge opening
81 lower wedge opening
82 perforation
83 inner side of 84
84 wedge accommodation space/passage
85 wedge support body
86 wedge pivot counter-bearing
87 interior space of 78
88 locking position
89.1 upper inner edge
89.2 lower inner edge
90 vertical symmetry plane/vertical plane
91 vertical central axis
92.1 vertical plane
92.2 vertical plane
93 introduction region
93.1 upper introduction region
93.2 lower introduction region
94 longitudinal axis of 78
95.1 upper slot surface
95.2 upper slot surface
96.1 lower slot surface
96.2 lower slot surface
97 (outer) projection part/edge crosspiece
98 first slot height/slot width/vertical distance
99 upper slot surface
99.1 upper slot surface
99.2 upper slot surface
100 shoulder/support body
101 longitudinal direction of 80
102.1 vertical slot surface
102.2 vertical slot surface
103 slot bottom
103.1 slot bottom
103.2 slot bottom
104 longitudinal direction of 80
105 essentially horizontal mounting direction/essentially horizontal
106 slot width/slot height/distance
107 upper shoulder slot surface
108 wedge support surface
109 lower wedge end
110 toward the top
111 narrowing
112 (upper) wall part

113 slanted surface
114 slot width of 80
115 toward the bottom
116 upper introduction bevel
117 lower introduction bevel
118 transverse direction
119 (the) interior
120 direction/tangential
121 horizontal plane
122.1 inner delimitation surface
122.2 inner delimitation surface
123 inside space/interior
124 (upper) front delimitation edge
125 first vertical slot surface distance
126 second vertical slot surface distance
127 wedge end part
128 lower/front/inner delimitation edge/release edge/lower end
129 vertical distance
130 inner radius
131 outer radius
132 accommodation pocket
133 inside contour of 132
134 circumference angle
135 outside contour
136 inclination angle
137 distance
138 surface
139 inner wall part
140 upper wall part
141 impact ring surface
142 horizontal distance
143.1 centering support tab
143.2 centering support tab
144.1 centering support surface
144.2 centering support surface
145 thickness/wedge thickness
146 upper region of 132
147 zinc run-out opening
148 vertical axis
149 cavity
150 inside diameter
151.1 first distance
151.2 first distance
152 upper end
153.1 second distance
153.2 second distance
154 lower end
155 outer surface of 78
156 vertical distance
157 horizontal distance
158 toe board fitting recess
159 section line/intersection line/longitudinal axis
161.1 wedge side surface
161.2 wedge side surface
162 (rear/outer) first wedge face edge
163 (front/inner) second wedge face edge
164 length
166 upper (front/inner) contact surface
167 lower (front/inner) contact surface
168 (rear/outer) contact surface
168.1 (rear/outer) lower wedge face surface
169 first slanted axis
170 (first) inclination angle
171 second slanted axis
172 (second) inclination angle
173 amount/contact surface distance
174 vertical (front/inner) face surface
175 length
176 wedge part distance
177 rounding radius
178 inclination angle
179 slanted support surface
180 vertical support surface
181 upper wedge end/drive-in end
182 upper wedge edge
183 upper drive-in wedge surface
184 radius
185 rear, upper end
186 radius
187 upper (rear/outer) slanted wedge surface
188 slanted wedge edge
189 inclination angle
190 upper wedge part
191 wedge part width
192 distance
193 slanted surface
194 lower slanted wedge surface
195 inclination angle
196 distance
197 vertical surface
198 lower wedge width
199 length
200 wedge end surface
201 wedge end part
202 bore
203 retainer/thickening/rivet
204 radius
205 vertical surface
206 elevation
207 bridging recess
208 distance
209.1 rivet head
209.2 rivet head
210 maximal rivet head diameter
211 rivet width
212 inner (delimitation) surface/horizontal surface/support surface
213 upper horizontal wall part
214 lower horizontal wall part
215 longitudinal slot
216 wall part
217 (upper) horizontal (outer) surface
218 (lower) horizontal (outer) surface
219 distance
220 upper wall part/rear wall part
221 outer surface
222.1 wedge guide surface
222.2 wedge guide surface
223.1 wedge guide edge
223.2 wedge guide edge
225 upper wedge support surface
226 height
227 vertical inner surface
229 (vertical) wedge support surface
230 arrangement
231 lower wedge support surface
232 front/inner end
233 length
234 length
235 outside diameter of 78
236 radial (inner/rear) side
237 wedge width
241.1 upper scaffolding element part/post part

241.2 lower scaffolding element part/post part
243 amount/wedge support surface distance
244.1 wedge step
244.2 wedge step
246.1 connection head step
246.2 connection head step
247 outside diameter of 141
248 inside diameter of 141
249 inside diameter of 78
250 centering tab
251 circumference angle
252 distance
253 upper pivot position
260 (inner) edge crosspiece/projection part
261 contact pivot position
262 mounting limit position
263 (initial) installation position
265 installer
266 secured position
267 leading railing
268 railing/back-hip railing
269 scaffolding deck
270.1 scaffolding field
270.2 adjacent scaffolding field
271 starting position
272.1 inclination position
272.2 (less greatly inclined) inclination position
273.1 inclination angle
273.2 (reduced) inclination angle
274 horizontal
275 edge
276.1 preparation position
276.2 (alternative) preparation position
277 knee rail
280 recess edge
281 support position
282 (front) introduction bevel
283 inclination angle
284 direction (toward the inside)
345 scaffolding component
361 connection head
362 wedge
363 contact part
363.1 contact wall part
363.2 contact wall part
364 connection part
366 contact surface
374 upper head part
375 lower head part
383 inner side
384 passage
385 wedge support body
388 locking position
400 shoulder
409 lower wedge end
412 (upper) wall part
413 slanted surface
429 vertical distance
436 inclination angle
445 wedge thickness
447 zinc run-out opening
461.1 wedge side surface
461.2 wedge side surface
462 rear/outer/first wedge face edge
463 front/inner/second wedge face edge
466 contact surface
468 contact surface
469 slanted axis
470 inclination angle
481 upper wedge end/drive-in end
482 upper wedge edge
483 upper drive-in (wedge) surface
484 rounding radius
485 upper end
486 radius
490 upper wedge part
491 (maximal) wedge part width
492 distance
493 slanted surface
496 distance
497 vertical surface
498 wedge width
499 length
500 wedge end surface
501 wedge end part
504 radius
505 vertical surface
506 elevation
507 bridging recess
513 upper horizontal wall part
514 lower horizontal wall part
520 upper wall part/back wall part
521 outer surface
525 upper wedge support surface
530 arrangement
531 lower wedge support surface
533 length
534 length
550.1 centering tab
550.2 centering tab
550.3 centering tab
551.1 circumference angle
551.2 circumference angle
582 introduction bevel
583 inclination angle
585.1 introduction bevel
585.2 introduction bevel
586.1 slanted surface
586.2 slanted surface
587.1 inclination angle
587.2 inclination angle
588 thickness
589 inside diameter
590 (maximal) width
626 slot surface distance
645 scaffolding component
656 vertical distance
661 connection head
667 slot
685 wedge support body
695 upper slot surface
695.1 upper slot surface
695.2 upper slot surface
712 (upper) wall part
830 arrangement

The invention claimed is:

1. Arrangement of a vertical scaffolding element and of a scaffolding component, said scaffolding component having at least one connection head and a wedge, for formation of a releasable connection with the vertical scaffolding element, wherein a projection is fastened onto said vertical scaffolding element which extends in the direction of a longitudinal axis, wherein the projection extends transversely, in other words in a transverse direction, relative to the longitudinal axis of the vertical scaffolding element, and has a recess in the form of a perforation for inserting the wedge through it, wherein the connection head has an upper head part having an upper wedge opening, and a lower head part having a lower wedge opening, for the wedge that can be inserted through the wedge openings, wherein a horizontal slot that is open toward the front is disposed between the upper head part and the lower head part, for mounting the connection head in a horizontal mounting direction toward the front onto the projection, wherein the horizontal slot is delimited toward the top and toward the bottom with slot surfaces, which extend on both sides of a horizontal center plane of the horizontal slot, wherein the connection head has a wedge support body, disposed above the horizontal slot and projecting over the horizontal slot toward the front, said wedge support body having wedge support surfaces for vertical support of the wedge in the region of its lower wedge end towards the bottom against unintentional movement of the wedge vertically downward into a blockage position, in which mounting of the connection head with its horizontal slot in the horizontal mounting direction toward the front onto the projection would be blocked, wherein the wedge support surfaces of the wedge support body are configured to support the wedge so that a wedge part of the wedge projects out of the upper head part toward the top beyond the upper head part and so that the wedge can be pivoted into a vertical plane that runs perpendicular to the horizontal center plane of the horizontal slot, relative to the connection head, into an impact pivot position that is inclined toward the front, in which impact pivot position the wedge part of the wedge projects out of the upper head part toward the top beyond the upper head part and projects in front of the upper head part of the connection head, toward the front, when the wedge is supported on the wedge support surfaces, wherein the connection head has a wedge pivot counter-bearing above the wedge support surfaces of the wedge support body and projecting toward the front of the slot, wherein the wedge support surfaces allow vertical support of the wedge, towards the bottom, wherein the wedge-pivot counter-bearing is configured so that the wedge can be laid or is laid on the wedge-pivot counter-bearing when the wedge is supported on the wedge support surfaces of the wedge support body, in the region of its lower wedge end, and wherein the wedge-pivot counter-bearing delimits the upper wedge opening toward the rear so that the wedge can be pivoted about the wedge-pivot counter-bearing, when the wedge is supported on the wedge support surfaces of the wedge support body in the region of the lower wedge end and when the wedge is laid against the wedge pivot counter-bearing, toward the rear with its wedge part that projects toward the top beyond the upper wedge opening, and, at the same time, toward the front with its lower wedge end, in order to achieve liberation of the wedge, so that the wedge can automatically move all the way into or through the lower wedge opening as the result of gravity and/or with the support of spring force, vertically toward the bottom, while crossing the horizontal slot.

2. Arrangement according to claim 1, wherein the wedge support surfaces of the wedge support body are disposed at a slight vertical distance above slot surfaces that delimit the horizontal slot toward the top.

3. Arrangement according to claim 1, wherein the wedge support surfaces of the wedge support body are disposed at a vertical distance above slot surfaces that delimit the horizontal slot toward the top, which distance is less than half the slot height.

4. Arrangement according to claim 1, wherein the wedge support body is disposed in the region of vertical slot surfaces of a slot bottom that delimit the horizontal slot toward the rear and/or in a rear region of the horizontal slot.

5. Arrangement according to claim 1, wherein the wedge support body delimits the horizontal slot with an upper slot surface toward the top.

6. Arrangement according to claim 1, wherein the wedge support surfaces are inclined at a slant toward the front and toward the bottom in the region of the front, lower, end of the wedge support body that faces the lower head part, and are structured to run concave or in a straight line when viewed in a vertical section that contains the vertical plane.

7. Arrangement according to claim 1, wherein the wedge support body has an accommodation pocket for accommodating and supporting at least one wedge part provided at the lower wedge end of the wedge.

8. Arrangement according to claim 7, wherein the accommodation pocket, when viewed in the vertical direction, is configured between the wedge pivot counter-bearing and the slot.

9. Arrangement according to claim 7, wherein the accommodation pocket, when viewed in a vertical section that contains the vertical plane, has an inside contour that corresponds to a corresponding outside contour of a or the wedge part provided at the lower wedge end of the wedge.

10. Arrangement according to claim 1, wherein the wedge pivot counter-bearing is disposed in the region of the upper wedge opening and delimits the upper wedge opening toward the bottom.

11. Arrangement according to claim 1, wherein the wedge support body and/or the wedge pivot counter-bearing is/are configured on the upper head part of the connection head and/or on a connection part of the connection head, onto which a component, particularly a rod element of the scaffolding component is fastened.

12. Arrangement according to claim 1, wherein the wedge support body and/or the wedge pivot counter-bearing are disposed in the interior of the connection head.

13. Arrangement according to claim 1, wherein the connection head has centering support surfaces for the wedge, disposed on both sides of the vertical plane, between which centering support surfaces the wedge is laterally supported in the region of its lower wedge end with little play, when the wedge is supported on the wedge support surfaces of the wedge support body.

14. Arrangement according to claim 13, wherein the centering support surfaces are disposed below the wall parts of the upper head part of the connection head that delimit the upper wedge opening and/or below the wedge pivot counter-bearing.

15. Arrangement according to claim 13, wherein the centering support surfaces are disposed in the region of the wedge support body or in the region of the accommodation pocket.

16. Arrangement according to claim 13, wherein at least two centering support tabs that extend toward the front are provided, which tabs are disposed at a horizontal distance relative to one another, delimited by the centering support surfaces that lie opposite each other.

17. Arrangement according to claim 13, wherein the centering support surfaces delimit a or the accommodation pocket laterally.

18. Arrangement according to claim 1, wherein the upper wedge opening is delimited, at least on one side, by an upper wall part of the upper head part, which upper wall part is delimited, into the interior of the connection head by an inner, slanted wedge guide edge that extends toward the rear and toward the bottom, along which wedge guide edge a retainer provided in the region of the lower wedge end or on the lower wedge end can be guided, in the event of a movement of the wedge relative to the connection head.

19. Arrangement according to claim 18, wherein the wedge guide edge makes a tangential transition, toward the bottom, into the accommodation pocket.

20. Method for fastening a scaffolding component having at least one connection head and a wedge, onto a vertical scaffolding element that extends in the direction of a longitudinal axis, onto which element a projection that extends transversely relative to the longitudinal axis of the scaffolding element, and has a recess in the form of a perforation for inserting the wedge through it, is fastened, wherein the connection head has an upper head part having an upper wedge opening and a lower head part having a lower wedge opening, for the wedge that can be inserted through the wedge openings, wherein a slot that is open toward the front is disposed between the upper head part and the lower head part, for mounting the connection head onto the projection, wherein the slot is delimited toward the top and toward the bottom with slot surfaces, which extend on both sides of a center plane of the slot, wherein for formation of a releasable connection, in which the connection head is locked together, with shape fit, with the vertical scaffolding element, using the wedge that has been inserted through the recess, the connection head is mounted onto the projection of the vertical scaffolding element with its slot, in an essentially horizontal mounting direction, wherein the wedge has been or is brought into an installation position that allows mounting of the connection head, with its slot, in a or the essentially horizontal mounting direction, onto the projection, without any blockage by the wedge, in which installation position the wedge is supported, in the region of its lower wedge end, on wedge support surfaces of a wedge support body of the connecting head, said wedge support body being disposed above the slot and projecting over the slot toward the front, and in which a wedge part of the wedge projects out of the upper head part toward the top beyond the upper head part, and projects in front of the upper head part, toward the front, wherein the connection head, together with the wedge that is in the installation position, is moved toward the projection and/or is mounted onto the projection with its slot, in a or in the essentially horizontal mounting direction, until the wedge impacts against a scaffolding element part of the vertical scaffolding element that extends above the projection, in a or the impact pivot position, with its wedge part that projects out of the upper head part toward the top beyond the upper head part, whereupon the connection head is moved further in a or in the essentially horizontal mounting direction with its slot, toward the front, thereby pivoting the wedge part of the wedge that lies against the scaffolding part toward the rear, relative to the connection head, wherein or after which the wedge lies against a wedge pivot counter-bearing disposed above the wedge support surfaces of the wedge support body, the wedge pivot counter-bearing projecting toward the front of the slot delimiting the upper wedge opening toward the rear, wherein the wedge is then pivoted about the wedge pivot counter-bearing relative to the connection head, in such a manner that its upper wedge part is pivoted toward the rear and, at the same time, its lower wedge end is pivoted toward the front, wherein during the pivoting about the wedge pivot counter-bearing the wedge still remains supported on the wedge support surfaces of the wedge support body, in the or a corresponding installation position, at least until a mounting limit position has been reached, from which position the wedge, if pushing of the connection head onto the projection were to be continued, in a or in the essentially horizontal mounting direction, would automatically move toward the bottom, as the result of gravity and/or with the support of spring force, and wherein the connection head is pushed further toward the front with its then horizontal slot which is delimited toward the top and toward the bottom with the slot surfaces which extend on both sides of the center plane then being a horizontal center plane of the horizontal slot, onto the projection, beyond the mounting limit position, so that the wedge comes loose from the wedge support surfaces because of its pivoting about the wedge pivot counter-bearing, whereupon the wedge automatically moves into a locking position, into or through the recess of the projection, as the result of gravity and/or with the support of spring force with its lower wedge end, in which locking position the connection head is locked together with the projection, with shape fit, using the wedge, so that the connection head can only be removed from the projection after the wedge has been unlocked, via a force that acts on the wedge.

21. Method according to claim 20, wherein the scaffolding component, before being fastened onto the projection with the connection head, either proceeding from a preparation position of the wedge, in which the latter is folded in, in the direction on or onto an outer surface of a component of the scaffolding component that is firmly connected with the connection head, or proceeding from a preparation position of the wedge, in which the latter is loosely pushed only through the upper wedge opening or loosely pushed through the upper and through the lower wedge opening, is rotated by an angle of up to about 180 degrees, about a longitudinal axis in the form of an intersection line at which the center plane of the slot and the vertical plane of the connection head intersect and/or about a longitudinal axis of the scaffolding component, so that the wedge hangs downward, supported on inner support surfaces of the upper head part as the result of gravity.

22. Method according to claim 20, wherein the scaffolding component, before being fastened onto the projection with the connection head, is inclined toward the front and toward the bottom, with the connection head and with the slot leading, into an inclination position in which a or the longitudinal axis in the form of an intersection line at which the center plane of the slot and the vertical plane of the connection head intersect, and/or a or the longitudinal axis of the scaffolding component has/have an inclination angle relative to the horizontal, and in which the wedge hangs downward, supported on inner support surfaces of the Upper head part as the result of gravity.

23. Method according to claim 22, wherein in the said inclination position of the scaffolding component, the wedge that is hanging downward supports itself, with its front wedge edge, on a front wall part of the upper head part that faces downward in this position.

24. Method according to claim 22, wherein subsequently, the scaffolding component, while Maintaining a corresponding inclination position, is rotated back or further, by an angle of about 180 degrees, about the longitudinal axis of the connection head and/or about the longitudinal axis of the scaffolding component, so that as a result, the wedge moves into an upper pivot position in which its wedge part that projects toward the top beyond the upper head part, projects in front of the upper head part toward the front.

25. Method according to claim 24, wherein subsequently, the scaffolding component is pivoted, with its connection head, out of the said inclination position into a less inclined inclination position having a reduced inclination angle that is equal to or less than 12 degrees or that is equal to or less than seven degrees, or that is equal to or less than five degrees, and as a result, the wedge moves into the or a corresponding installation position, in which it is supported on the wedge support surfaces of the wedge support body, from the upper pivot position, toward the bottom, as the result of gravity and/or with the support of spring force.

26. Method according to claim 25, wherein during the movement of the wedge from the upper pivot position downward into the installation position, a or the retainer provided in the region of the lower wedge end of the wedge is guided toward the bottom together with the wedge, lying against a or the wedge guide edge.

* * * * *

UNITED STATES PATENT AND TRADEMARK OFFICE

CERTIFICATE OF CORRECTION

PATENT NO. : 9,080,335 B2
APPLICATION NO. : 13/824633
DATED : July 14, 2015
INVENTOR(S) : Kreller It is certified that error appears in the above-identified patent and that said Letters Patent is hereby corrected as shown below:

Claims

In particular, in Column 62, Line 64 (Line 11 of Claim 22) please change "Upper" to correctly read:
-- upper --.

In Column 63, Line 5 (Line 2 of Claim 24) please change "Maintaining" to correctly read:
-- maintaining --.

Signed and Sealed this
Twenty-fourth Day of November, 2015

Michelle K. Lee

Michelle K. Lee
*Director of the United States Patent and Trademark Office*